US009737762B2

(12) United States Patent
Ortwig

(10) Patent No.: US 9,737,762 B2
(45) **Date of Patent: *Aug. 22, 2017**

(54) FLIPPERS, BOOTS, SYSTEMS INCLUDING SAME, AND METHODS OF USING SAME

(71) Applicant: Cetatek Holdings Inc., North Vancouver (CA)

(72) Inventor: Jan Peter Ortwig, Bowen Island (CA)

(73) Assignee: CETATEK HOLDINGS INC., North Vancouver (CA)

( * ) Notice: Subject to any disclaimer, the term of this patent is extended or adjusted under 35 U.S.C. 154(b) by 109 days.

This patent is subject to a terminal disclaimer.

(21) Appl. No.: 14/171,288

(22) Filed: Feb. 3, 2014

(65) Prior Publication Data

US 2014/0206247 A1 Jul. 24, 2014

Related U.S. Application Data

(63) Continuation of application No. 13/639,446, filed as application No. PCT/CA2011/000395 on Apr. 7, 2011, now Pat. No. 8,641,464.

(Continued)

(51) Int. Cl.
*B63C 11/02* (2006.01)
*A63B 31/10* (2006.01)

(Continued)

(52) U.S. Cl.
CPC ..... *A63B 31/10* (2013.01); *A43B 5/08* (2013.01); *A43B 5/18* (2013.01); *A43B 7/20* (2013.01);

(Continued)

(58) Field of Classification Search
CPC ..... A63B 31/11
See application file for complete search history.

(56) References Cited

U.S. PATENT DOCUMENTS 1,607,857 A * 11/1926 Zukal ..... A63B 31/14 441/64
3,171,142 A 3/1965 Auzols (Continued)

FOREIGN PATENT DOCUMENTS

CN 201220068 Y 4/2009
DE 55619 C 3/1891

(Continued)

OTHER PUBLICATIONS

"Aqua Lung Slingshot," Product Information, Aqua Lung International, Vista, Calif., as early as Feb. 14, 2008, <http://aqualung.com/us/content/view/226/282> [retrieved Jul. 12, 2013], 1 page.

(Continued)

*Primary Examiner* — Edwin Swinehart
(74) *Attorney, Agent, or Firm* — Christensen O'Connor Johnson Kindness PLLC

(57) ABSTRACT

A first flipper has a base, a deformable fin connected to the base, and a first spreader that imposes a first force on the fin that causes the fin to spread in response to relative movement between the first spreader and the fin caused by a first longitudinal deflection of the fin relative to the base. A second flipper has a fin and a foot coupling portion connectable to a foot holding portion of a boot to couple a foot in the foot holding portion to the flipper. A first system includes the flipper and the boot. Methods of using the flippers, the boot, and the system are also disclosed.

26 Claims, 42 Drawing Sheets

Related U.S. Application Data

(60) Provisional application No. 61/322,104, filed on Apr. 8, 2010.

(51) Int. Cl.

| | |
|---|---|
| ***A43B 5/08*** | (2006.01) |
| ***A43B 5/18*** | (2006.01) |
| ***A43B 7/20*** | (2006.01) |
| ***A43B 23/07*** | (2006.01) |
| ***A63B 31/11*** | (2006.01) |

(52) U.S. Cl.

CPC ..... *A43B 23/07* (2013.01); *A63B 31/11* (2013.01); *B63C 11/02* (2013.01); *Y10T 29/49716* (2015.01)

(56) References Cited

U.S. PATENT DOCUMENTS

| | | | | |
|---|---|---|---|---|
| 3,183,529 | A | 5/1965 | Beuchat | |
| 3,302,223 | A | 2/1967 | Ciccotelli | |
| 3,315,286 | A | 4/1967 | Brion | |
| 3,422,470 | A | 1/1969 | Mares | |
| 3,922,741 | A | 12/1975 | Semeia | |
| 3,978,537 | A | 9/1976 | Shamlian | |
| 4,025,977 | A | 5/1977 | Cronin | |
| 4,264,994 | A * | 5/1981 | Carbone | A63B 31/04 441/56 |
| D266,265 | S | 9/1982 | Bowden | |
| 4,538,480 | A | 9/1985 | Trindle | |
| 4,642,056 | A | 2/1987 | Keivanjah | |
| 4,657,515 | A | 4/1987 | Ciccotelli | |
| 4,677,769 | A | 7/1987 | Ahmad | |
| 4,689,029 | A | 8/1987 | Ciccotelli | |
| 4,738,645 | A | 4/1988 | Garofalo | |
| 4,775,343 | A | 10/1988 | Lamont | |
| 4,807,372 | A | 2/1989 | McCall | |
| 4,869,696 | A | 9/1989 | Ciccotelli | |
| 4,887,985 | A | 12/1989 | Garofalo | |
| 5,041,039 | A | 8/1991 | Chang | |
| 5,163,859 | A | 11/1992 | Beltrani | |
| 5,242,321 | A * | 9/1993 | Gil | A63B 31/11 441/64 |
| 5,292,272 | A | 3/1994 | Grim | |
| 5,295,701 | A | 3/1994 | Reiber | |
| 5,303,940 | A | 4/1994 | Brandner | |
| 5,304,081 | A | 4/1994 | Takizawa | |
| 5,324,219 | A | 6/1994 | Beltrani | |
| 5,331,752 | A | 7/1994 | Johnson | |
| D355,012 | S | 1/1995 | Robertson | |
| 5,401,196 | A | 3/1995 | Triantafyllou | |
| 5,443,593 | A | 8/1995 | Garofalo | |
| 5,447,457 | A | 9/1995 | Kamitani | |
| 5,452,907 | A | 9/1995 | Meibock | |
| 5,507,506 | A | 4/1996 | Shadroui | |
| 5,545,067 | A | 8/1996 | Garofalo | |
| 5,551,728 | A | 9/1996 | Barthel | |
| 5,572,806 | A | 11/1996 | Osawa | |
| 5,588,890 | A | 12/1996 | Garofalo | |
| 5,593,333 | A | 1/1997 | Johnson | |
| 5,607,334 | A | 3/1997 | Garofalo | |
| 5,630,775 | A | 5/1997 | Raasch | |
| 5,632,662 | A | 5/1997 | Cadorette | |
| 5,683,279 | A | 11/1997 | Raasch | |
| 5,716,250 | A | 2/1998 | Garofalo | |
| 5,722,867 | A | 3/1998 | LaGrow | |
| 5,746,016 | A | 5/1998 | Freisinger | |
| 5,746,631 | A | 5/1998 | McCarthy | |
| 5,766,050 | A | 6/1998 | Maggi | |
| 5,797,608 | A | 8/1998 | Haldemann | |
| 5,813,889 | A | 9/1998 | Perry | |
| 5,879,212 | A | 3/1999 | Kennedy | |
| 5,941,747 | A | 8/1999 | Garofalo | |
| 6,053,788 | A | 4/2000 | Garofalo | |
| 6,120,038 | A | 9/2000 | Dong | |
| 6,120,336 | A | 9/2000 | Kawai | |
| 6,126,502 | A | 10/2000 | Hull | |
| 6,126,503 | A | 10/2000 | Viale | |
| 6,129,601 | A | 10/2000 | Aucoin | |
| 6,146,224 | A | 11/2000 | McCarthy | |
| 6,179,675 | B1 | 1/2001 | Godoy | |
| 6,227,923 | B1 | 5/2001 | Johnson | |
| 6,290,561 | B1 | 9/2001 | Garofalo | |
| 6,322,411 | B1 | 11/2001 | Evans | |
| 6,322,412 | B2 | 11/2001 | Viale | |
| 6,364,728 | B1 | 4/2002 | Viale | |
| 6,540,574 | B2 | 4/2003 | Hashizume | |
| 6,568,973 | B2 | 5/2003 | Testa | |
| 6,568,974 | B2 | 5/2003 | Semeia | |
| 6,568,975 | B1 | 5/2003 | Perry | |
| 6,672,920 | B2 | 1/2004 | Wilson | |
| 6,702,633 | B1 | 3/2004 | Johnson | |
| 6,719,599 | B2 | 4/2004 | McCarthy | |
| 6,758,708 | B2 | 7/2004 | Angelini | |
| 6,814,640 | B1 | 11/2004 | Houck | |
| 6,843,693 | B2 | 1/2005 | McCarthy | |
| 6,884,134 | B2 | 4/2005 | McCarthy | |
| 7,007,626 | B2 | 3/2006 | Hobson | |
| 7,048,601 | B2 | 5/2006 | Sclafani | |
| 7,086,916 | B2 | 8/2006 | Godoy | |
| 7,115,011 | B2 | 10/2006 | Chen | |
| 7,124,476 | B2 | 10/2006 | Garofalo | |
| 7,134,927 | B1 | 11/2006 | Johnson | |
| 7,140,937 | B2 | 11/2006 | Cadorette | |
| 7,159,336 | B2 | 1/2007 | Burns | |
| 7,172,480 | B2 | 2/2007 | Abbott | |
| D561,862 | S | 2/2008 | Moyal | |
| D561,863 | S | 2/2008 | Moyal | |
| 7,462,085 | B2 | 12/2008 | Moyal | |
| 7,470,164 | B2 | 12/2008 | Moyal | |
| 7,601,041 | B2 | 10/2009 | McCarthy | |
| 7,815,477 | B2 | 10/2010 | Garofalo | |
| 7,988,510 | B2 | 8/2011 | Beltrani | |
| 8,087,959 | B2 | 1/2012 | Hsu | |
| 8,376,796 | B1 | 2/2013 | Vock | |
| 2007/0004295 | A1 | 1/2007 | Rocci | |
| 2007/0032144 | A1 | 2/2007 | Ketterman | |
| 2007/0077831 | A1 | 4/2007 | Kuo | |
| 2008/0185816 | A1 | 8/2008 | Riepler | |
| 2010/0029153 | A1 | 2/2010 | Testa | |
| 2010/0075554 | A1 | 3/2010 | Johnson | |
| 2011/0312231 | A1 | 12/2011 | Montemurro | |
| 2015/0231449 | A1 | 8/2015 | Ortwig | |

FOREIGN PATENT DOCUMENTS

| | | | |
|---|---|---|---|
| DE | 84 22 316.2 | U1 | 11/1984 |
| DE | 90 17 320.1 | U1 | 4/1991 |
| DE | 40 40 985 | C1 | 6/1992 |
| DE | 296 22 809 | U1 | 8/1997 |
| DE | 196 13 208 | A1 | 10/1997 |
| DE | 196 33 905 | A1 | 10/1997 |
| DE | 196 54 899 | A1 | 11/1997 |
| DE | 197 00 497 | A1 | 7/1998 |
| DE | 197 26 109 | A1 | 7/1998 |
| DE | 101 52 438 | A1 | 4/2003 |
| EP | 0 310 828 | B1 | 11/1991 |
| EP | 0 572 853 | A1 | 8/1993 |
| EP | 0 884 073 | A2 | 12/1998 |
| EP | 0 890 375 | A1 | 1/1999 |
| EP | 1 297 869 | A1 | 4/2003 |
| EP | 1 389 483 | B1 | 2/2004 |
| EP | 1 591 145 | A1 | 11/2005 |
| EP | 2 058 032 | A1 | 5/2009 |
| FR | 2 659 534 | A1 | 9/1991 |
| FR | 2 659 862 | A1 | 9/1991 |
| FR | 2 725 880 | A1 | 4/1996 |
| FR | 2 794 374 | A1 | 12/2000 |
| GB | 1 033 304 | A | 6/1966 |
| WO | 88/01523 | A1 | 3/1988 |
| WO | 91/16957 | A1 | 11/1991 |
| WO | 95/03101 | A1 | 2/1995 |
| WO | 97/36655 | A1 | 10/1997 |
| WO | 97/49603 | A1 | 12/1997 |

(56) References Cited

FOREIGN PATENT DOCUMENTS

| | | | |
|---|---|---|---|
| WO | 98/30294 | A1 | 7/1998 |
| WO | 99/47013 | A1 | 9/1999 |
| WO | 00/78606 | A1 | 12/2000 |
| WO | 02/47776 | A2 | 6/2002 |
| WO | 2006/058849 | A1 | 6/2006 |
| WO | 2007/138367 | A1 | 12/2007 |
| WO | 2008/087589 | A1 | 7/2008 |
| WO | 2011/080432 | A1 | 7/2011 |
| WO | 2011/123950 | A1 | 10/2011 |
| WO | 2011/134066 | A1 | 11/2011 |
| WO | 2014/056066 | A1 | 4/2014 |

OTHER PUBLICATIONS

"Cressi Scuba Diving Fins," Product Information, Cressi Sub S.p. A., Genoa, Italy, as early as Apr. 5, 2011, <http://www.cressisubusa.com/catalogue /index.asp?CategoriaID=101020> [retrieved Jul. 12, 2013], 3 pages.

Extended European Search Report mailed Aug. 1, 2013, in related European Application No. 11 764 992.1, filed Apr. 7, 2011, 5 pages.

International Search Report mailed Jul. 12, 2013, issued in related International Application No. PCT/CA2012/000946, filed Oct. 12, 2012, 2 pages.

"Lundblue: Lunocet—Pioneering Biomimetic Propulsion," Product Sheet, Ciamillo Components, Inc., Nicholson, Ga., <http://www.lunocet.com/> [retrieved Jan. 1, 2010], 1 page.

McKenzie, J., "Two Mares Fins: The Volo Power is Still Strong and the Next Gen X-Stream is High Tech," Jul. 28, 2011, ScubaGadget, Scuba News Service, <http://www.scubagadget.com/?p=1555> [retrieved Jan. 16, 2013], 4 pages.

"Omega Aquatics Amphibian Fins," Product Information, Soldier Systems: An Industry Daily, Jul. 11, 2008, <http://soldiersystems.net/2008/07/11/omega-aquatics-amphibian-fins/> [retrieved Jan. 17, 2013], 2 pages.

"Open Heel—Mares," Product Information, Mares S.p.A., Rapallo, Italy, <http://www.mares.com/products/fins/open-heel/?region=eu> [retrieved Jan. 16, 2013], 2 pages.

"Scuba Dive Fins," Product Information, Waikiki Dive Centre, Singapore, <http://www.waikikidive.com/TUSA_MARES_FINS.htm> [retrieved Jan. 16, 2013], 7 pages.

"TUSA Fins," Product Information,TUSA (Tabata USA), Tokyo, as early as Jul. 23, 2012, <http://tusa.com/us-en/Tusa/Fins> [retrieved Jul. 12, 2013], 1 page.

"X-Stream—Open Heel—Mares—Just Add Water," Product Sheet, Mares S.p.A., Rapallo, Italy, <http://www.mares.com/products/fins/open-heel/x-stream/241/?region=eu> [retrieved Nov. 21, 2012], 1 page.

International Search Report mailed Mar. 11, 2016, issued in corresponding International Application No. PCT/CA2015/051278, filed Dec. 4, 2015, 4 pages.

* cited by examiner

FLIPPERS, BOOTS, SYSTEMS INCLUDING SAME, AND METHODS OF USING SAME

CROSS-REFERENCES TO RELATED APPLICATIONS

This application is a continuation of U.S. patent application Ser. No. 13,639,446, filed Oct. 4, 2012, which is the national stage of International Application No. PCT/CA2011/000395, filed Apr. 7, 2011, which claims the benefit of U.S. Provisional Patent Application No. 61/322,104, filed Apr. 8, 2010, all of which are incorporated by reference herein in their entirety.

BACKGROUND

1. Field of Invention

This invention relates generally to flippers and boots, and more particularly to flippers, boots, systems including the flippers and boots, and methods of using the flippers, boots, and systems.

2. Description of Related Art

A user can couple a known flipper to each foot of the user. These known flippers have fins, and when the user kicks in water, for example, the fins can facilitate generating propulsion in the water.

Many known flippers react passively to kicks in water. For example, in many known flippers, the fins maintain generally constant shapes in response to a kick in water. These fins can disadvantageously generate inefficient water flow around the fins. For example, water in the kick path of the fin may be displaced towards lateral sides or a front side of the fin, and such water generally does not contribute to propulsion, disadvantageously reducing efficiency of the flipper.

Other known fins change shape in response to a kick in water, but water in the kick path of these fins generally causes longitudinal center portions of these fins to be displaced away from longitudinal lateral portions of these fins opposite a direction of the kick, causing these fins to curve and become narrower in response to a kick. These fins therefore have reduced widths and thus reduced effective areas during a kick and greater widths when the user is not kicking. Thus, during a kick, effective areas of these fins are disadvantageously reduced. When the user is not kicking, the fin is wider, disadvantageously causing greater drag in the water.

Also, many known flippers have foot pockets for receiving a foot of a user, but these foot pockets are generally integral to the fin and available only in a small number of standard sizes. Therefore, when a user selects a flipper, a user must also select a single foot pocket size of the flipper, often from among a small number of available sizes. Therefore, these foot pockets often do not comfortably fit a foot of a user, and space between the foot and an inside wall of the foot pocket can receive water, disadvantageously adding to drag of the flipper in water and limiting the control of the user over the flipper.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one aspect of the invention, there is provided a method of changing a lateral shape of a deformable fin having first and second laterally opposite side elements connected to a base by respective first and second hinges. The method involves causing a first distal end of a first spreader having a first proximal end coupled to the base to impose a first force on the fin in response to relative movement between the first spreader and the fin caused by a first longitudinal deflection of the fin relative to the base in a first deflection direction. The method also involves using the first force from the first spreader to spread the first and second laterally opposite side elements apart.

In accordance with another aspect of the invention, there is provided a method of coupling a foot to a flipper having a fin coupled to a foot coupling portion. The method involves: connecting a first connector on a first end of the foot coupling portion to a first complementary connector in a first region of a foot holding portion of a boot; and connecting a second connector on a second end of the foot coupling portion opposite the first end of the foot coupling portion to a second complementary connector in a second region of the foot holding portion of the boot spaced apart from the first region of the foot holding portion of the boot.

In accordance with another aspect of the invention, there is provided a flipper apparatus including: a base; a deformable fin having first and second laterally opposite side elements; first and second hinges connecting the first and second laterally opposite side elements respectively to the base; first means for imposing a first force on the fin in response to relative movement between the first means for imposing and the fin caused by a first longitudinal deflection of the fin relative to the base in a first deflection direction; and means for using the first force from the first means for imposing to spread the first and second laterally opposite side elements apart.

In accordance with another aspect of the invention, there is provided a flipper apparatus coupleable to a boot having a foot holding portion having first and second spaced-apart regions. The apparatus includes a fin and a foot coupling portion coupled to the fin. The foot coupling portion has: first and second opposite ends; a first connecting means on the first end of the foot coupling portion for connecting with a first complementary connecting means in the first region of the foot holding portion of the boot; and a second connecting means on the second end of the foot coupling portion for connecting with a second complementary connecting means in the second region of the foot holding portion of the boot.

In accordance with another aspect of the invention, there is provided a boot coupleable to a flipper having a foot coupling portion having first and second opposite ends. The boot includes: a foot holding portion having first and second spaced-apart regions; a first connecting means of the first region of the foot holding portion for connecting with a first complementary connecting means on the first end of the foot coupling portion of the flipper; and a second connecting means of the second region of the foot holding portion for connecting with a second complementary connecting means on the second end of the foot coupling portion of the flipper.

In accordance with another aspect of the invention, there is provided a flipper system including the flipper and the boot.

In accordance with another aspect of the invention, there is provided a flipper apparatus including: a base; a deformable fin having first and second laterally opposite side elements; first and second hinges connecting the first and second laterally opposite side elements respectively to the base; and a first spreader having a first proximal end coupled to the base and a first distal end operably configured to impose a first force on the fin and to spread the first and second laterally opposite side elements to spread apart in response to relative movement between the first spreader and the fin caused by a first longitudinal deflection of the fin relative to the base in a first deflection direction.

In accordance with another aspect of the invention, there is provided a flipper apparatus coupleable to a boot having a foot holding portion having first and second spaced-apart regions. The apparatus includes a fin and a foot coupling portion coupled to the fin. The foot coupling portion has: first and second opposite ends; a first connector on the first end of the foot coupling portion configured to connect with a first complementary connector in the first region of the foot holding portion of the boot; and a second connector on the second end of the foot coupling portion configured to connect with a second complementary connector in the second region of the foot holding portion of the boot.

In accordance with another aspect of the invention, there is provided a boot coupleable to a flipper having a foot coupling portion having first and second opposite ends. The boot includes: a foot holding portion having first and second spaced-apart regions; a first connector of the first region of the foot holding portion configured to connect with a first complementary connector on the first end of the foot coupling portion of the flipper; and a second connector of the second region of the foot holding portion configured to connect with a second complementary connector on the second end of the foot coupling portion of the flipper.

In accordance with another aspect of the invention, there is provided a flipper system including the flipper and the boot.

Other aspects and features of the present invention will become apparent to those ordinarily skilled in the art upon review of the following description of specific embodiments of the invention in conjunction with the accompanying figures.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

In drawings that illustrate embodiments of the invention.

DETAILED DESCRIPTION

Figure 1:
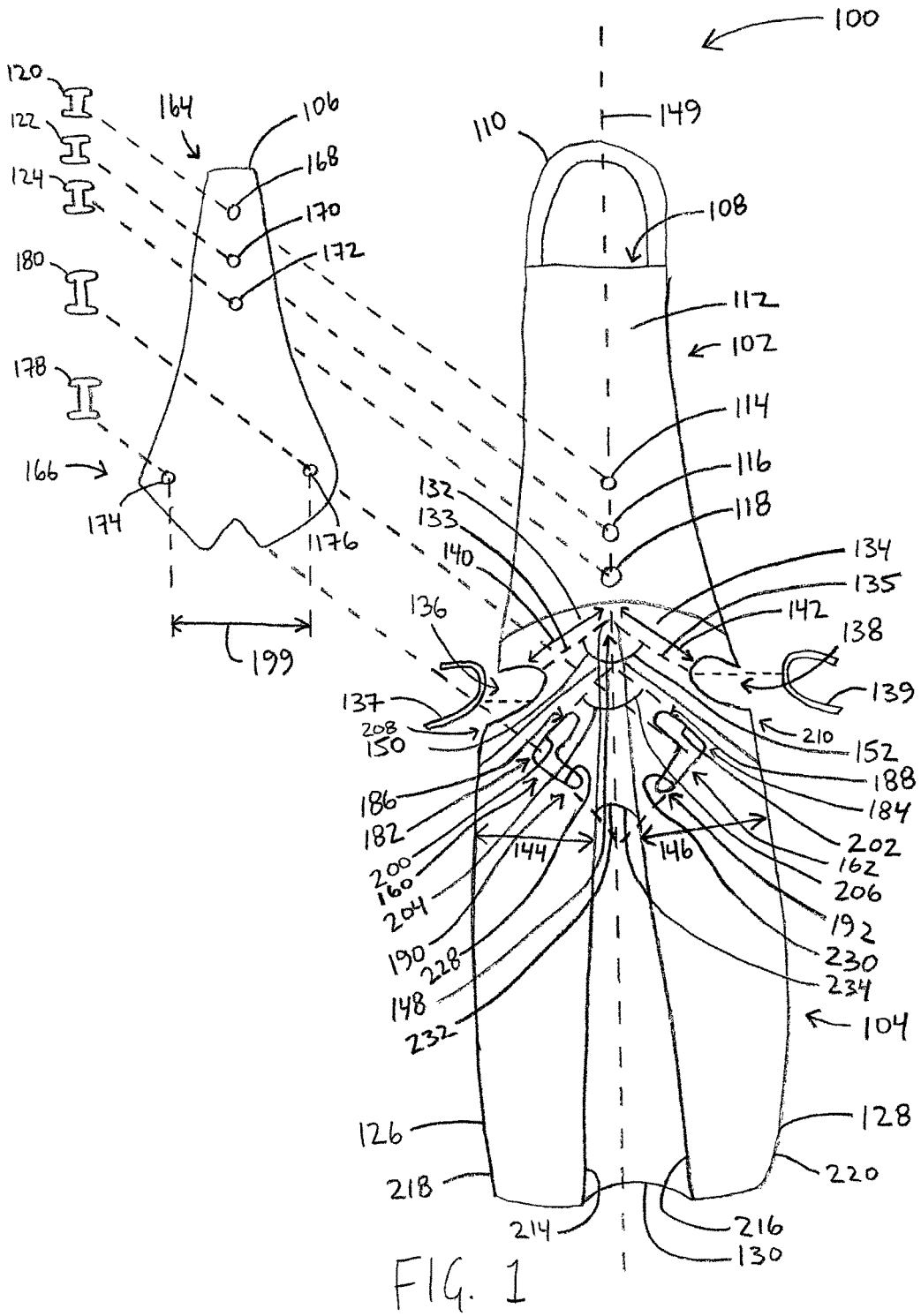
FIG. 1 is an exploded bottom view of a flipper in accordance with an embodiment of the invention.

Referring to FIG. 1, a flipper in accordance with an embodiment of the invention is shown generally at 100. The flipper 100 includes a base shown generally at 102, a deformable fin shown generally at 104, and a spreader 106.

In the embodiment shown, the base 102 is made from a moderately flexible thermoplastic material. The thermoplastic materials in the various embodiments disclosed herein may include various known thermoplastic materials, such as thermoplastic polyurethane, polypropylene, polyamides, thermoplastic elastomers, styrene-butadiene-styrene, styrene-ethylene-butadiene-styrene, ethylene, polyolefine, acetal resin, polyoxymethylene plastic such as Delrin™ or Delrin 107™, and/or combinations of two or more thereof, for example. These thermoplastic materials may also be fiber-infused, and/or include composite matrix materials including glass and/or carbon fibers, for example.

The base 102 defines a foot pocket 108 for receiving a foot of a user (not shown), and a heel-retaining strap 110 extending from laterally opposite sides of the base 102 and across an opening of the foot pocket 108 for contacting a heel of the foot to hold the foot in the foot pocket 108. The base 102 also has a bottom wall 112 defining through-holes 114, 116, and 118 for receiving fasteners 120, 122, and 124 respectively. The fasteners 120, 122, and 124 in the embodiment shown are metallic rivets, although it will be appreciated that these fasteners may alternatively be threaded fasteners or other fasteners, for example.

When a user wearing the flipper 100 walks on a surface, the bottom wall 112 generally faces downward and therefore generally contacts the surface. In general, the "bottom" side of a flipper herein refers to a side of the flipper that faces downward and generally contacts a surface when a user of the flipper walks on the surface. However, when using a flipper in water, a user generally faces downward, and therefore a "bottom" of a flipper herein refers to a surface that generally faces upward when the flipper is in use. A drawing of a "bottom view" herein generally refers to a view of such a "bottom" side of a flipper, and in the case of a flipper in use, a "bottom view" herein therefore generally refers to a view from above.

The fin 104 has first and second laterally opposite side elements 126 and 128, which in the embodiment shown are made from a relatively rigid thermoplastic material. Herein, a "relatively rigid thermoplastic material" may refer to a thermoplastic material having a modulus of elasticity of about 100 megapascals (MPa) to about 500 MPa, for example.

The fin 104 also has and an elastically deformable web 130 coupled to and extending between the first and second laterally opposite side elements 126 and 128. In the embodiment shown, the web 130 is made from a relatively flexible thermoplastic material. Herein, a "relatively flexible thermoplastic material" may refer to a thermoplastic material having a modulus of elasticity of about 30 MPa to about 200 MPa, for example.

The first and second laterally opposite side elements 126 and 128 are connected to the base 102 by first and second hinges 132 and 134 respectively. The first and second hinges 132 and 134 respectively define first and second recesses shown generally at 136 and 138. The first and second recesses 136 and 138 give the first and second hinges 132 and 134 respective minimum widths 140 and 142 that are less than respective widths 144 and 146 of the first and second laterally opposite side elements 126 and 128 respectively. In the embodiment shown, the first and second hinges 132 and 134 are made from a relatively flexible and resilient thermoplastic material, although the first and second hinges 132 and 134 also include first and second arcuate resilient restoring members 137 and 139 respectively surrounding the first and second recesses 136 and 138 respectively and made from a relatively rigid and resilient thermoplastic material.

In the embodiment shown, the base 102, the first and second laterally opposite side elements 126 and 128, the web 130, and the first and second hinges 132 and 134 are unitarily formed in a multi-stage injection moulding process, although alternatively these elements may be formed by other processes.

Because the first and second hinges 132 and 134 have respective minimum widths 140 and 142 that are less than the respective widths 144 and 146 of the first and second laterally opposite side elements 126 and 128 respectively, and because the first and second hinges are made from a more flexible material than the base 102 and the first and second laterally opposite side elements 126 and 128, the flipper 100 is generally most flexible at the first and second hinges 132 and 134. Therefore, the first and second laterally opposite side elements 126 and 128 have a tendency to rotate about first and second hinge axes 133 and 135 respectively of the first and second hinges 132 and 134 respectively in response to a kicking force applied by a foot coupled to the base 102 in a fluid such as water (not shown), for example. This rotation of the first and second laterally opposite side elements 126 and 128 about the first and second hinge axes 133 and 135 respectively facilitates longitudinal deflection of the fin 104 relative to the base 102.

The first and second hinge axes 133 and 135 extend generally between the first and second recesses 136 and 138 respectively and an intersection region shown generally at 148 between the first and second laterally opposite side elements 126 and 128 and the base 102. The first and second recesses 136 and 138 are disposed forwardly of (that is, in a direction toward the fin 104 and away from the base 102 from) the intersection region 148. The first and second hinge axes 133 and 135 therefore extend away from a central longitudinal axis 149 of the fin 104 and away from the base 102 at respective acute angles 150 and 152 from the central longitudinal axis 149 of the fin 104.

The first and second laterally opposite side elements 126 and 128 define first and second v-shaped guides shown generally at 160 and 162 respectively, which in the embodiment shown are channels extending through the first and second laterally opposite side elements 126 and 128 respectively.

The spreader 106 in the embodiment shown is made from a relatively rigid thermoplastic material, and has a proximal end shown generally at 164 and a distal end shown generally at 166. At the proximal end 164, the spreader 106 defines through-holes 168, 170, and 172 that are aligned with the through-holes 114, 116, and 118 in the bottom wall 112 of the base 102. The through-holes 114, 116, 118 and the through-holes 168, 170, and 172 receive the fasteners 120, 122, and 124 respectively to couple the proximal end 164 of the spreader 106 to the base 102 and hold the proximal end 164 of the spreader 106 in a substantially fixed position relative to the base 102.

At the distal end 166, the spreader 106 defines through-holes 174 and 176. The through-holes 174 and 176 and the first and second guides 160 and 162 respectively receive fasteners (which may also be referred to as "pins") 178 and 180. The fasteners 178 and 180 in the embodiment shown are metallic rivets, although it will be appreciated that these fasteners may alternatively be threaded fasteners or other fasteners, for example.

When the flipper 100 is not subjected to any deflecting forces, the flipper 100 may be referred to as being undeflected, such that the bottom wall 112 of the base 102 is generally coplanar with the fin 104, and the spreader 106 is generally planar, and parallel to and spaced apart from, the bottom wall 112 and the fin 104. When the flipper 100 is undeflected, the fasteners 178 and 180 are disposed at respective undeflected positions shown generally at 182 and 184 at respective apexes of the first and second guides 160 and 162.

However, the fasteners 178 and 180 can slide away from the respective undeflected positions 182 and 184 towards respective inner proximal ends shown generally at 186 and 188 of the first and second guides 160 and 162, or towards respective inner distal ends shown generally at 190 and 192 of the first and second guides 160 and 162 respectively. Therefore, while the proximal end 164 of the spreader 106 is held in a substantially fixed position relative to the base 102, the distal end 166 of the spreader 106 is coupled to the first and second laterally opposite side elements 126 and 128 and held longitudinally slidably to the fin 104.

Figure 2:
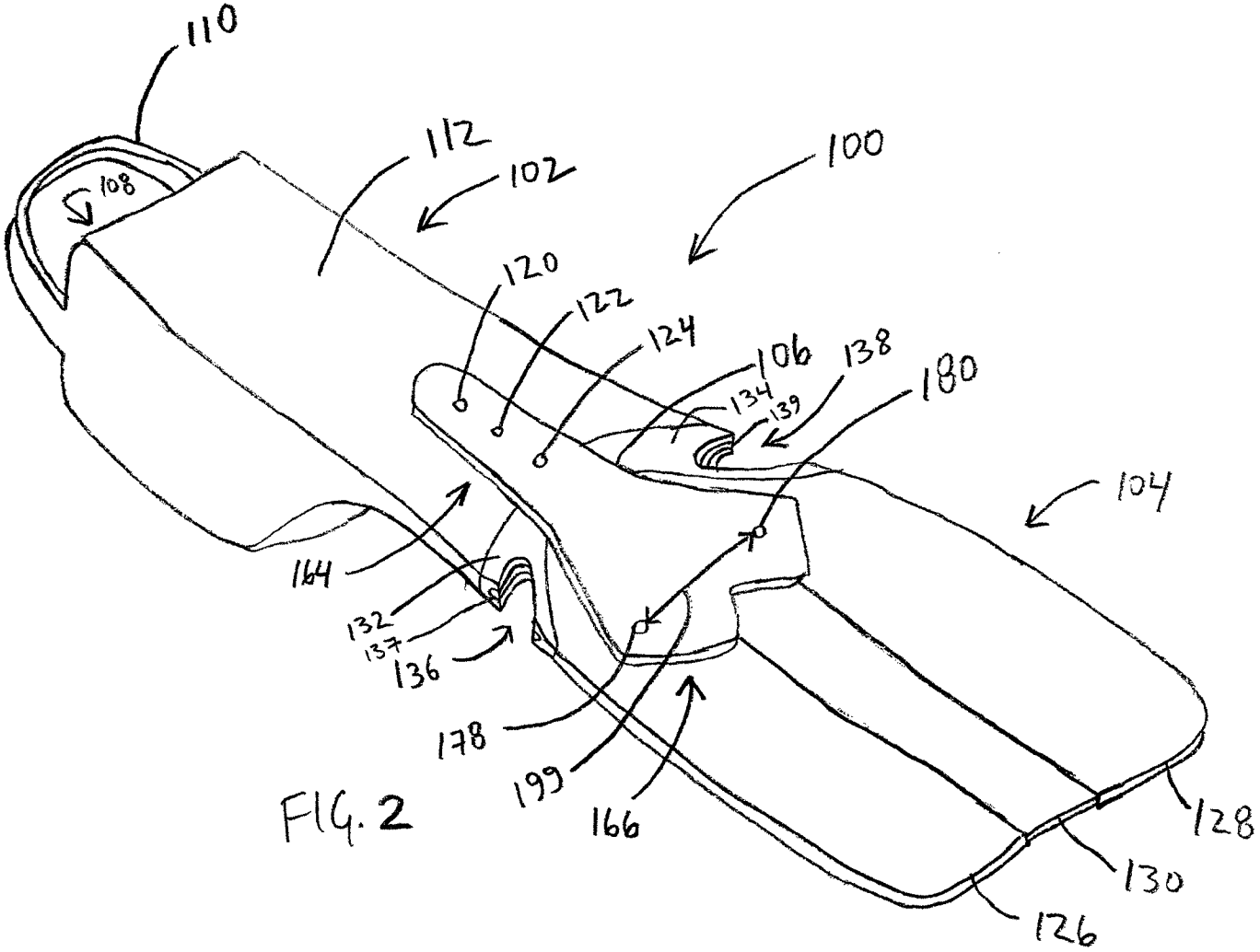
FIG. 2 is a bottom oblique view of the flipper of FIG. 1, showing an undeflected fin of the flipper of FIG. 1.

Referring to FIG. 2, the flipper 100 is shown with the spreader 106 thus held on the base 102 and fin 104 while the flipper 100 is undeflected.

Figure 3:
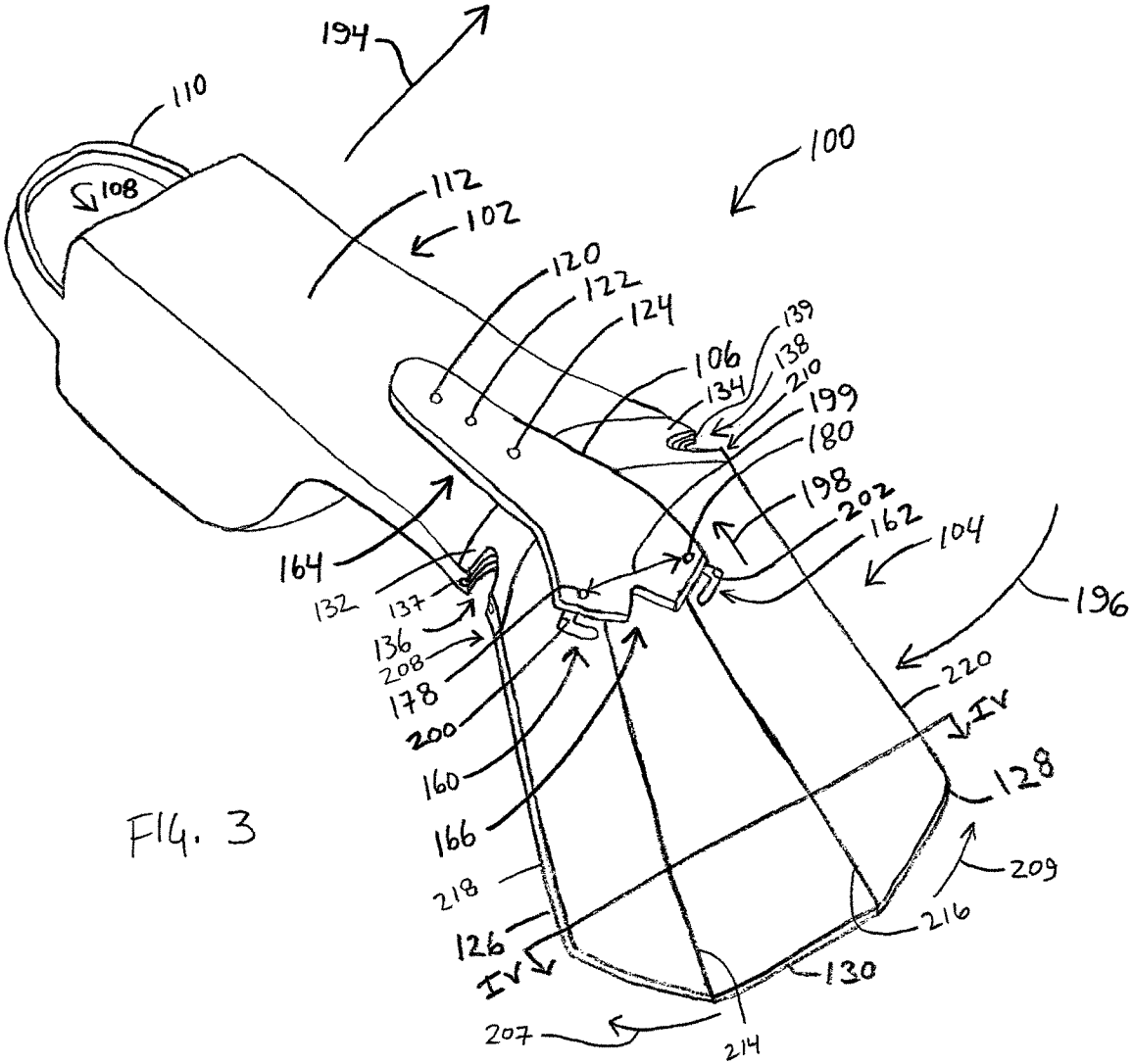
FIG. 3 is a bottom oblique view of the flipper of FIG. 1, showing the fin of the flipper of FIG. 1 deflected in a downward direction in response to an upward kick.

Referring to FIG. 3, the flipper 100 is shown deflected in response to an upward kick in the direction of the arrow 194 of the user in a fluid such as water (not shown), for example. In response to the upward kick, the fin 104 deflects in a downward deflection direction longitudinally relative to the base 102 at the first and second hinges 132 and 134 in the direction of the arrow 196.

Because the spreader 106 is on a same side of the base 102 and the fin 104, the proximal end 164 of the spreader 106 is held in a substantially fixed position relative to the base 102 by the fasteners 120, 122, and 124, and the distal end 166 of the spreader 106 is held longitudinally slidably to the fin 104, the spreader 106 flexes longitudinally in response to the longitudinal deflection of the fin 104 relative to the base 102, and remains generally parallel to and spaced apart from the fin 104. Thus, in response to longitudinal deflection of the fin 104 relative to the base 102 in the direction of the arrow 196, the distal end 166 of the spreader 106 moves longitudinally relative to the fin 104 in the direction of the arrow 198, thus urging the fasteners 178 and 180 towards the respective inner proximal ends 186 and 188 (shown in FIG. 1) of the first and second guides 160 and 162 respectively.

As indicated above, the spreader 106 in the embodiment shown is made from a relatively rigid thermoplastic material, and therefore maintains a generally constant separation distance 199 between the fasteners 178 and 180. Thus, as the fasteners 178 and 180 move relative to the fin 104 towards the respective inner proximal ends (186 and 188) of the first and second guides 160 and 162 respectively in response to the longitudinal deflection of the fin 104, the fasteners 178 and 180 slide along respective walls 200 and 202 of the first and second guides 160 and 162, and impose respective thrust forces in the direction of the arrow 198 on the respective walls 200 and 202. These respective thrust forces may collectively be referred to as "a first force" and the spreader 106 thus imposes the first force on the fin 104 in response to relative movement between the distal end 166 of the spreader 106 and the fin 104 caused by longitudinal deflection of the fin 104 relative to the base 102.

The walls 200 and 202 are disposed at respective acute angles 204 and 206 to the central longitudinal axis 149 (shown in FIG. 1) of the fin 104. Because the respective walls 200 and 202 of the first and second guides 160 and 162 are disposed at the respective acute angles (204 and 206) to the central longitudinal axis (149) of the fin 104, and because the spreader 106 maintains the generally constant separation distance (199) between the fasteners 178 and 180, the respective walls 200 and 202 receive and use the respective thrust forces caused by the longitudinal deflection of the fin 104 relative to the base 102 to cause the walls 200 and 202 to be pushed apart and thereby to cause the first and second laterally opposite side elements 126 and 128 to spread apart by moving or rotating laterally about the first and second hinges 132 and 134 respectively in the directions of the arrows 207 and 209 respectively. This spreading elastically deforms the elastically deformable web 130 by stretching the elastically deformable web 130 to accommodate the separation of the first and second laterally opposite side elements 126 and 128, and changes a lateral shape of the fin 104.

When the first and second laterally opposite side elements 126 and 128 move laterally about the first and second hinges 132 and 134, respective regions shown generally at 208 and 210 of the first and second laterally opposite side elements 126 and 128 move into the first and second recesses 136 and 138 respectively. The first and second recesses 136 and 138 thus accommodate lateral movement of the first and second laterally opposite side elements 126 and 128 respectively about the first and second hinges 132 and 134 respectively.

As the respective regions 208 and 210 of the first and second laterally opposite side elements 126 and 128 move into the first and second recesses 136 and 138 respectively, the first and second arcuate resilient restoring members 137 and 139 are resiliently deformed, storing therein elastic potential energy. This elastic potential energy is usable to facilitate moving the first and second laterally opposite side elements 126 and 128 in respective directions opposite the directions of the arrows 207 and 209 respectively as the fin is restored to the undeflected position shown in FIG. 2.

Figure 4:
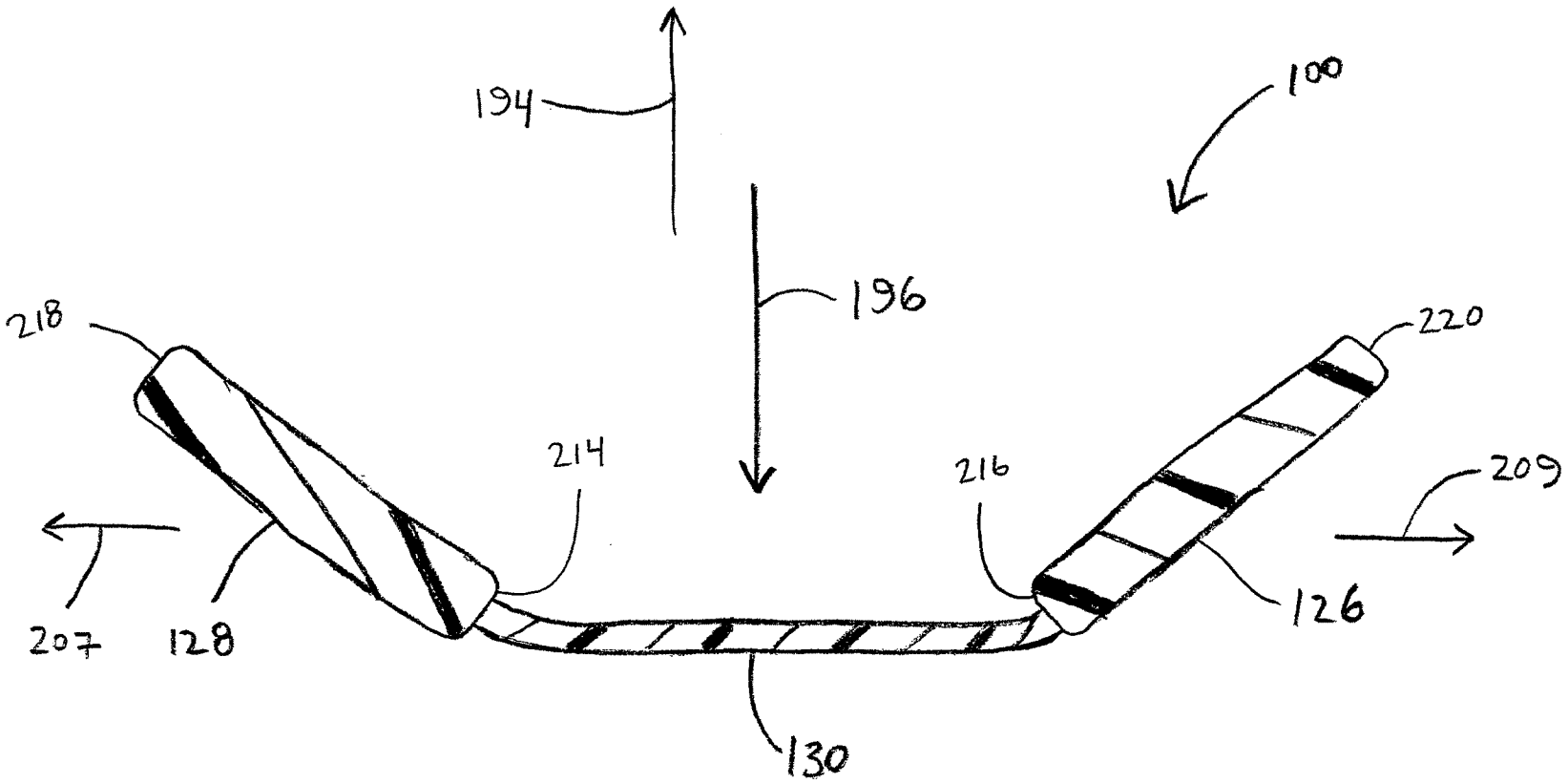
FIG. 4 is a cross-sectional view of the flipper of FIG. 1, taken along the line IV-IV in FIG. 3.

As shown in FIG. 1 and discussed above, the first and second hinge axes 133 and 135 are disposed at respective acute angles 150 and 152 to the central longitudinal axis 149 of the fin 104. Referring to FIGS. 1, 3, and 4, due to the acute angles 150 and 152 of the first and second hinge axes 133 and 135, when the first and second laterally opposite side elements 126 and 128 rotate about the first and second hinge axes 133 and 135 respectively, respective inner sides 214 and 216 of the first and second laterally opposite side elements 126 and 128 move in the downward deflection direction of the arrow 196 by a greater distance than respective outer sides 218 and 220 of the first and second laterally opposite side elements 126 and 128. The first and second hinges 132 and 134 thus impart a concave shape to the fin 104, opposite the downward deflection direction of the arrow 196, when the first and second laterally opposite side elements 126 and 128 are rotated about the first and second hinge axes 133 and 135 respectively in response to longitudinal deflection of the fin 104 relative to the base 102.

In different embodiments, the acute angles 150 and 152 may be varied to vary the degree of concavity that results from longitudinal deflection of the fin 104 relative to the base 102. For example, the angles 150 and 152 may be reduced generally to increase concavity that results from longitudinal deflection of the fin 104 relative to the base 102. Alternatively, the acute angles 150 and 152 may be increased generally to decrease concavity that results from longitudinal deflection of the fin 104 relative to the base 102.

Figure 5:
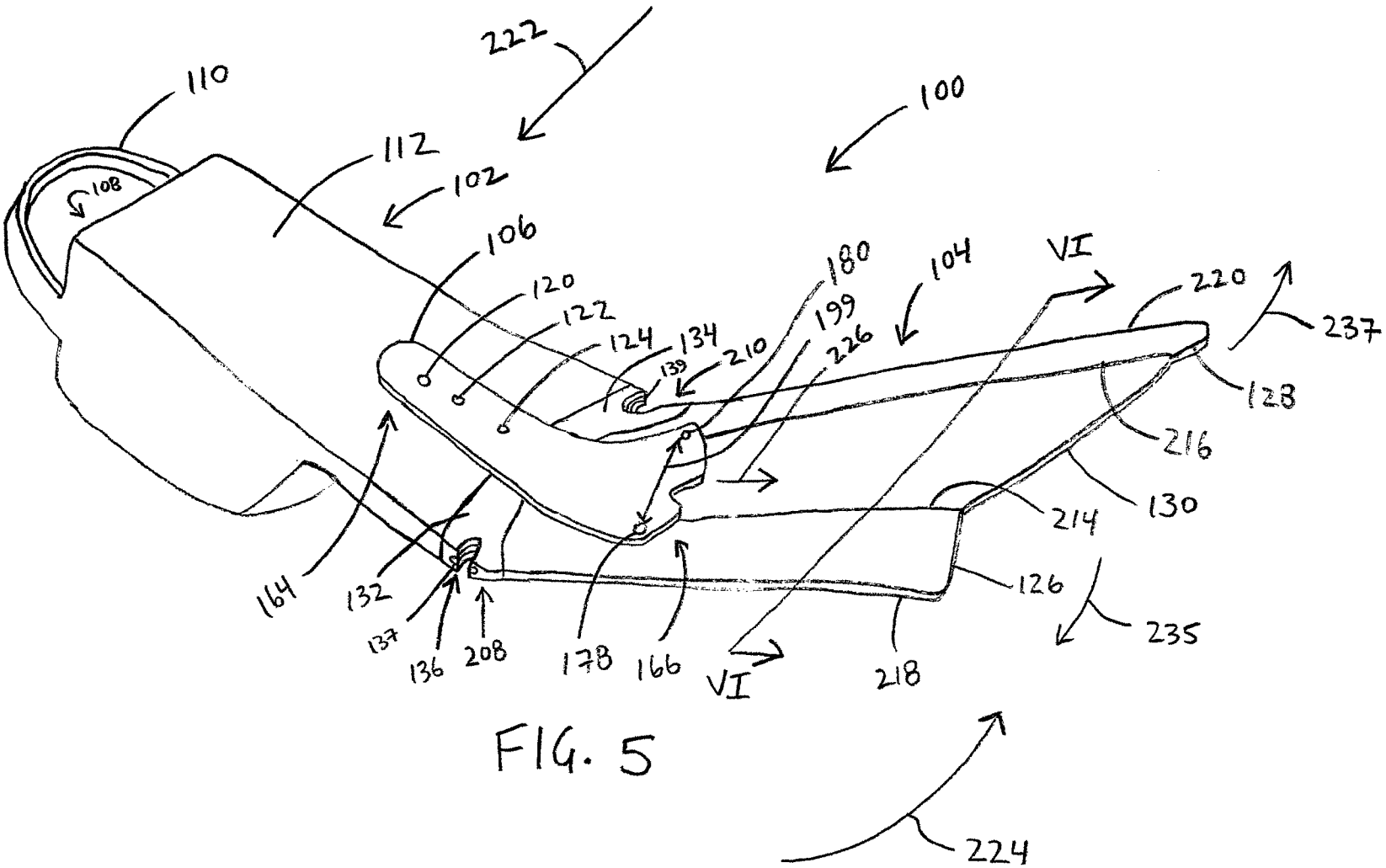
FIG. 5 is a bottom oblique view of the flipper of FIG. 1, showing the fin of the flipper of FIG. 1 deflected upward in response to a downward kick.

Referring to FIG. 5, the flipper 100 is shown deflected in response to a downward kick in the direction of the arrow 222 of the user in a fluid such as water (not shown), for example. In response to the downward kick, the fin 104 deflects in an upward deflection direction longitudinally relative to the base 102 at the first and second hinges 132 and 134 in the direction of the arrow 224.

As with the upward kick shown in FIG. 3, the spreader 106 flexes longitudinally in response to the longitudinal deflection of the fin 104 relative to the base 102, and remains generally parallel to and spaced apart from the fin 104. Thus, in response to the longitudinal deflection of the fin 104 relative to the base 102 in the direction of the arrow 224, the distal end 166 of the spreader 106 moves longitudinally relative to the fin 104 in the direction of the arrow 226, thus urging the fasteners 178 and 180 towards the respective inner distal ends 190 and 192 of the first and second guides 160 and 162 respectively (shown in FIG. 1).

Again, the spreader 106 maintains the generally constant separation distance 199 between the fasteners 178 and 180, such that as the fasteners 178 and 180 move towards the respective inner distal ends (190 and 192) of the first and second guides (160 and 162), the fasteners 178 and 180 slide along respective walls 228 and 230 of the first and second guides 160 and 162 (shown in FIG. 1), and impose respective thrust forces (which again may be collectively referred to as "a first force") in the direction of the arrow 226 on the respective walls (228 and 230).

The walls 228 and 230 are also disposed at respective acute angles 232 and 234 to the central longitudinal axis 149 (shown in FIG. 1) of the fin 104. As with the upward kick shown in FIG. 3, the downward kick shown in FIG. 5 causes the respective walls (228 and 230) of the first and second guides 160 and 162 to receive and use the respective thrust forces by causing the walls (228 and 230) to separate, and thereby causing the first and second laterally opposite side elements 126 and 128 to spread apart by moving or rotating laterally about the first and second hinges 132 and 134 respectively in the directions of the arrows 235 and 237 respectively, elastically deforming and stretching the web 130, causing the respective regions 208 and 210 of the first and second laterally opposite side elements 126 and 128 to move into the first and second recesses 136 and 138 respectively, and thereby changing a lateral shape of the fin 104.

Figure 6:
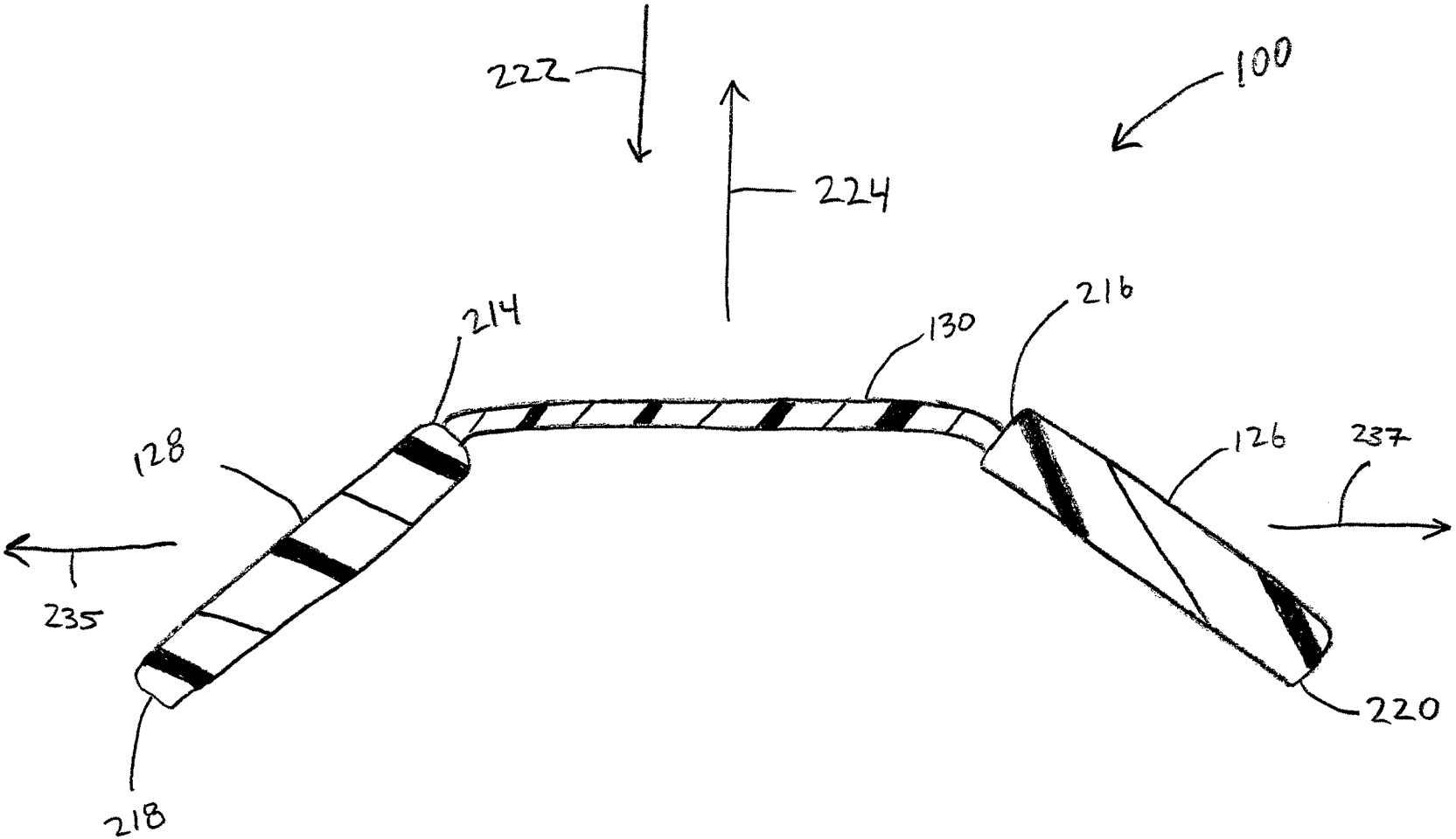
FIG. 6 is a cross-sectional view of the flipper of FIG. 1, taken along the line VI-VI in FIG. 5.

Referring to FIGS. 1, 5, and 6, as with the upward kick shown in FIG. 3, because the first and second hinge axes 133 and 135 extend away from the central longitudinal axis 149 of the fin 104 and away from the base 102 at respective acute angles 150 and 152 from the central longitudinal axis 149 of the fin 104, the downward kick shown in FIG. 5 causes the respective inner sides 214 and 216 of the first and second laterally opposite side elements 126 and 128 to move in the upward deflection direction of the arrow 224 by a greater distance than the respective outer sides 218 and 220 of the first and second laterally opposite side elements 126 and 128, and the first and second hinges 132 and 134 thus impart a concave shape to the fin 104 opposite the upward deflection direction of the arrow 224.

Figure 7:
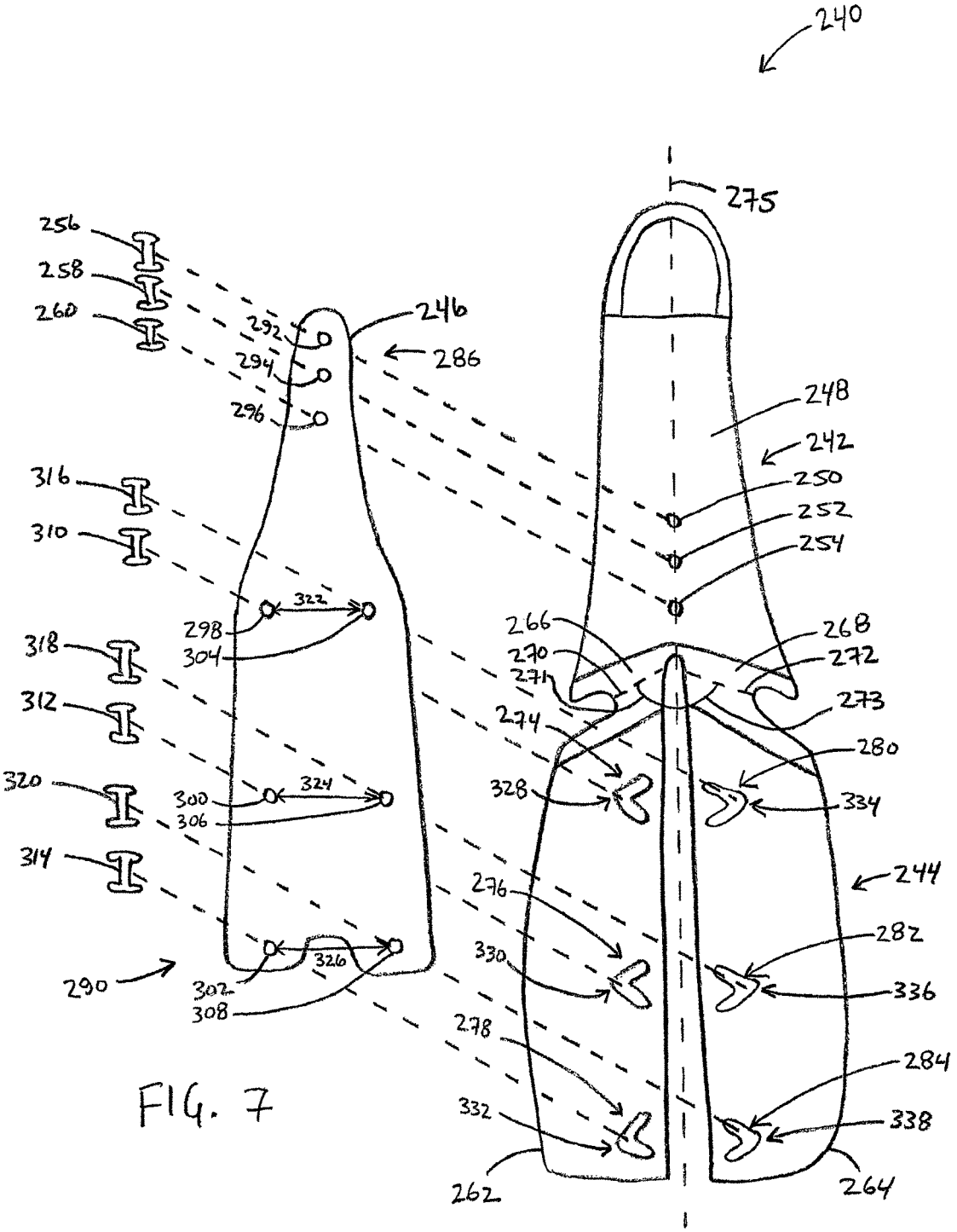
FIG. 7 is an exploded bottom view of a flipper in accordance with another embodiment of the invention.

Referring to FIG. 7, a flipper in accordance with another embodiment of the invention is shown generally at 240. The flipper 240 includes a base shown generally and 242, a deformable fin shown generally at 244, and a spreader 246. The base 242 is substantially the same as the base 102 shown in FIGS. 1 to 6, and includes a bottom wall 248 defining through-holes 250, 252, and 254 for receiving fasteners 256, 258, and 260 respectively. The fasteners 256, 258, and 260 in the embodiment shown are metallic rivets, although it will be appreciated that these fasteners may alternatively be threaded fasteners or other fasteners, for example.

The fin 244 has first and second laterally opposite side elements 262 and 264, which in the embodiment shown are made from a relatively rigid thermoplastic material.

The first and second laterally opposite side elements 262 and 264 are connected to the base 242 by first and second hinges 266 and 268 respectively. The first and second hinges 266 and 268 are substantially the same as the first and second hinges 132 and 134 shown in FIGS. 1 to 6, and therefore function in substantially the same way. For example, the first and second laterally opposite side elements 262 and 264 have a tendency to rotate about first and second hinge axes 270 and 272 respectively of the first and second hinges 266 and 268 respectively in response to a kicking force applied by a foot coupled to the base 242 in a fluid such as water (not shown), for example, to facilitate longitudinal deflection of the fin 244 relative to the base 242. The first and second hinges 266 and 268 also have respective recesses that accommodate lateral movement of the first and second laterally opposite side elements 262 and 264 respectively about the first and second hinges 266 and 268 respectively, and the first and second hinges 266 and 268 have respective arcuate resilient restoring members (not shown) to facilitate restoring the first and second laterally opposite side elements 262 and 264 to respective undeflected positions. The first and second hinge axes 270 and 272 are also disposed at respective acute angles 271 and 273 to a central longitudinal axis 275 of the fin 244, such that the first and second hinges 266 and 268 also impart a concave shape to the fin 244 opposite a deflection direction of longitudinal deflection of the fin 244 relative to the base 242 when the first and second laterally opposite side elements 262 and 264 are rotated about the first and second hinge axes 270 and 272, as discussed above and illustrated in FIGS. 3 to 6.

As discussed above in relation to the acute angles 150 and 152, the acute angles 271 and 273 may be varied in different embodiments to vary a degree of concavity that results from longitudinal deflection of the fin 244 relative to the base 242. More generally, such acute angles in other embodiments, such as other embodiments described herein for example, may be varied to vary such degrees of concavity.

The first laterally opposite side element 262 defines a first plurality of v-shaped guides, which in the embodiment shown includes v-shaped guides shown generally at 274, 276, and 278. The second laterally opposite side element 264 defines a second plurality of v-shaped guides, which in the embodiment shown includes v-shaped guides shown generally at 280, 282, and 284.

In the embodiment shown, the base 242, the first and second laterally opposite side elements 262 and 264, and the first and second hinges 266 and 268 are unitarily formed in a multi-stage injection moulding process, although alternatively these elements may be formed by other processes.

The spreader 246 in the embodiment shown is made from a relatively rigid thermoplastic material, and has a proximal end shown generally at 286 and a distal end shown generally at 290. At the proximal end 286, the spreader 246 defines through-holes 292, 294, and 296 that are aligned with to the through-holes 250, 252, and 254 in the bottom wall 248 of the base 242. The through-holes 250, 252, and 254 and the through-holes 292, 294, and 296 receive the fasteners 256, 258, and 260 respectively to couple the proximal end 286 of the spreader 246 to the base 242 and hold the proximal end 286 of the spreader 246 in a substantially fixed position relative to the base 242.

At the distal end 290, the spreader 246 defines through-holes 298, 300, 302, 304, 306, and 308. The through-holes 298, 300, 302, 304, 306, and 308 and the v-shaped guides 274, 276, 278, 280, 282, and 284 respectively receive fasteners (which may also be referred to as "pins") 310, 312, 314, 316, 318, and 320. The fasteners 310, 312, 314, 316, 318, and 320 in the embodiment shown are metallic rivets, although it will be appreciated that these fasteners may alternatively be threaded fasteners or other fasteners, for example. The fasteners 310, 312, 314, 316, 318, and 320 couple the distal end 290 of the spreader 246 to the first and second laterally opposite side elements 262 and 264, hold the distal end 290 of the spreader 246 longitudinally slidably to the fin 244.

As indicated above, the spreader 246 is made from a relatively rigid thermoplastic material, and therefore maintains a generally constant separation distance 322 between corresponding fasteners 310 and 316, a generally constant separation distance 324 between corresponding fasteners 312 and 318, and a generally constant separation distance 326 between corresponding fasteners 314 and 320.

When the flipper 240 is not subjected to any deflecting forces, the flipper 240 may be referred to as being undeflected, such that the bottom wall 248 of the base 242 is generally coplanar with the fin 244, and the spreader 246 is generally planar, and parallel to and spaced apart from, the bottom wall 248 and the fin 244. When the flipper 240 is undeflected, the fasteners 310, 312, 314, 316, 318, and 320 are disposed at respective undeflected positions shown generally at 328, 330, 332, 334, 336, and 338 at respective apexes of the v-shaped guides 274, 276, 278, 280, 282, and 284 respectively. However, the fasteners 310, 312, 314, 316, 318, and 320 can slide away from the respective undeflected positions 328, 330, 332, 334, 336, and 338 towards respective proximal inner ends of the v-shaped guides 274, 276, 278, 280, 282, and 284, or towards respective distal inner ends v-shaped guides 274, 276, 278, 280, 282, and 284.

As with the flipper 100 shown in FIGS. 1 to 6, the fin 244 deflects in a deflection direction longitudinally relative to the base 242 at the first and second hinges 266 and 268 in response to a kick of a user in a fluid such as water (not shown), for example. In response to the longitudinal deflection of the fin 244 relative to the base 242, the spreader 246 flexes longitudinally and remains generally parallel to and spaced apart from the fin 244, and the distal end 290 of the spreader 246 moves longitudinally relative to the fin 244. The fasteners 310, 312, 314, 316, 318, and 320 slide along respective walls of the v-shaped guides 274, 276, 278, 280, 282, and 284, the respective walls being disposed at respective acute angles to the central longitudinal axis 275 of the fin 244. The fasteners 310, 312, 314, 316, 318, and 320 thus impose respective thrust forces (may be collectively referred to as "a first force") in the direction of the longitudinal movement of the distal end 290 of the spreader 246 relative to the fin 244 on the respective walls of the v-shaped guides 274, 276, 278, 280, 282, and 284, and the respective walls use the respective thrust forces to separate the first and second laterally opposite side elements 262 and 264 and change a lateral shape of the fin 244 in substantially the same way as discussed above and shown in FIGS. 1 to 6.

Advantageously, the first and second pluralities of v-shaped guides shown in FIG. 7 permit control over how the lateral shape of the fin 244 is changed at a plurality of points along the length of the fin 244 in response to longitudinal deflection of the fin 244 relative to the base 242. For example, the respective angles to the central longitudinal axis 275 of the respective walls of the respective v-shaped guides may differ to permit differing spreading along the length of the fin 244.

Figure 8:
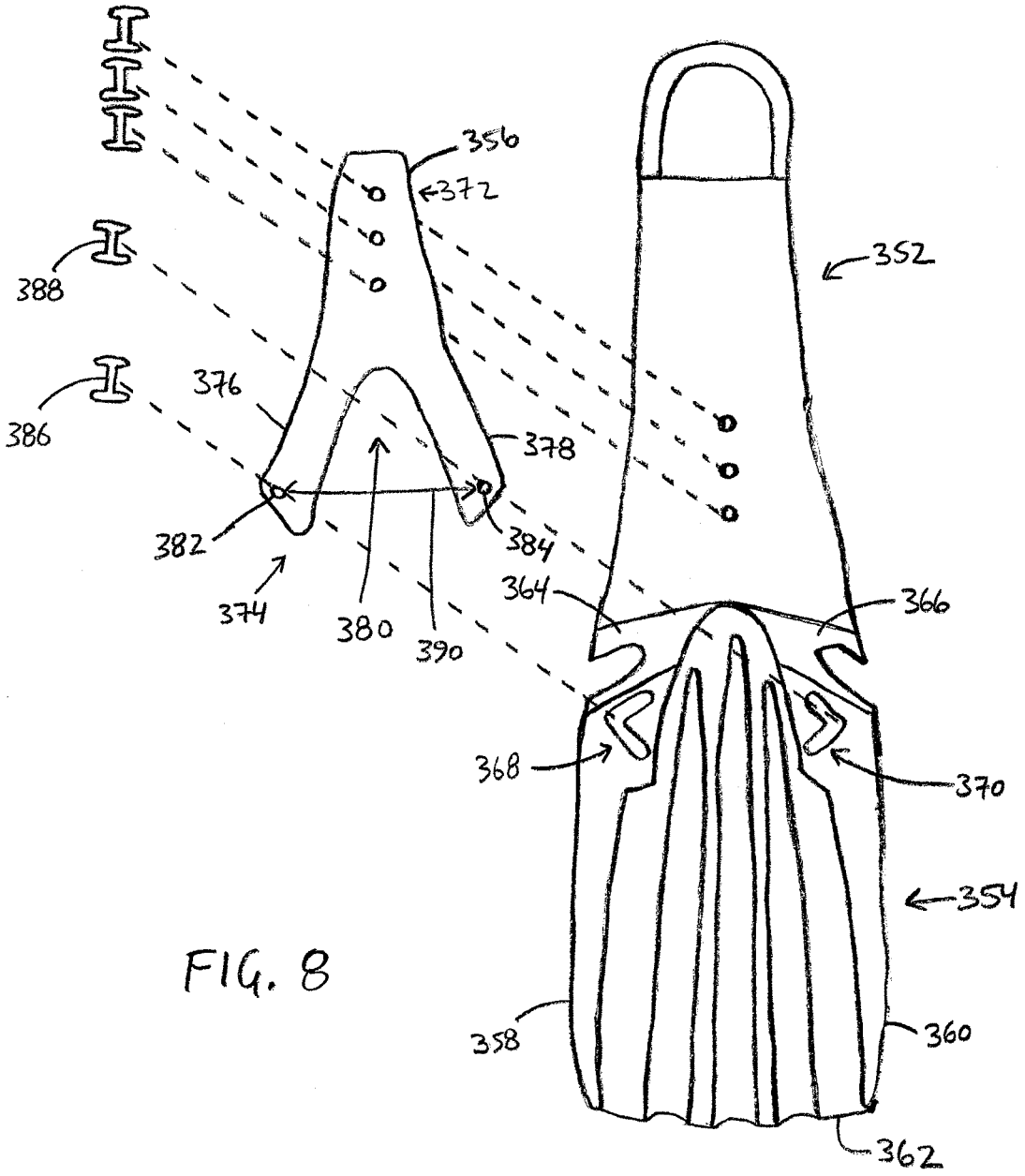
FIG. 8 is an exploded bottom view of a flipper in accordance with another embodiment of the invention.

Referring to FIG. 8, a flipper in accordance with another embodiment of the invention is shown generally at 350. The flipper 350 includes a base shown generally at 352, a deformable fin shown generally at 354, and a spreader 356. The base 352 is substantially the same as the base 102 shown in FIGS. 1 to 6.

The fin 354 has first and second laterally opposite side elements 358 and 360, which in the embodiment shown are made from a relatively rigid thermoplastic material. The fin 354 also has an elastically deformable web 362 coupled to and extending between the first and second laterally opposite side elements 358 and 360. In the embodiment shown, the web 362 is made from a relatively flexible thermoplastic material. The first and second laterally opposite side elements 358 and 360 are connected to the base 352 by first and second hinges 364 and 366 respectively. The first and second hinges 364 and 366 are substantially the same as the first and second hinges 132 and 134 respectively shown in FIGS. 1 to 6, and therefore function in substantially the same way. The first and second laterally opposite side elements 358 and 360 define first and second v-shaped guides shown generally at 368 and 370.

In the embodiment shown, the base 352, the first and second laterally opposite side elements 358 and 360, and the first and second hinges 364 and 366 are unitarily formed in a multi-stage injection moulding process, although alternatively these elements may be formed by other processes.

The spreader 356 in the embodiment shown is made from a relatively rigid thermoplastic material, and has a proximal end shown generally at 372 and a distal end shown generally at 374. The proximal end 372 of the spreader 356 is coupled to the base 352 and held in a substantially fixed position relative to the base 352 in substantially the same manner as discussed above and illustrated in FIGS. 1 and 7.

At the distal end 374, the spreader 356 includes first and second elongate members 376 and 378 separated by an opening shown generally at 380. The first and second elongate members 376 and 378 define respective through-openings 382 and 384 for receiving respective fasteners (which may also be referred to as "pins") 386 and 388. The fasteners 386 and 388 in the embodiment shown are metallic rivets, although it will be appreciated that these fasteners may alternatively be threaded fasteners or other fasteners, for example. The spreader 356 maintains a generally constant separation distance 390 between the fasteners 386 and 388. The spreader 356 functions in substantially the same was as the spreader 106 discussed above and shown in FIGS. 1 to 6, and the fasteners 386 and 388 cooperate with the first and second guides 368 and 370 in substantially the same manner as the fasteners 178 and 180 cooperate with the first and second guides 160 and 162 as discussed above and shown in FIGS. 1 to 6.

The first and second laterally opposite side elements 358 and 360 are generally narrower than the first and second laterally opposite side elements 126 and 128 shown in FIGS.

1 to 6, such that the web 362 is generally wider than the web 130 shown in FIGS. 1 to 6. The opening 380 between the first and second elongate members 376 and 378 at the distal end 374 of the spreader 356 permits the web 362 to pass therethrough when the fin 354 is deflected longitudinally relative to the base 352 during operation of the flipper 350. The relatively greater width of the web 362 permits a more continuously curved concavity of the fin 354.

Figure 9:
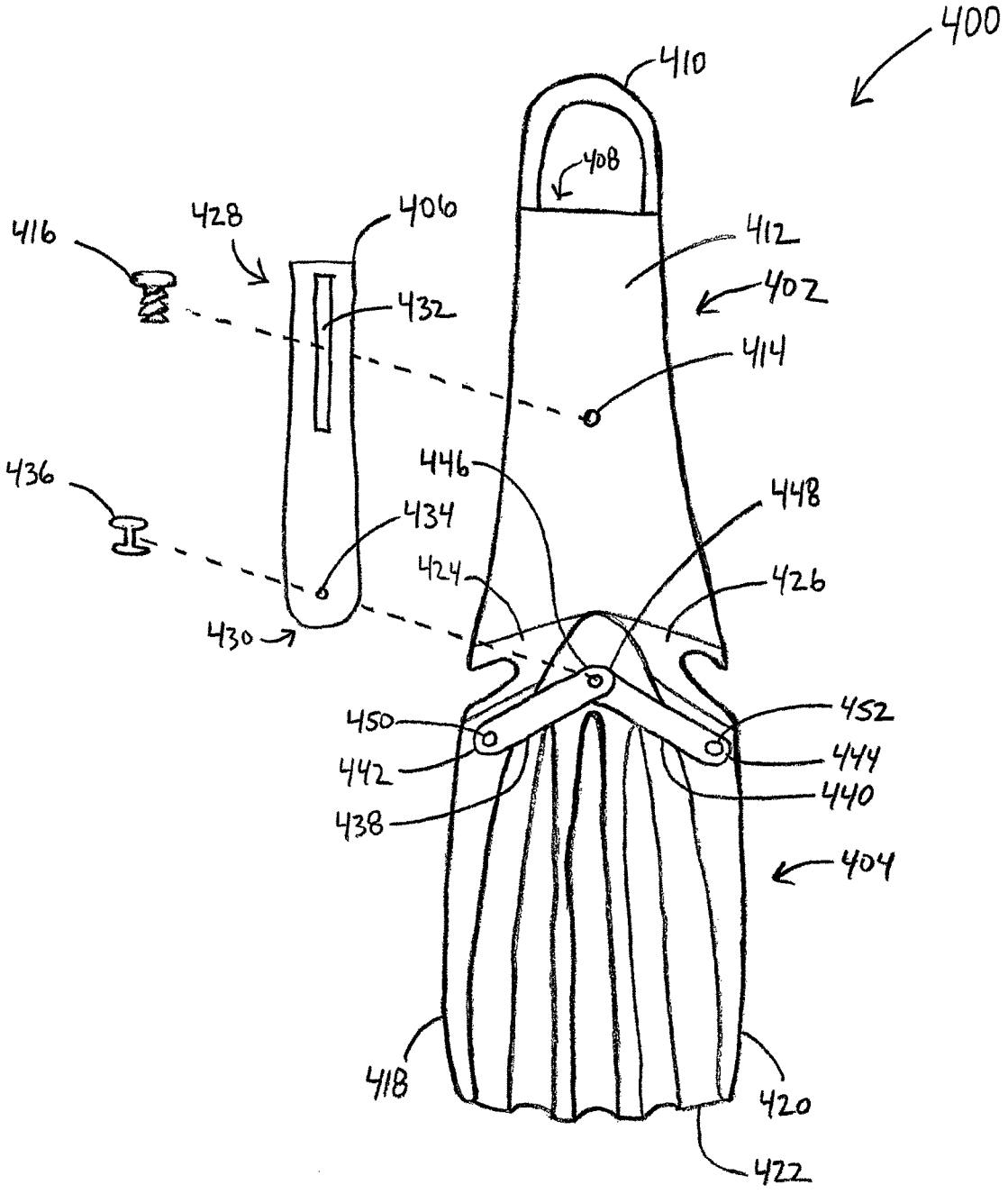
FIG. 9 is an exploded bottom view of a flipper in accordance with another embodiment of the invention.

Referring to FIG. 9, a flipper in accordance with another embodiment of the invention is shown generally at 400. The flipper 400 includes a base shown generally at 402, a deformable fin shown generally at 404, and a spreader 406.

In the embodiment shown, the base 402 is made from a moderately flexible thermoplastic material. The base 402 defines a foot pocket 408 for receiving a foot of a user (not shown), and a heel-retaining strap 410 extending from laterally opposite sides of the base 402 and across an opening of the foot pocket 408 for contacting a heel of the foot to hold the foot in the foot pocket 408. The base 402 also has a bottom wall 412 defining an opening 414 in communication with a threaded receptacle (not shown) in the base 402 for receiving a threaded fastener 416. In the embodiment shown, the threaded fastener 416 and the threaded receptacle are metallic, although it will be appreciated that other fasteners and receptacles may alternatively be used.

The fin 404 has first and second laterally opposite side elements 418 and 420, which in the embodiment shown are made from a relatively rigid thermoplastic material. The fin 404 also has an elastically deformable web 422 coupled to and extending between the first and second laterally opposite side elements 418 and 420. In the embodiment shown, the web 422 is made from a relatively flexible thermoplastic material. The first and second laterally opposite side elements 418 and 420 are connected to the base 402 by first and second hinges 424 and 426 respectively. The first and second hinges 424 and 426 are substantially the same as the first and second hinges 132 and 134 respectively shown in FIGS. 1 to 6, and therefore function in substantially the same way.

In the embodiment shown, the base 402, the first and second laterally opposite side elements 418 and 420, and the first and second hinges 424 and 426 are unitarily formed in a multi-stage injection moulding process, although alternatively these elements may be formed by other processes.

The spreader 406 in the embodiment shown is made from a relatively rigid thermoplastic material, and has a proximal end shown generally at 428 and a distal end shown generally at 430. At the proximal end 428, the spreader 406 defines a through-channel 432 for receiving the threaded fastener 416 at a selectable position along a length of the through-channel 432. The threaded fastener 416 thus couples the proximal end 428 of the spreader 406 to the base 402, and holds the proximal end 428 of the spreader 406 in a substantially fixed position relative to the base 402. However, the threaded fastener 416 can hold the proximal end 428 of the spreader 406 at various selectable positions along the length of the through-channel 432, and thus the substantially fixed position of the proximal end 428 of the spreader 406 relative to the base 402 is adjustable.

At the distal end 430, the spreader 406 defines a through-hole 434 for receiving a fastener 436. The fastener 436 in the embodiment shown is a metallic rivet, although it will be appreciated that this fastener may alternatively be a threaded fastener or another fastener, for example.

The fin 404 has first and second force transfer elements 438 and 440, which in the embodiment shown are made from a relatively rigid thermoplastic material. The first and second force transfer elements 438 and 440 have respective distal ends 442 and 444 and respective proximal ends 446 and 448. The respective distal ends 442 and 444 of the first and second force transfer elements 438 and 440 are pivotally connected to the first and second laterally opposite side elements 418 and 420 respectively at respective pivots 450 and 452. The pivots 450 and 452 in the embodiment shown are metallic rivets, although it will be appreciated that these pivots may alternatively be other fasteners, for example. At the respective proximal ends 446 and 448, the first and second force transfer elements 438 and 440 define respective through-holes for receiving the fastener 436. The fastener 436 thus couples and pivotally connects the distal end 430 of the spreader 406 to the respective proximal ends 446 and 448 of the first and second force transfer elements 438 and 440.

Figure 10:
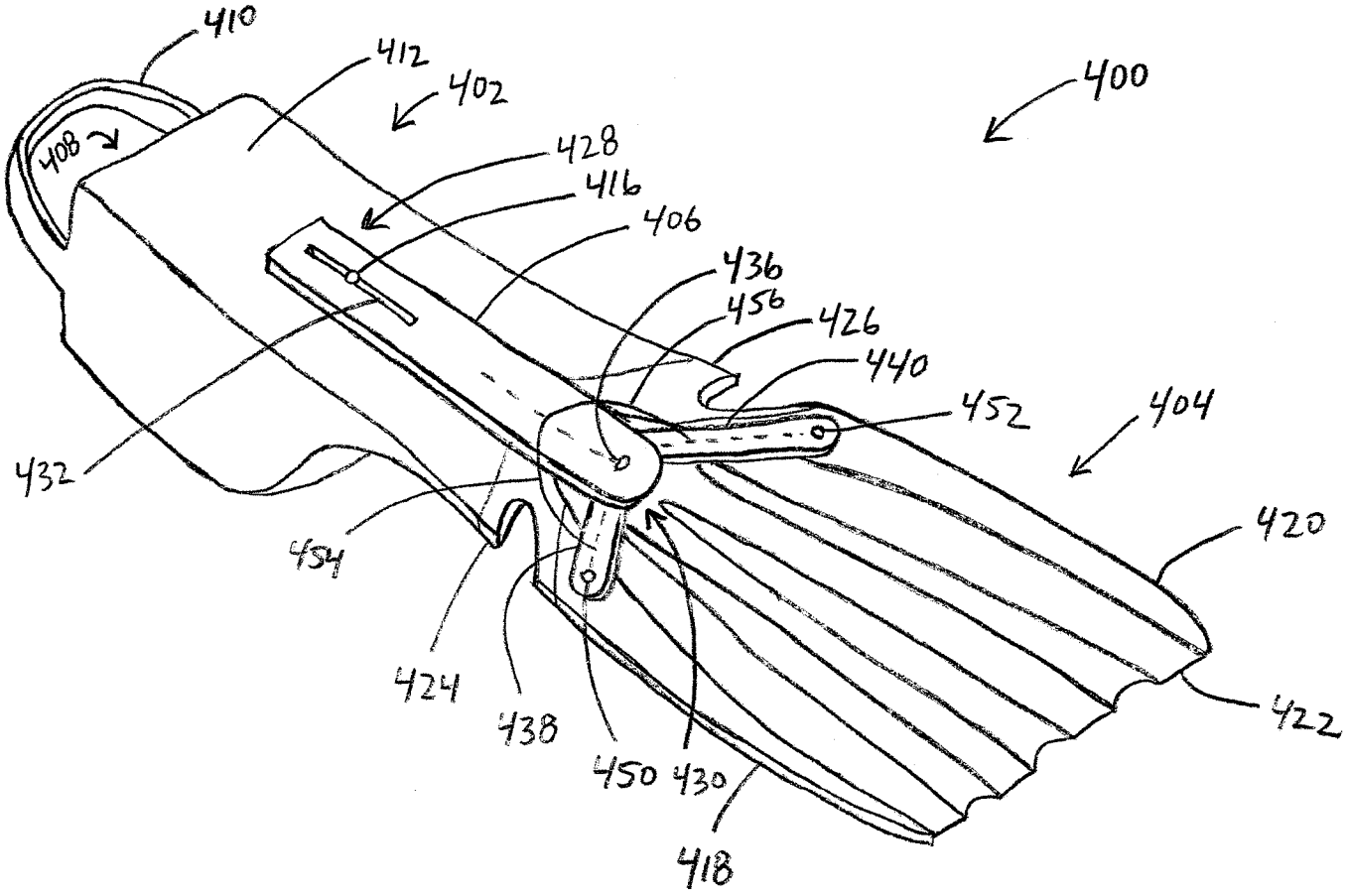
FIG. 10 is a bottom oblique view of the flipper of FIG. 9, showing an undeflected fin of the flipper of FIG. 9.

When the flipper 400 is not subjected to any deflecting forces, the flipper 400 may be referred to as being undeflected, such that the bottom wall 412 of the base 402 is generally coplanar with the fin 404, and the spreader 406 is generally planar, and parallel to and spaced apart from, the bottom wall 412 and the fin 404. Referring to FIG. 10, the flipper 400 is shown undeflected. When the flipper 400 is undeflected, the first force transfer element 438 is at a first undeflected angle 454 from the spreader 406, and the second force transfer element 440 is at a second undeflected angle 456 from the spreader 406.

Figure 11:
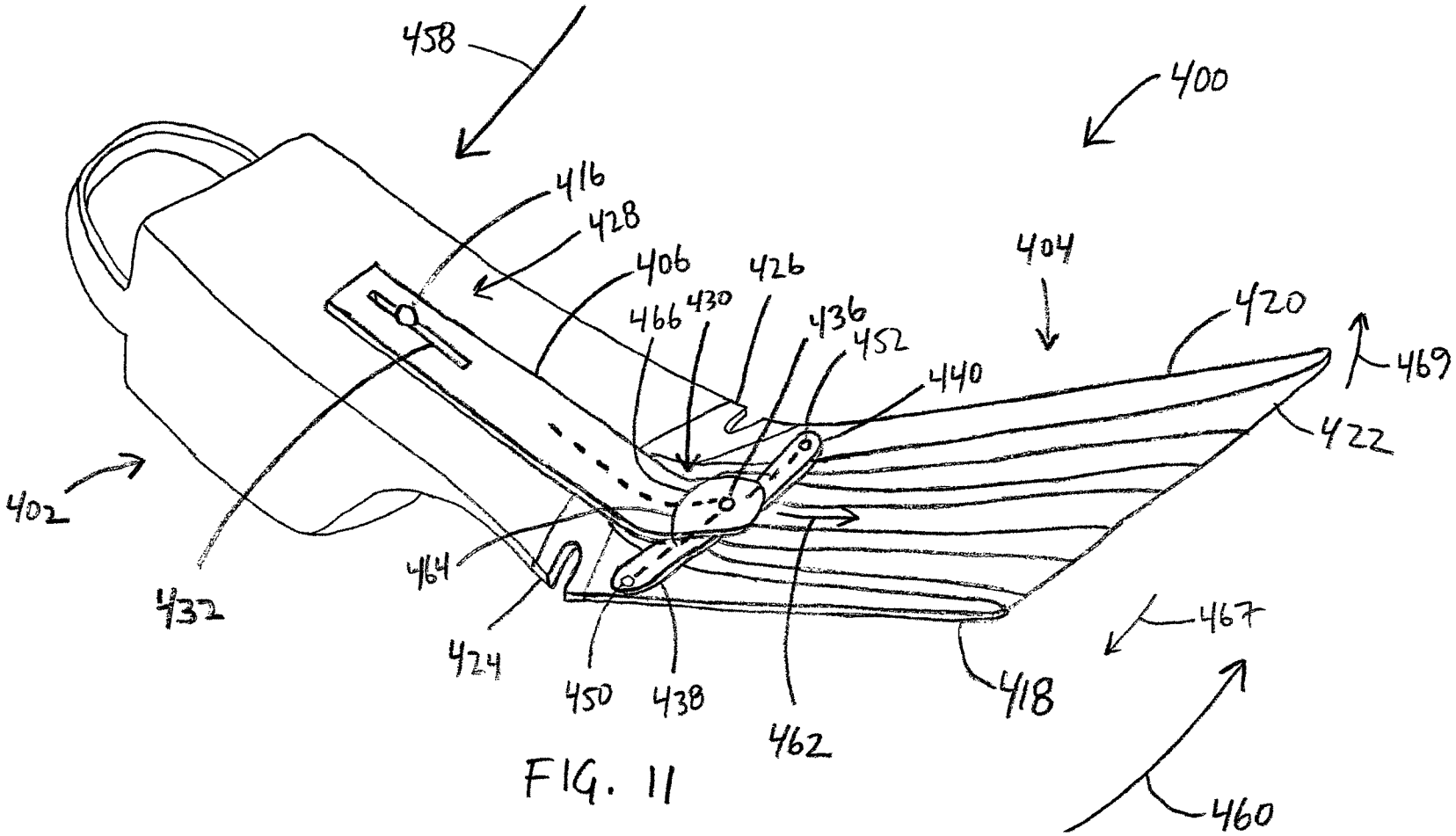
FIG. 11 is a bottom oblique view of the flipper of FIG. 9, showing the fin of the flipper of FIG. 9 deflected upward in response to a downward kick.

Referring to FIG. 11, the flipper 400 is shown deflected in response to a downward kick in the direction of arrow 458 of the user in a fluid such as water (not shown), for example. In response to the downward kick, the fin 404 deflects in an upward deflection direction longitudinally relative to the base 402 at the first and second hinges 424 and 426 in the direction of the arrow 460.

Because the spreader 406 is on a same side of the base 402 and the fin 404, the proximal end 428 of the spreader 406 is held in a substantially fixed position relative to the base 402, the distal end 430 of the spreader 406 is pivotally connected to the respective proximal ends 446 and 448 of the first and second force transfer elements 438 and 440, and the respective distal ends 442 and 444 of the first and second force transfer elements 438 and 440 are pivotally connected to the first and second laterally opposite side elements 418 and 420 respectively, the spreader 406 flexes longitudinally in response to the longitudinal deflection of the fin 404 relative to the base 402, and remains generally parallel to and spaced apart from the fin 404. Thus, in response to longitudinal deflection of the fin 404 relative to the base 402 in the direction of the arrow 460, the distal end 430 of the spreader 406 moves longitudinally relative to the fin 404 in the direction of the arrow 462 and imposes a force on the fastener 436 in the direction of the arrow 462.

The force on the fastener 436 in the direction of the arrow 462 rotates the first and second force transfer elements 438 and 440 about the pivots 450 and 452, thereby changing respective angles between the first and second force transfer elements 438 and 440 and the spreader 406 from the respective undeflected angles 454 and 456 shown in FIG. 10 to respective deflected angles 464 and 466, which in the embodiment shown are less than the respective undeflected angles 454 and 456 respectively shown in FIG. 10. The longitudinal movement of the distal end 430 of the spreader 406 in the direction of the arrow 462 thereby spreads the first and second laterally opposite side elements 418 and 420 apart in the respective directions of the arrows 467 and 469 respectively. The first and second force transfer elements 438 and 440 thus receive and use a force from the distal end 430 of the spreader 406 in response to longitudinal movement of the distal end 430 of the spreader 406 relative to the fin 404 to spread the first and second laterally opposite side elements 418 and 420 apart, thereby elastically deforming the web 422 by stretching the web 422 to accommodate the spreading of the first and second laterally opposite side elements 418 and 420 apart, and thereby changing a lateral shape of the fin 404.

Further, it will be appreciated that when the substantially fixed position of the proximal end 428 of the spreader 406 relative to the base 402 is adjusted by moving the threaded fastener 416 along the length of the through-channel 432, the respective undeflected angles 454 and 456 (shown in FIG. 10) of the first and second force transfer elements 438 and 440 can be adjusted, as can the respective deflected angles 464 and 466, thereby adjusting an amount of spreading of the first and second laterally opposite elements 418 and 420.

Figure 12:
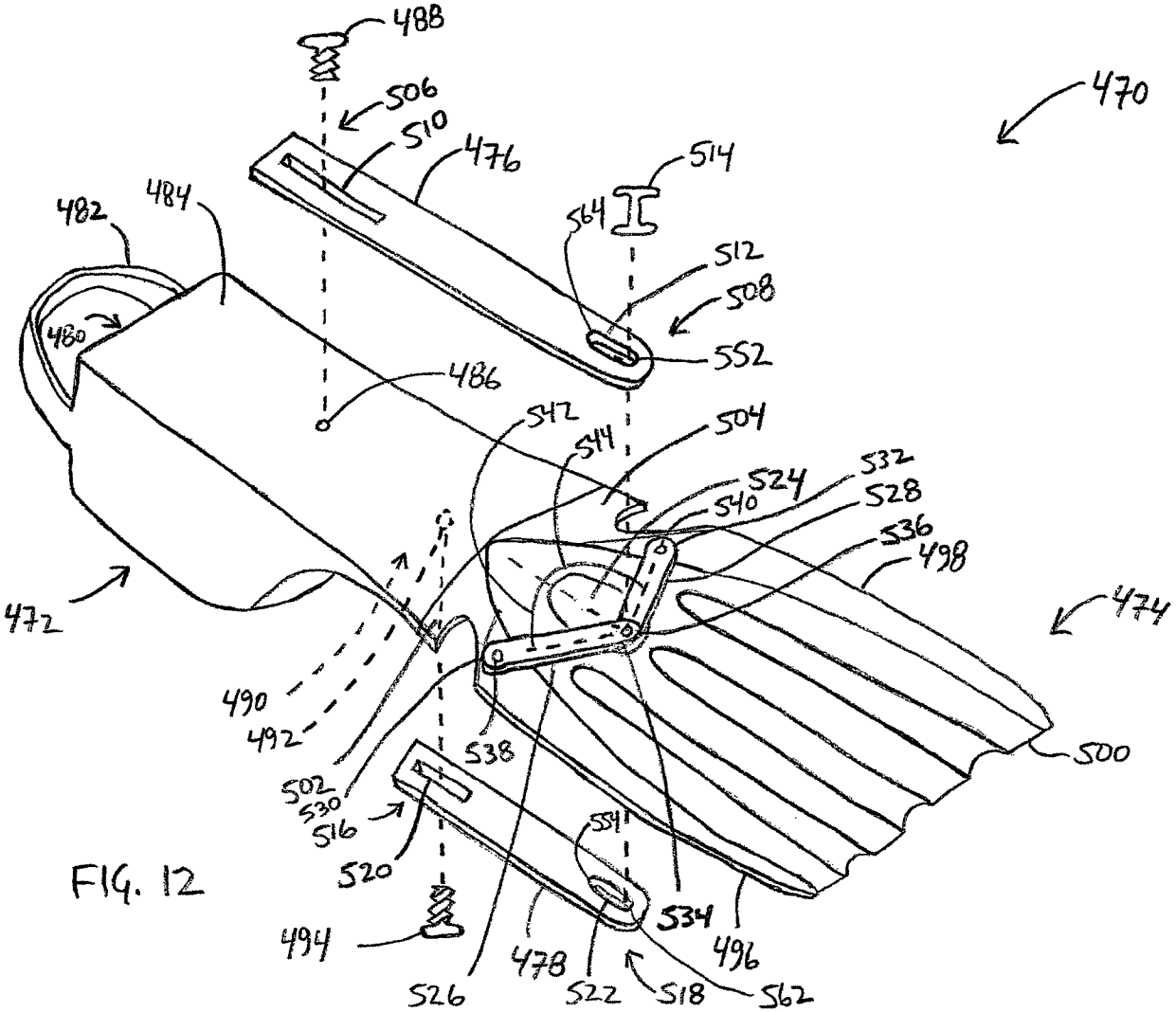
FIG. 12 is an exploded bottom oblique view of a flipper in accordance with another embodiment of the invention, showing an undeflected fin of the flipper of FIG. 12.

Referring to FIG. 12, a flipper in accordance with another embodiment of the invention is shown generally at 470. The flipper 470 includes a base shown generally at 472, a deformable fin shown generally at 474, a first spreader 476, and a second spreader 478.

In the embodiment shown, the base 472 is made from a moderately flexible thermoplastic material. The base 472 defines a foot pocket 480 for receiving a foot of a user (not shown), and a heel-retaining strap 482 extending from laterally opposite sides of the base 472 and across an opening of the foot pocket 480 for contacting a heel of the foot to hold the foot in the foot pocket 480. The base 472 also has a bottom wall 484 defining an opening 486 in communication with a threaded receptacle (not shown) in the base 472 for receiving a threaded fastener 488. The base 472 also has a top wall 490 (also shown in FIG. 14) defining an opening 492 in communication with a threaded receptacle (not shown) in the base 402 for receiving a threaded fastener 494. In the embodiment shown, the threaded fasteners 488 and 494 and the threaded receptacles are metallic, although it will be appreciated that alternatively other fasteners and receptacles may be used, for example.

The fin 474 has first and second laterally opposite side elements 496 and 498, which in the embodiments shown are made from a relatively rigid thermoplastic material. The fin 474 also has an elastically deformable web 500 coupled to and extending between the first and second laterally opposite side elements 496 and 498. In the embodiment shown, the web 500 is made from a relatively flexible thermoplastic material. The first and second laterally opposite side elements 496 and 498 are connected to the base 472 by first and second hinges 502 and 504 respectively. The first and second hinges 502 and 504 are substantially the same as the first and second hinges 132 and 134 respectively shown in FIGS. 1 to 6, and therefore function in substantially the same way.

In the embodiment shown, the base 472, the first and second laterally opposite side elements 496 and 498, the web 500, and the first and second hinges 502 and 504 are unitarily formed in a multi-stage injection moulding process, although alternatively these elements may be formed by other processes.

The first spreader 476 in the embodiment shown is made from a relatively rigid thermoplastic material, and has a first proximal end shown generally at 506 and a first distal end shown generally at 508. At the first proximal end 506, the first spreader 476 defines a through-channel 510 for receiving the threaded fastener 488 at a selectable position along a length of the through-channel 510. The threaded fastener 488 thus couples the first proximal end 506 of the first spreader 476 to the base 472, and holds the first proximal end 506 of the first spreader 476 in a first substantially fixed position relative to the base 472. However, the threaded fastener 488 can hold the first proximal end 506 of the first spreader 476 at various selectable positions along the length of the through-channel 510, and therefore the first substantially fixed position of the first proximal end 506 of the first spreader 476 relative to the base 472 is adjustable.

At the first distal end 508, the first spreader 476 defines an elongate through-hole 512 for receiving a fastener 514. In the embodiment shown, the fastener 514 is a metallic rivet, although it will be appreciated that this fastener may alternatively be a threaded fastener or another fastener, for example.

The second spreader 478 in the embodiment shown is made from a relatively rigid thermoplastic material, and has a second proximal end shown generally at 516 and a second distal end shown generally at 518. At the second proximal end 516, the second spreader 478 defines a through-channel 520 for receiving the threaded fastener 494 at a selectable position along a length of the through-channel 520. The threaded fastener 494 thus couples the second proximal end 516 of the second spreader 478 to the base 472, and holds the second proximal end 516 of the second spreader 478 in a second substantially fixed position relative to the base 472. However, the threaded fastener 494 can hold the second proximal end 516 of the second spreader 478 at various selectable positions along the length of the through-channel 520, and therefore the second substantially fixed position of the second proximal end 516 of the second spreader 478 relative to the base 472 is adjustable.

At the second distal end 518, the second spreader 478 defines an elongate through-hole 522 for receiving the fastener 514 through an opening 524 in the web 500.

The fin 474 has first and second force transfer elements 526 and 528 having respective proximal ends 530 and 532 and respective distal ends 534 and 536. The respective proximal ends 530 and 532 of the first and second force transfer elements 526 and 528 are pivotally connected to the first and second laterally opposite side elements 496 and 498 at respective pivots 538 and 540. The pivots 538 and 540 in the embodiment shown are metallic rivets, although it will be appreciated that other fasteners may alternatively be used, for example. At the respective distal ends 534 and 536, the first and second force transfer elements 526 and 528 define respective through-holes for receiving the fastener 514. Thus, the fastener 514 couples and pivotally connects the respective distal ends 534 and 536 of the first and second force transfer elements 526 and 528 to the first and second distal ends 508 and 518 of the first and second spreaders 476 and 478 respectively.

When the flipper 470 is not subjected to any deflecting forces, the flipper 470 may be referred to as being undeflected, such that the bottom wall 484 and the top wall 490 of the base 472 are generally parallel to the fin 474, and the first and second spreaders 476 and 478 are generally planar, and parallel to and spaced apart from, the bottom wall 484, the top wall 490, and the fin 474. When the flipper 470 is undeflected, as shown in FIG. 12, the first and second force transfer elements 526 and 528 are at respective undeflected angles 542 and 544 from the first and second spreaders 476 and 478.

Figure 13:
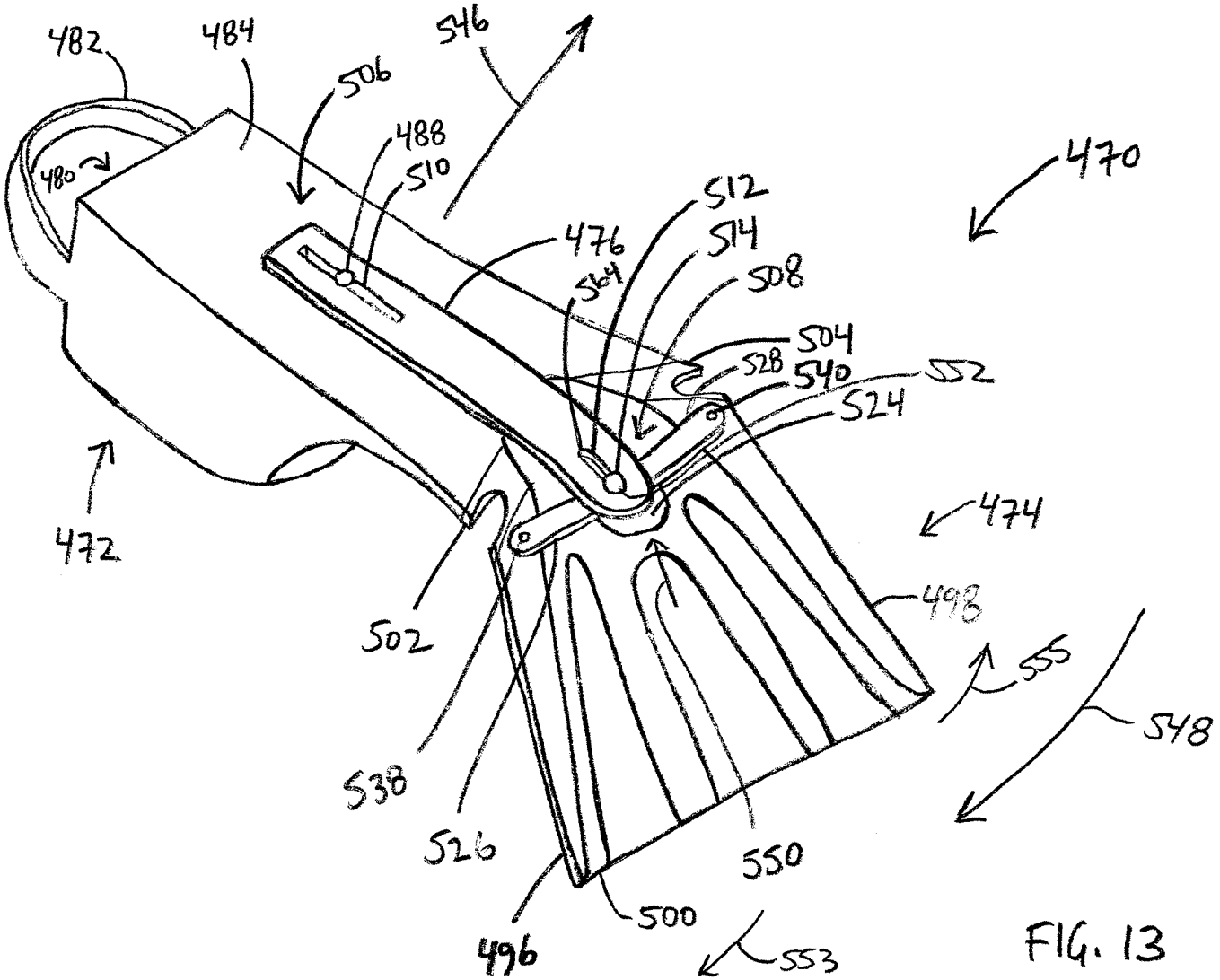
FIG. 13 is a bottom oblique view of the flipper of FIG. 12, showing the fin of the flipper of FIG. 12 deflected downward in response to an upward kick.

Referring to FIG. 13, the flipper 470 is shown deflected in response to an upward kick in the direction of the arrow 546 of the user in a fluid such as water (not shown), for example. In response to the upward kick, the fin 474 deflects in a downward deflection direction longitudinally relative to the base 472 at the first and second hinges 502 and 504 in the direction of the arrow 548.

Because the first spreader 476 is on a same side of the base 472 and the fin 474, the first proximal end 506 of the first spreader 476 is held in a first substantially fixed position relative to the base 472, the first distal end 508 of the first spreader 476 is pivotally connected to the respective distal ends 534 and 536 of the first and second force transfer elements 526 and 528, and the respective proximal ends 530 and 532 of the first and second force transfer elements 526 and 528 are pivotally connected to the first and second laterally opposite side elements 496 and 498 respectively, the first spreader 476 flexes longitudinally in response to the longitudinal deflection of the fin 474 relative to the base 472 and remains generally parallel to and spaced apart from the fin 474. Thus, in response to the longitudinal deflection of the fin 474 relative to the base 472 in the direction of the arrow 548, the first distal end 508 of the first spreader 476 moves longitudinally relative to the fin 474 in the direction of the arrow 550.

In response to the longitudinal movement of the first distal end 508 of the first spreader 476 relative to the fin 474 in the direction of the arrow 550, the first distal end 508 of the first spreader 476 contacts the fastener 514 at a distal end 552 of the elongate through-hole 512, and urges the fastener 514 in the direction of the arrow 550. The first spreader 476 thus imposes a force on the first and second force transfer elements 526 and 528 in the direction of the arrow 550 in response to the longitudinal movement of the first distal end 508 of the first spreader 476 relative to the fin 474 in the direction of the arrow 550, and thus rotates the first and second force transfer elements 526 and 528 about the respective pivots 538 and 540, thereby spreading the first and second laterally opposite side elements 496 and 498 apart in the respective directions of the arrows 553 and 555 respectively, thereby elastically deforming the web 500 by stretching the web 500 to accommodate the spreading of the first and second laterally opposite side elements 496 and 498, and thereby changing a lateral shape of the fin 474.

Accordingly, the first and second force transfer elements 526 and 528 receive and use a force in the direction of the arrow 550, and imposed by the first distal end 508 of the first spreader 476 in response to the longitudinal movement of the first distal end 508 of the first spreader 476 caused by longitudinal deflection of the fin 474 relative to the base 472 in the direction of the arrow 548, to spread the first and second laterally opposite side elements 496 and 498 apart in the respective directions of the arrows 553 and 555 respectively, and thereby change a lateral shape of the fin 474.

Referring to FIGS. 12 and 13, in response to movement of the fastener 514 in the direction of the arrow 550, the fastener 514 moves in the elongate through-hole 522 of the second spreader 478 towards a proximal end 554 of the elongate through-hole 522, and therefore the second spreader 478 does not obstruct the aforementioned movement of the fastener 514 caused by the first spreader 476.

Figure 14:
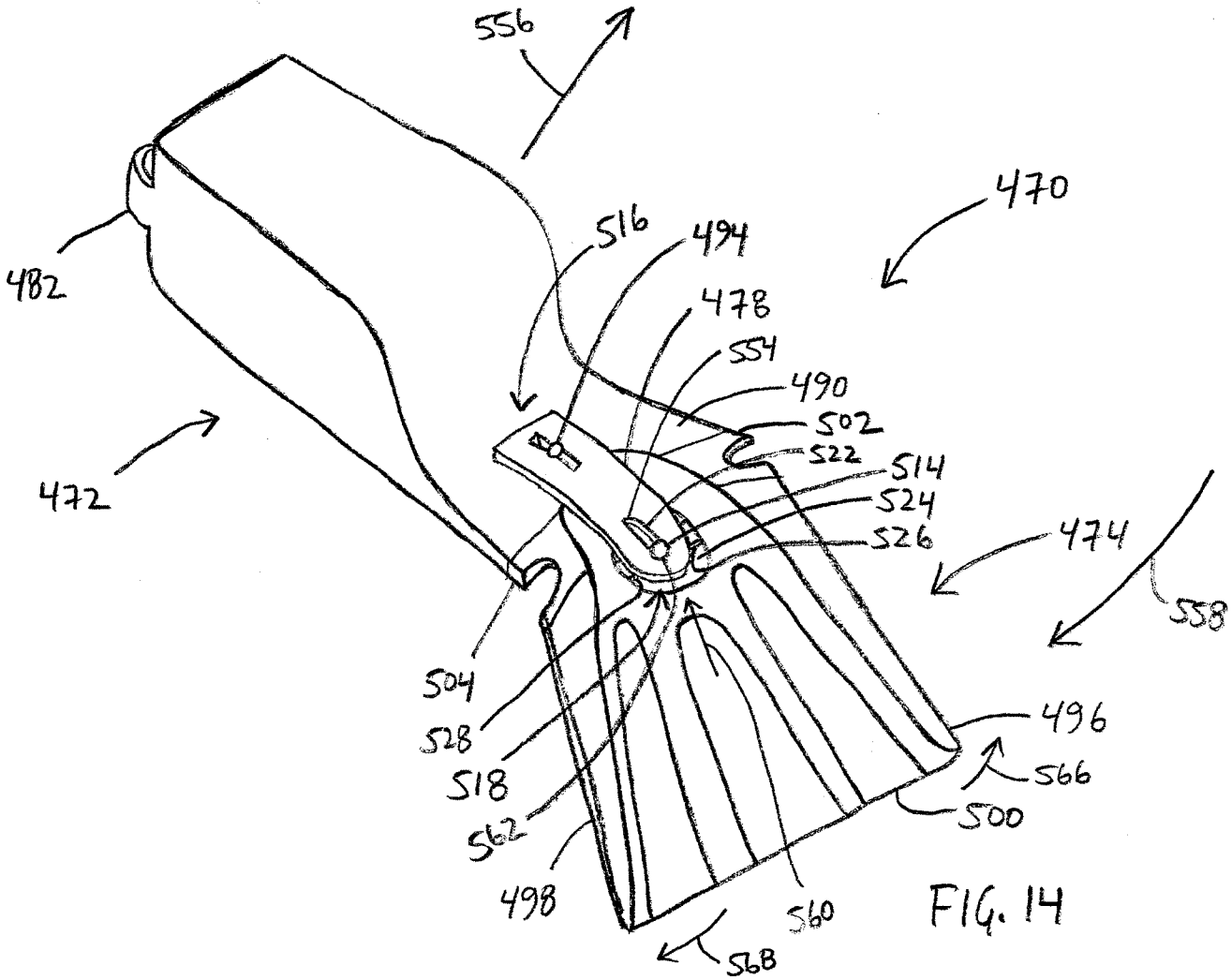
FIG. 14 is a top oblique view of the flipper of FIG. 12, showing the fin of the flipper of FIG. 12 deflected upward in response to a downward kick.

Referring to FIG. 14, the flipper 470 is shown deflected in response to a downward kick in the direction of the arrow 556 of the user in a fluid such as water (not shown), for example. In response to the downward kick, the fin 474 deflects in an upward deflection direction longitudinally relative to the base 472 and the first and second hinges 502 and 504 in the direction of the arrow 558.

Because the second spreader 478 is on a same side of the base 472 and the fin 474, the second proximal end 516 of the second spreader 478 is held in a second substantially fixed position relative to the base 472, the second distal end 518 of the second spreader 478 is pivotally connected to the respective distal ends 534 and 536 of the first and second force transfer elements 526 and 528, and the respective proximal ends 530 and 532 of the first and second force transfer elements 526 and 528 are pivotally connected to the first and second laterally opposite side elements 496 and 498 respectively, the second spreader 478 flexes longitudinally in response to the longitudinal deflection of the fin 474 relative to the base 472 and remains generally parallel to and spaced apart from the fin 474. Thus, in response to the longitudinal deflection of the fin 474 relative to the base 472 in the direction of the arrow 558, the second distal end 518 of the second spreader 478 moves longitudinally relative to the fin 474 in the direction of the arrow 560.

In response to the longitudinal movement of the second distal end 518 of the second spreader 478 in the direction of the arrow 560, the second distal end 518 of the second spreader 478 contacts the fastener 514 at a distal end 562 of the elongate through-hole 522, and thus the second distal end 518 of the second spreader 478 imposes a force on the fastener 514 in the direction of the arrow 560, thereby rotating the first and second force transfer elements 526 and 528 about the respective pivots 538 and 540 (shown in FIGS. 12 and 13), thereby spreading the first and second laterally opposite side elements 496 and 498 apart in the respective directions of the arrows 566 and 568 respectively to change a lateral shape of the fin 474, and thereby elastically deforming the web 500 by stretching the web 500 to accommodate the spreading of the first and second laterally opposite side elements 496 and 498.

Accordingly, the first and second force transfer elements 526 and 528 receive and use a force in the direction of the arrow 560, and imposed by the second distal end 518 of the second spreader 478 in response to the longitudinal movement of the second distal end 518 of the second spreader 478 caused by longitudinal deflection of the fin 474 relative to the base 472 in the direction of the arrow 558, to spread the first and second laterally opposite side elements 496 and 498 apart in the respective directions of the arrows 566 and 568 respectively, and thereby to change a lateral shape of the fin 474.

When the fastener 514 moves in the direction of the arrow 560, the fastener 514 moves in the elongate through-hole 512 of the first spreader 476 to a proximal end 564 of the elongate through-hole 512 (shown in FIGS. 12 and 13), and therefore the first spreader 476 does not obstruct the aforementioned movement of the fastener 514 caused by the second spreader 478.

Figure 15:
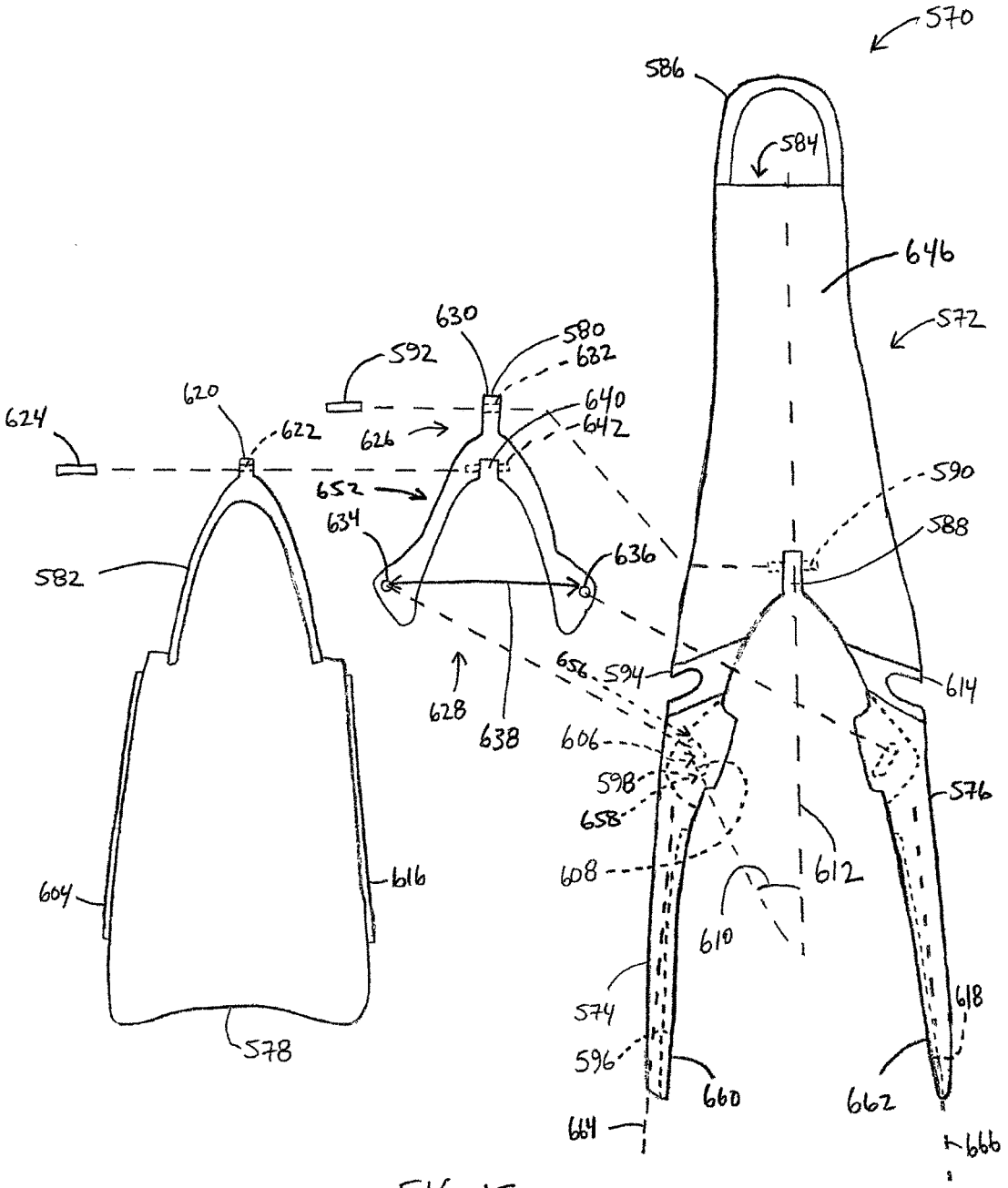
FIG. 15 is an exploded bottom view of a flipper in accordance with another embodiment of the invention.
Figure 16:
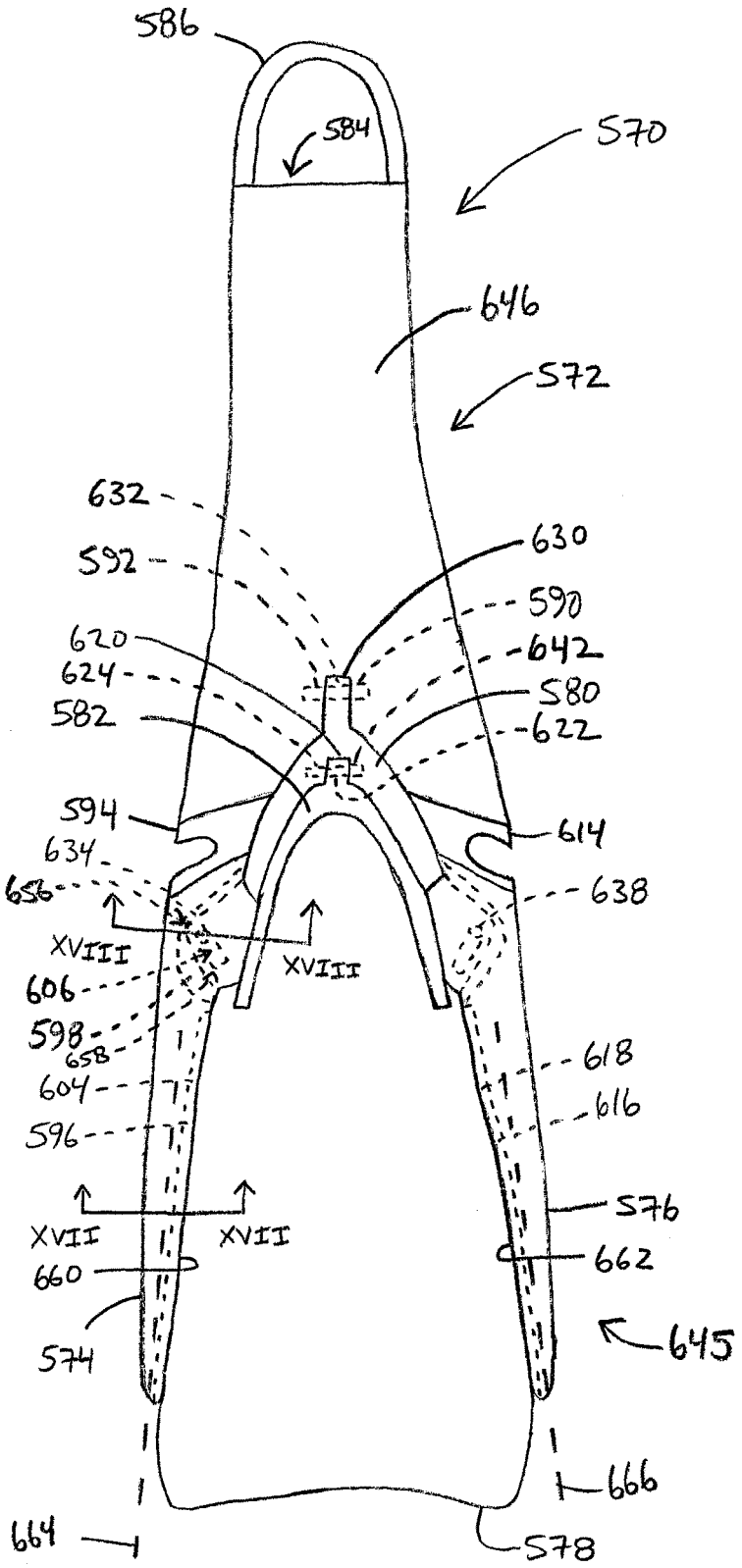
FIG. 16 is a bottom view of the flipper of FIG. 15, showing an undeflected fin of the flipper of FIG. 15.
Figure 17:
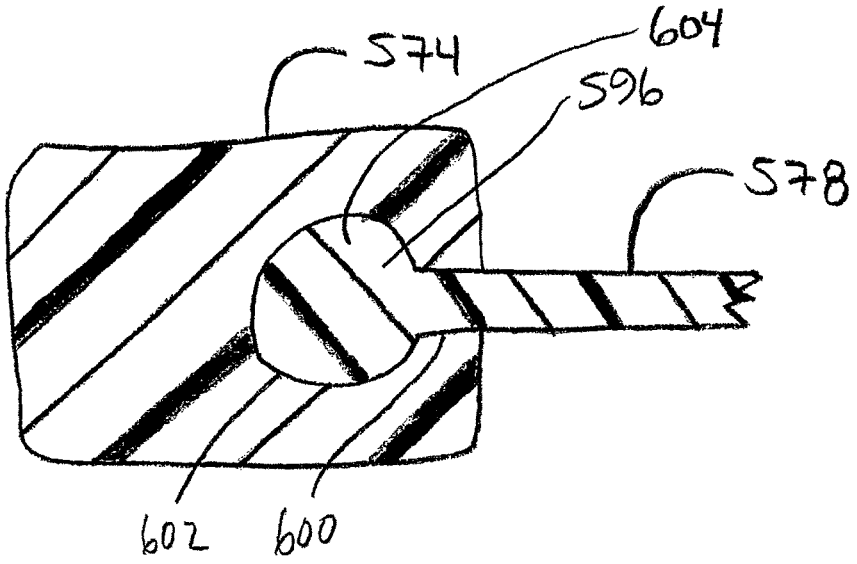
FIG. 17 is a cross-sectional view of the flipper of FIG. 15, taken along the line XVII-XVII in FIG. 16.

Referring to FIGS. 15 and 16, a flipper in accordance with another embodiment of the invention is shown generally at 570. The flipper 570 includes a base shown generally at 572, first and second laterally opposite side elements 574 and 576, an elastically deformable web 578, a spreader 580, and a curving element 582 coupled to the web 578.

In the embodiment shown, the base 572 is made from a moderately flexible thermoplastic material. The base 572 defines a foot pocket 584 for receiving a foot of a user (not shown), and a heel-retaining strap 586 extending from laterally opposite sides of the base 572 and across an opening of the foot pocket 584 for contacting a heel of the foot to hold the foot in the foot pocket 584. The base 572 also defines a longitudinal recess 588, and a transverse cylindrical hole 590 centered about and extending across the longitudinal recess 588 for receiving a pivot 592.

Figure 18:
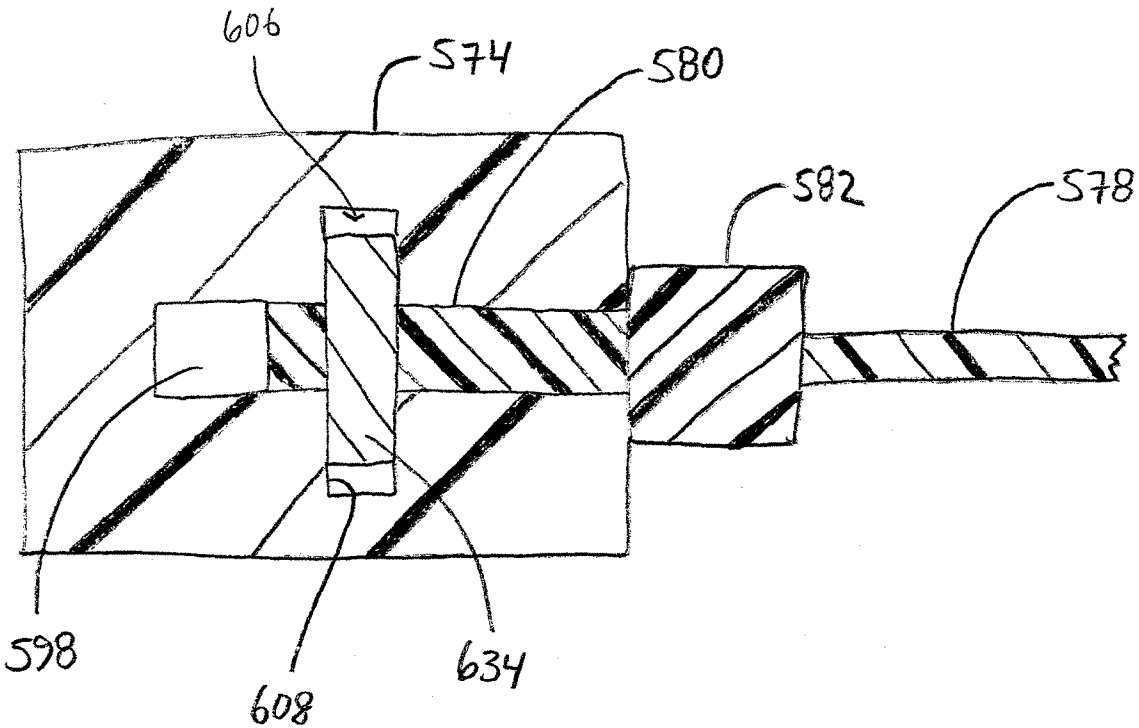
FIG. 18 is a cross-sectional view of the flipper of FIG. 15, taken along the line XVIII-XVIII in FIG. 16.

Referring to FIGS. 15, 16, 17, and 18, the first laterally opposite side element 574 is connected to the base 572 by a first hinge 594, and includes an elongate member defining a channel 596 (shown in FIG. 17) and a recess 598 (shown in FIG. 18). The first laterally opposite side element 574 in the embodiment shown is made from a relatively rigid thermoplastic material. The channel 596 has a relatively narrow opening 600 and a widened inner portion 602 for slidably retaining a bead 604 coupled to the web 578. The recess 598 includes a first guide shown generally at 606 having a first wall 608 extending at an acute angle 610 from a central longitudinal axis 612 of the flipper 570. The second laterally opposite side element 576 is connected to the base 572 by a second hinge 614, and is substantially a mirror image of the first laterally opposite side element 574. The first and second hinges 594 and 614 are substantially the same as the first and second hinges 132 and 134 respectively discussed above and shown in FIGS. 1 to 6, and therefore function in substantially the same way.

In the embodiment shown, the base 572, the first and second laterally opposite side elements 574 and 576, and the first and second hinges 594 and 614 are unitarily formed in a multi-stage injection moulding process, although alternatively these elements may be formed by other processes.

Referring back to FIGS. 15 and 16, the web 578 is made from a relatively flexible thermoplastic material, and as discussed above, includes a bead 604 for being received within the channel 596 of the first laterally opposite side element 574. The web 578 is also coupled to a corresponding bead 616 for being received within a channel 618 of the second laterally opposite side element 576 corresponding to the channel 596 of the first laterally opposite side element 574.

Also as discussed above, the web 578 is coupled to the curving element 582, which in the embodiment shown is made from a relatively rigid thermoplastic material. The curving element 582 is generally arcuate, and includes a longitudinal projection 620 at an apex of the arc and having a transverse cylindrical through-hole 622 for receiving a pivot 624 therethrough.

The spreader 580 in the embodiment shown is made from a relatively rigid thermoplastic material. The spreader 580 is generally arcuate, and has a proximal end shown generally at 626 at an apex of the arc, and a distal end shown generally at 628. At the proximal end 626, the spreader 580 includes a longitudinal projection 630 having a transverse cylindrical through-hole 632 for receiving the pivot 592. At the proximal end 626, the spreader 580 further defines a longitudinal recess 640, and a transverse cylindrical hole 642, centered around and extending across the longitudinal recess 640, for receiving the pivot 624.

At the distal end 628, the spreader 580 has first and second pins 634 and 636 on respective opposite spaced apart distal ends of the arc. Because the spreader 580 is made from a relatively rigid thermoplastic material, the spreader 580 maintains the first and second pins 634 and 636 at a generally constant separation distance 638.

When the aforementioned components are assembled as shown in FIG. 16, the longitudinal projection 630 of the spreader 580 is received in the longitudinal recess 588 of the base 572, and the pivot 592 is received in the transverse cylindrical hole 590 of the base 572 and the transverse cylindrical through-hole 632 of the longitudinal projection 630 of the spreader 580, and the proximal end 626 of the spreader 580 is thus pivotally coupled to the base 572 about the pivot 592. Further, the longitudinal projection 620 of the curving element 582 is received in the longitudinal recess 640 of the spreader 580, and the pivot 624 is received in the transverse cylindrical through-hole 622 of the longitudinal projection 620 of the curving element 582 and in the transverse cylindrical hole 642 of the spreader 580, and the curving element 582 is thus pivotally coupled to the spreader 580 about the pivot 624. As shown in FIG. 16, the curving element 582 extends longitudinally across the first and second hinges 594 and 614.

Further, when the aforementioned components are assembled as shown in FIG. 16, the first pin 634 is received within the first guide 606 of the first laterally opposed side element 574, and in slidable contact with the first wall 608 of the first guide 606. Likewise, the second pin 636 is similarly received in a corresponding recess of the second laterally opposite side element 576. Still further, the beads 604 and 616 coupled to the web 578 are received within the channels 596 and 618 of the first and second laterally opposite side elements 574 and 576 respectively, and thus the web 578 is coupled to and extends between the first and second laterally opposite side elements 574 and 576. The first and second laterally opposite side elements 574 and 576 and the web 578 thus assembled may be said to form a fin shown generally at 645.

When the flipper 570 is not subjected to any deflecting forces, the flipper 570 may be referred to as being undeflected, such that the fin 645, the spreader 580, and the curving element 582 are generally coplanar with a bottom wall 646 of the base 572. The flipper 570 is shown undeflected in FIG. 16.

Figure 19:
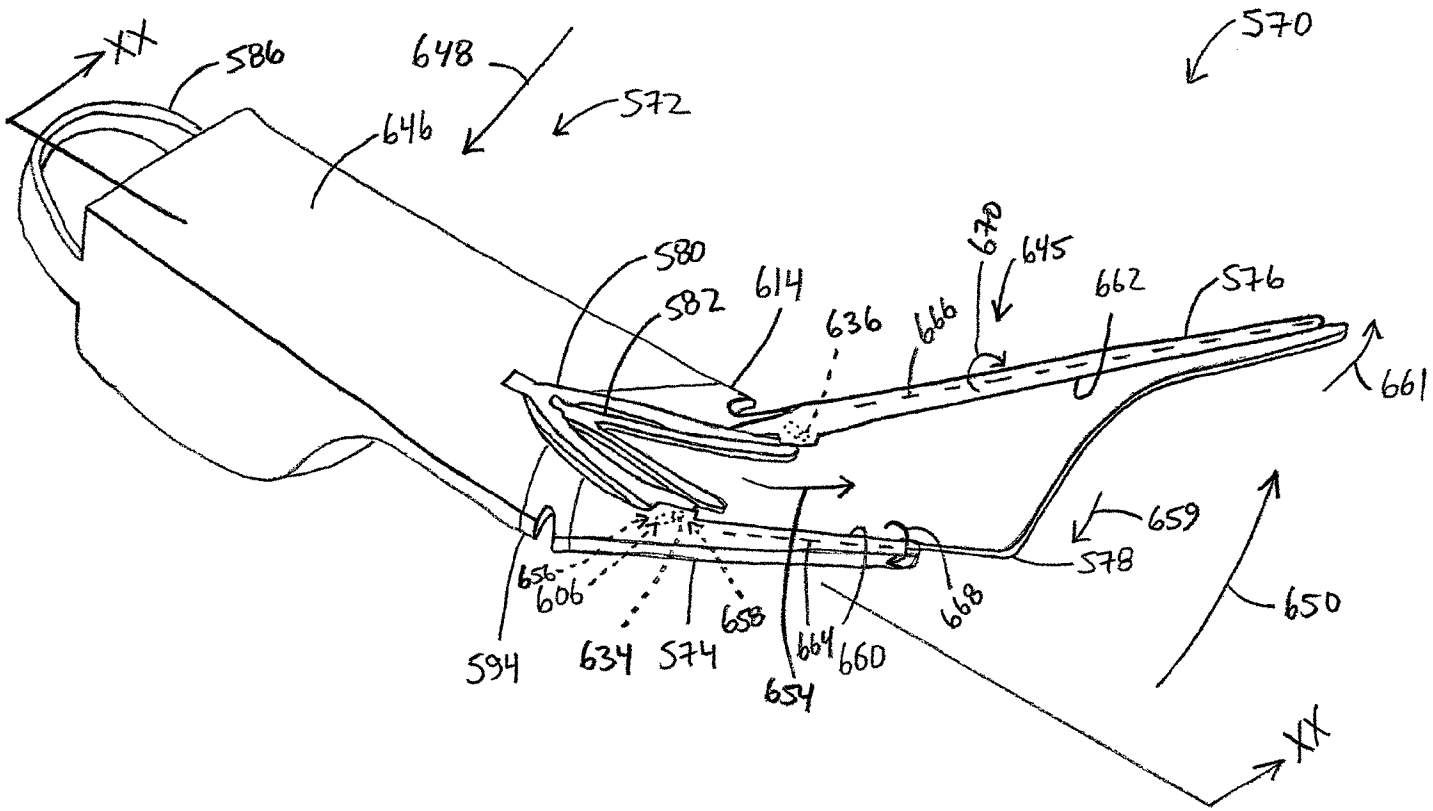
FIG. 19 is a bottom oblique view of the flipper of FIG. 15, showing the fin of the flipper of FIG. 15 deflected upward in response to a downward kick.
Figure 20:
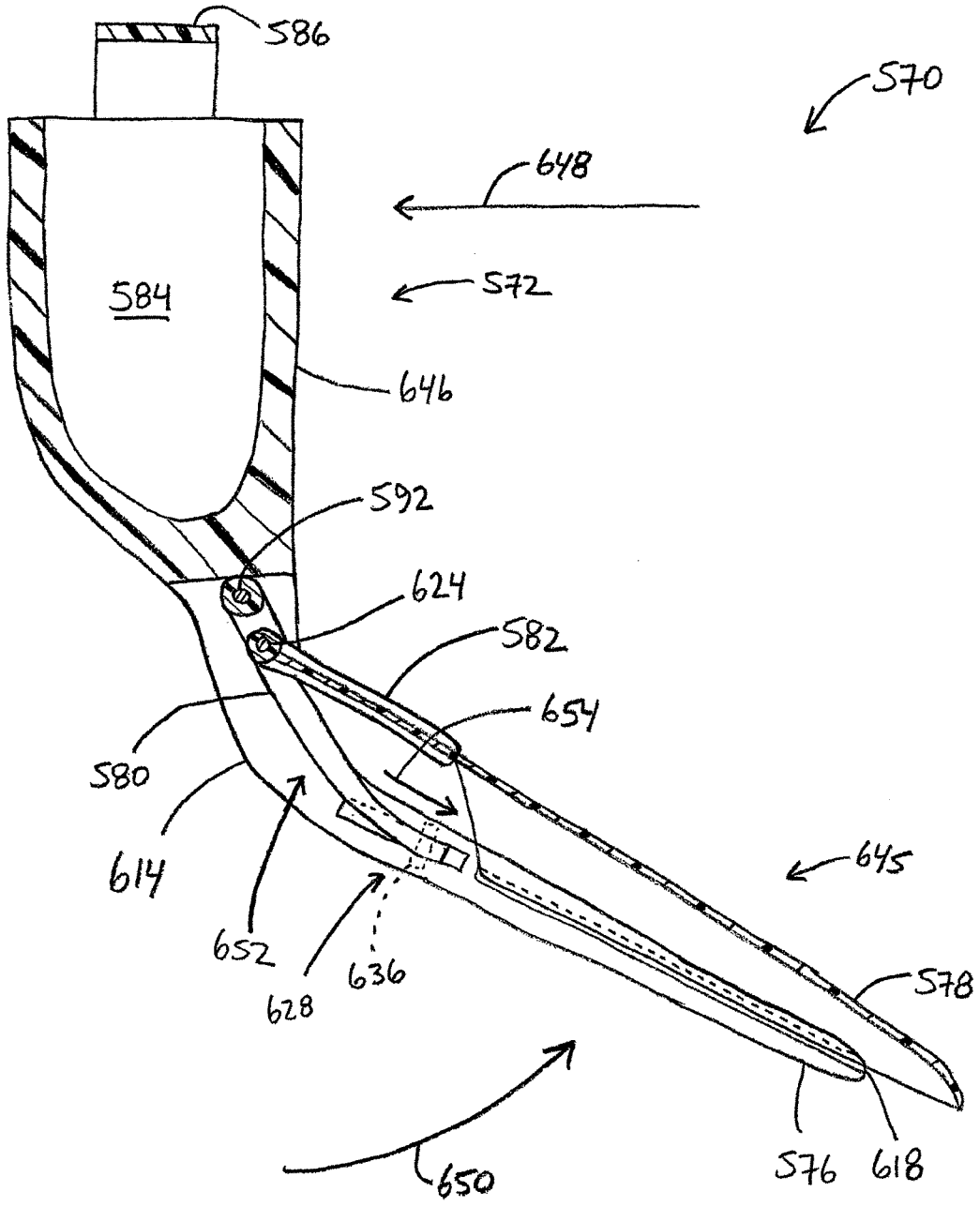
FIG. 20 is a cross-sectional view of the flipper of FIG. 15, taken along the line XX-XX in FIG. 19.

Referring to FIGS. 19 and 20, the flipper 570 is shown deflected in response to a downward kick in the direction of the arrow 648 of the user in a fluid such as water (not shown), for example. In response to the downward kick, the fin 645 deflects in an upward deflection direction longitudinally relative to the base 572 at the first and second hinges 594 and 614 in the direction of the arrow 650.

In the embodiment shown, the first and second hinges 594 and 614 are made from a relatively flexible thermoplastic material, while the first and second laterally opposite side elements 574 and 576 and the spreader 580 are made from relatively rigid thermoplastic materials. Referring to FIG. 20, when the fin 645 deflects in the upward deflection direction longitudinally relative to the base 572 in the direction of the arrow 650, the first and second hinges 594 and 614 flex longitudinally along a first curve (shown for the second hinge 614 in FIG. 20). However, because the spreader 580 is more rigid than the first and second hinges 594 and 614, the spreader 580 flexes longitudinally along a second curve (shown in FIG. 20) having a curvature less than a curvature of the first curve. This difference in curvature causes an intermediate portion shown generally at 652 of the spreader 580 to move away from the fin 645 in the direction of the arrow 650 as shown in FIG. 20, and causes longitudinal movement of the distal end 628 of the spreader 580 relative to the fin 645 in the direction of the arrow 654.

Thus, in response to longitudinal deflection of the fin 645 relative to the base 572 in the direction of the arrow 650, the distal end 628 of the spreader 580 moves longitudinally relative to the fin 645 in the direction of the arrow 654, and this longitudinal movement causes the first pin 634 to move from a proximal end 656 of the first guide 606 (as shown in FIGS. 15 and 16) to a distal end 658 of the first guide 606 (as shown in FIG. 19). Because the first wall 608 (shown in FIGS. 15 and 18) is disposed at the acute angle 610 from the central longitudinal axis 612 of the flipper 570 (shown in FIG. 15), the longitudinal movement of the distal end 628 of the spreader 580 in the direction of the arrow 654 causes the first pin 634 to slide along the first wall 608 and impose a thrust force on the first wall 608 in the direction of the arrow 650. Likewise, this longitudinal movement causes the second pin 636 to slide along a corresponding wall of a corresponding guide on the second laterally opposite side element 576, and to impose a thrust force on the corresponding wall in the direction of the arrow 650. These thrust forces from the first and second pins 634 and 636 may collectively be referred to as "a first force".

Further, because the spreader 580 maintains the generally constant separation distance 638 between the first and second pins 634 and 636, the first wall 608 and the corresponding wall of the second laterally opposite side element 576 receive and use these respective thrust forces from the first and second pins 634 and 636 in response to this longitudinal movement to cause the first and second laterally opposite side elements 574 and 576 spread apart in the respective directions of the arrows 659 and 661 respectively, thereby changing a lateral shape of the fin 645, and thereby elastically deforming the web 578 by stretching the web 578 to accommodate the spreading of the first and second laterally opposite side elements 574 and 576.

The first and second hinges 594 and 614 are substantially the same as the first and second hinges 132 and 134 shown in FIGS. 1 and 6, and therefore, as discussed above and shown in FIGS. 3 to 6, the first and second hinges 594 and 614 have respective hinge axes that extend away from a central longitudinal axis of the fin 645 and away from the base 572 at respective acute angles from the central longitudinal axis of the fin, thus imparting a concave shape to the fin opposite the direction of longitudinal deflection of the fin 645 relative to the base 572. However, as shown in FIGS. 19 and 20, the intermediate portion 652 of the spreader 580 moves away from the fin 645 in the direction of the arrow 650 when the fin 645 is deflected longitudinally in the direction of the arrow 650 relative to the base 572. Because the distal end 628 of the spreader 580 is coupled to the first and second laterally opposite side elements 574 and 576 on respective inner sides 660 and 662 of the first and second laterally opposite side elements 574 and 576, movement of the intermediate portion 652 of the spreader 580 away from the fin 645 imposes respective forces on the inner sides 660 and 662 in substantially the same direction as the direction of the arrow 650, thereby rotating the first and second laterally opposite side elements 574 and 576 about respective generally longitudinal axes 664 and 666 of the first and second laterally opposite side elements 574 and 576 in the respective directions of the arrows 668 and 670 respectively. This rotation further imparts a concave shape to the fin 645 opposite the deflection direction of the arrow 650.

Referring to FIG. 20, as indicated above, when the fin 645 deflects in the upward deflection direction longitudinally relative to the base 572 in the direction of the arrow 650, the first and second hinges 594 and 614 flex longitudinally along a first curve (shown for the second hinge 614 in FIG. 20). However, as indicated above, the curving element 582 is made from a relatively rigid thermoplastic material. Because the curving element 582 is more rigid than the first and second hinges 594 and 614, the curving element 582 has a curvature less than a curvature of the first curve. Therefore, when the first and second hinges 594 and 614 flex longitudinally along the first curve, the curving element 582 moves longitudinally relative to the first and second laterally opposite side elements 574 and 576 in the direction of the arrow 654, for similar reasons that the distal end 628 of the spreader 580 relative to the fin 645 in the direction of the arrow 654. However, the curving element 582 is coupled to the web 578, which is not generally movable longitudinally in the direction of the arrow 654. Therefore, to accommodate the longitudinal movement of the curving element 582 relative to the first and second laterally opposite side elements 574 and 576 in the direction of the arrow 654, the curving element 582 is deflected and rotates longitudinally about the pivot 624 generally in the direction of the arrow 650, as shown in FIG. 20. This rotation further imparts a concave shape to the fin 645 opposite the deflection direction of the arrow 650.

Although FIGS. 19 and 20 show the fin 645 deflected upward in the direction of the arrow 650 relative to the base 572 in response to a downward kick in the direction of the arrow 648, the fin 645 may also be deflected downward in a deflection direction opposite the direction of the arrow 650 relative to the base 572 in response to an upward kick in a direction opposite the direction of the arrow 648. In the case of such downward deflection, the spreader 580 and the curving element 582 move away from the fin 645 generally in the direction opposite the direction the direction of the arrow 650, and the distal end 628 of the spreader 580 still moves in the direction of the arrow 654 relative to the fin 645. Such downward deflection therefore causes the first and second laterally opposite side elements 574 and 576 to spread and change the lateral shape of the fin 645 in substantially the same way as discussed above and shown in FIGS. 19 and 20 in the case of upward deflection.

Figure 21:
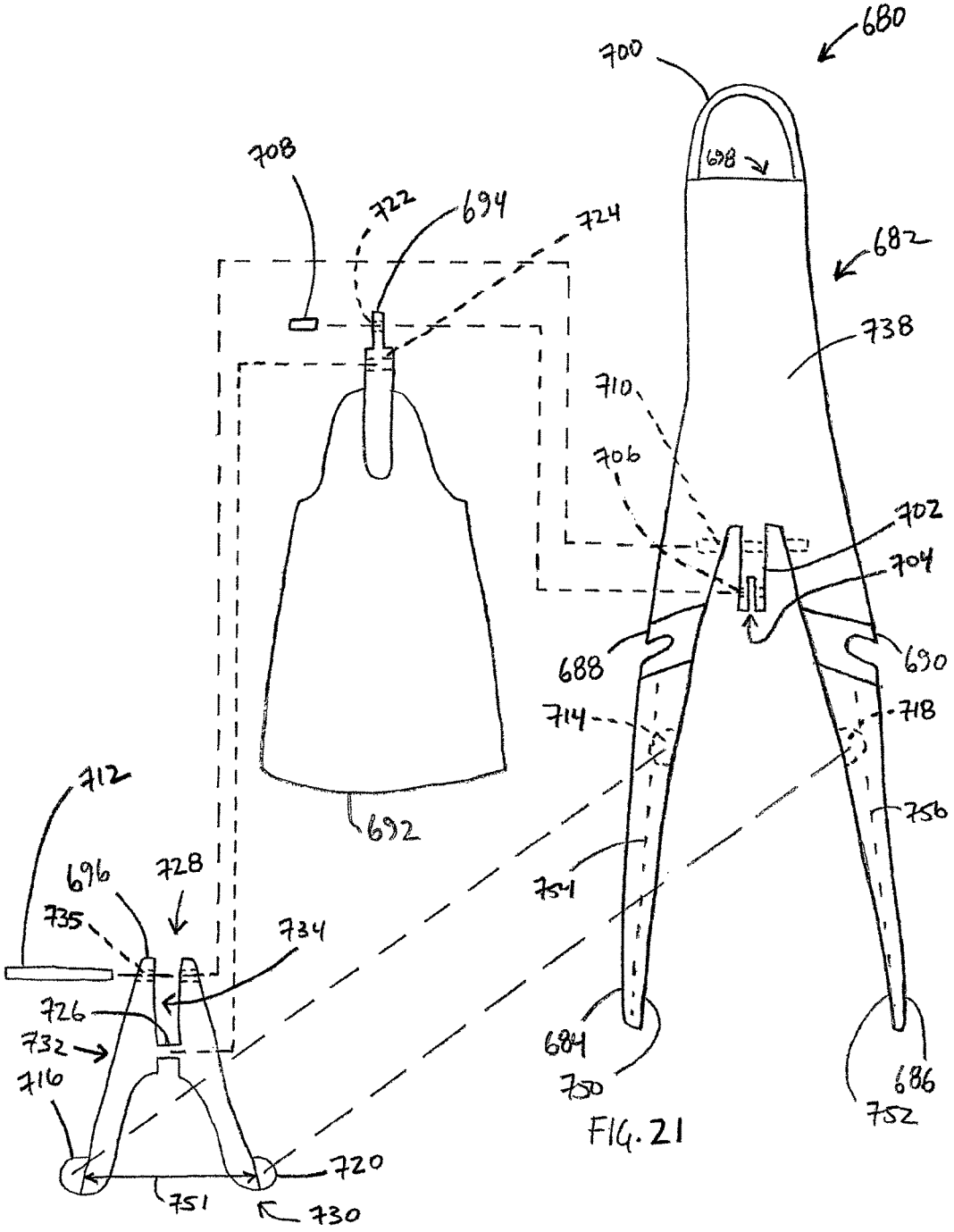
FIG. 21 is an exploded bottom view of a flipper in accordance with another embodiment of the invention.
Figure 22:
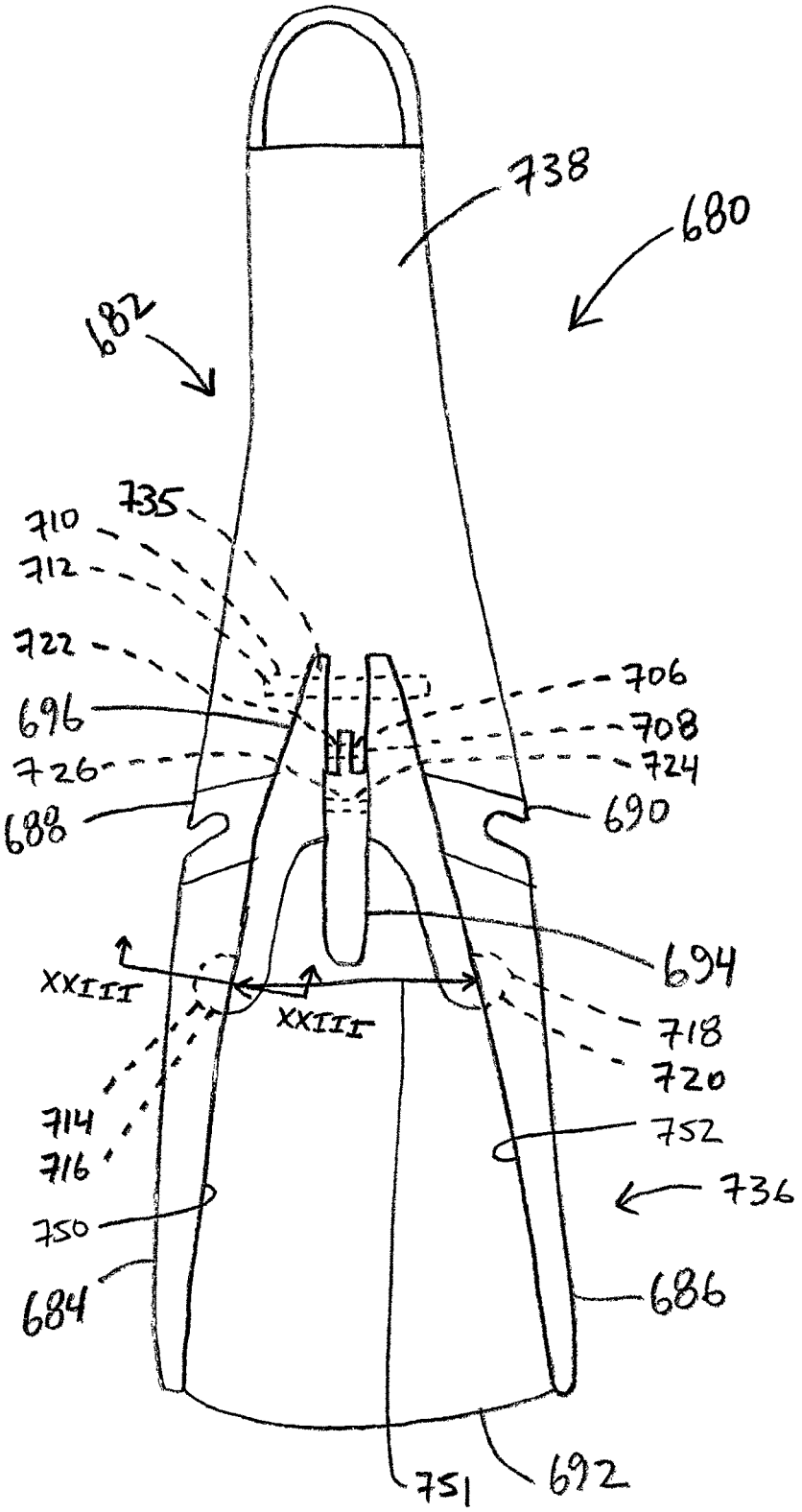
FIG. 22 is a bottom view of the flipper of FIG. 21, showing an undeflected fin of the flipper of FIG. 21.

Referring to FIGS. 21 and 22, a flipper in accordance with another embodiment of the invention is shown generally at 680. The flipper 680 includes a base shown generally at 682, first and second laterally opposite side elements 684 and 686, first and second hinges 688 and 690 coupling the first and second laterally opposite side elements 684 and 686 respectively to the base 682, an elastically deformable web 692, a curving element 694 coupled to the web 692, and a spreader 696.

In the embodiment shown, the base 682 is made from a moderately flexible thermoplastic material. The base 682 defines a foot pocket 698 for receiving a foot of a user (not shown), and a heel-retaining strap 700 extending from laterally opposite sides of the base 682 and across an opening of the foot pocket 698 for contacting a heel of the foot to hold the foot in the foot pocket 698. The base 682 also includes a longitudinal projection 702 having a longitudinal recess shown generally at 704 at a distal end thereof. The longitudinal projection 702 defines a transverse cylindrical through-hole 706 extending across the longitudinal recess 704 for receiving a pivot 708. The base 682 also defines a cylindrical transverse through-hole 710 centered about and extending through the longitudinal projection 702 for receiving a pivot 712.

Figure 23:
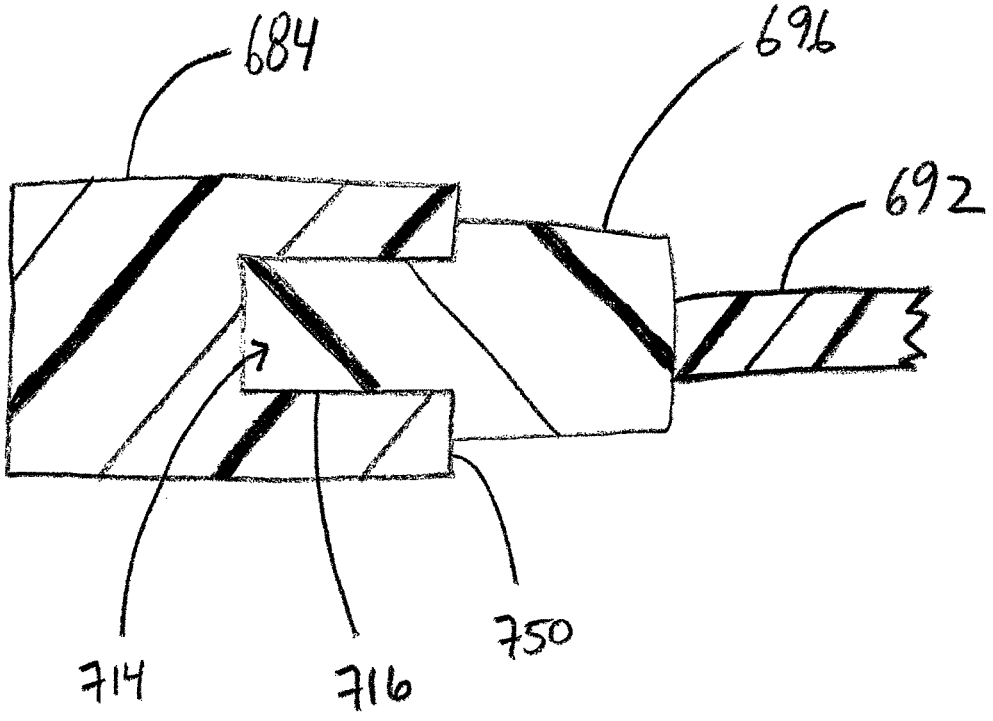
FIG. 23 is a cross-sectional view of the flipper of FIG. 21, taken along the line XXIII-XXIII in FIG. 22.

In the embodiment shown, the first and second laterally opposite side elements 684 and 686 are made from a relatively rigid thermoplastic material. Referring to FIGS. 21, 22, and 23, the first laterally opposite side element has a generally semi-circular recess 714 for receiving a first generally semi-circular projection 716 of the spreader 696. Likewise, the second laterally opposite side element 686 defines a generally semi-circular recess 718 for receiving a second generally semi-circular projection 720 of the spreader 696. As shown in FIGS. 22 and 23, the first and second generally semi-circular projections 716 and 720 are rotatably received within the generally semi-circular recesses 714 and 718 respectively.

The first and second hinges 688 and 690 are substantially the same as the first and second hinges 132 and 134 described above and shown in FIGS. 1 to 6, and therefore function in substantially the same way.

In the embodiment shown, the base 682, the first and second laterally opposite side elements 684 and 686, and the first and second hinges 688 and 690 are unitarily formed in a multi-stage injection moulding process, although alternatively these elements may be formed by other processes.

In the embodiment shown, the web 692 is made from a relatively flexible thermoplastic material. As shown in FIG. 22, the web 692 is coupled to and extends between the first and second laterally opposite side elements 684 and 686, and as discussed above, the web 692 is also coupled to the curving element 694.

The curving element 694 in the embodiment shown is made from a relatively rigid thermoplastic material, and includes a transverse through-hole 722 for receiving the pivot 708. Thus as shown in FIG. 22, the curving element 694 is coupled to the base 682 by a generally transverse hinge at the pivot 708. The curving element 694 also has a transverse through-hole 724 for receiving a transverse pivot 726 of the spreader 696.

The spreader 696 in the embodiment shown is made from a relatively rigid thermoplastic material, and has a proximal end shown generally at 728, a distal end shown generally at 730, and an intermediate portion shown generally at 732 between the proximal and distal ends 728 and 730. At the proximal end 728, the spreader 696 has a longitudinal recess shown generally at 734 for receiving the longitudinal projection 702 of the base 682, and the spreader 696 defines a transverse cylindrical through-hole 735 extending across the longitudinal recess 734 for receiving the pivot 712. As shown in FIG. 22, the proximal end 728 of the spreader 696 is thus coupled to the base 682 by a generally transverse hinge at the pivot 712.

At the distal end 730, the spreader 696 has the first and second generally semi-circular projections 716 and 720 at respective ends of opposite and spaced apart members of the spreader 696.

At the intermediate portion 732, the spreader 696 has the transverse pivot 726, which as discussed above is received in the transverse through-hole 724 of the curving element 694. As shown in FIG. 22, the curving element 694 is therefore also coupled to the spreader 696 by a generally transverse hinge at the transverse pivot 726 at the intermediate portion 732 of the spreader 696.

When the flipper 680 is assembled as shown in FIG. 22, the first and second laterally opposite side elements 684 and 686 and the web 692 may be said to form a fin shown generally at 736. As indicated above, the first and second generally semi-circular projections 716 and 720 are rotatably received within the generally semi-circular recesses 714 and 718 respectively of the first and second laterally opposite side elements 684 and 686 respectively, and the distal end 730 of the spreader 696 is thus coupled to the fin 736.

When the flipper 680 is not subjected to any deflecting forces, the flipper 680 may be referred to as being undeflected, such that the curving element 694, the spreader 696, and the fin 736 are generally planar with a bottom wall 738 of the base 682. The flipper 680 is shown undeflected in FIG. 22.

Figure 24:
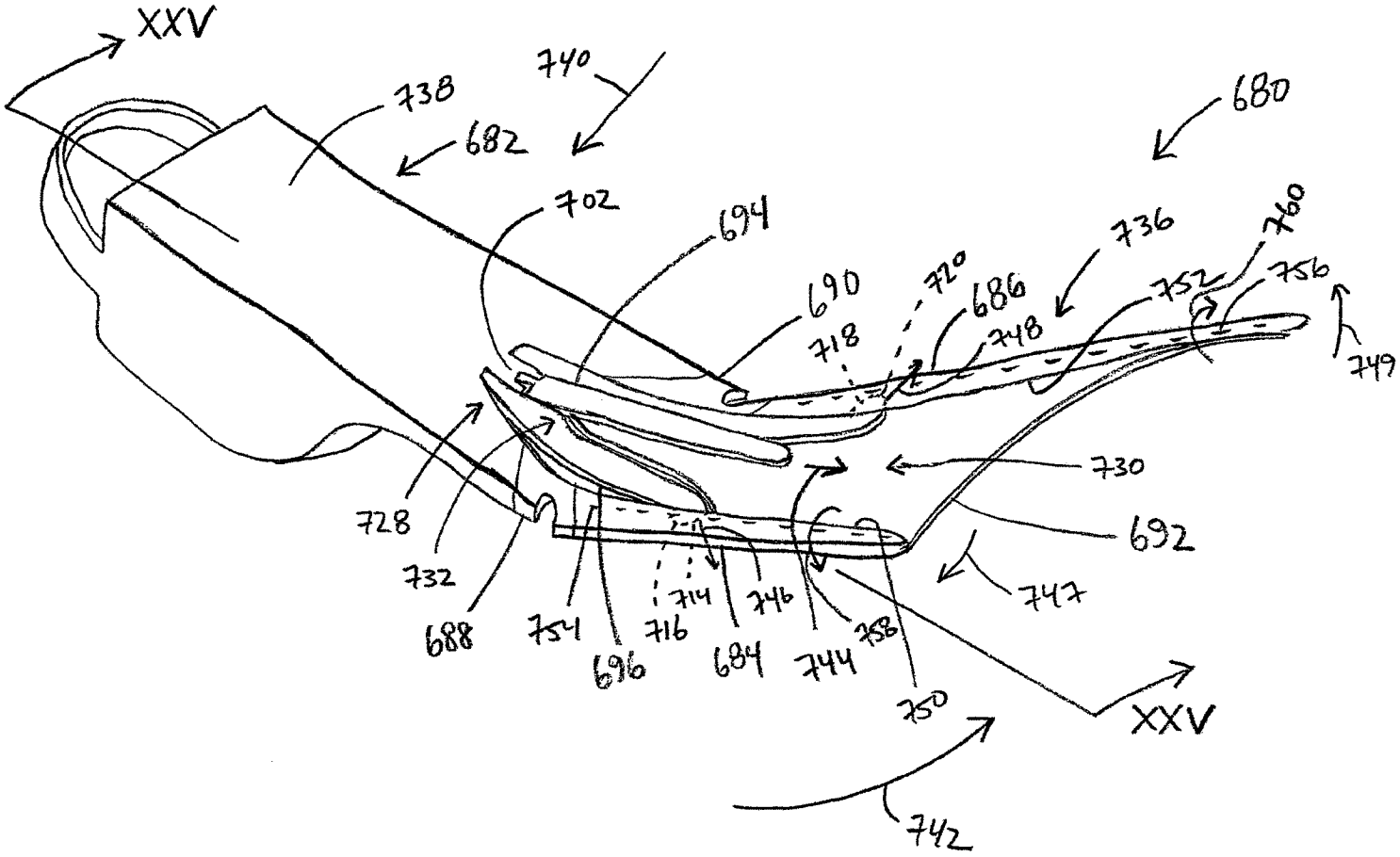
FIG. 24 is a bottom oblique view of the flipper of FIG. 21, showing the fin of the flipper of FIG. 21 deflected upward in response to a downward kick.
Figure 25:
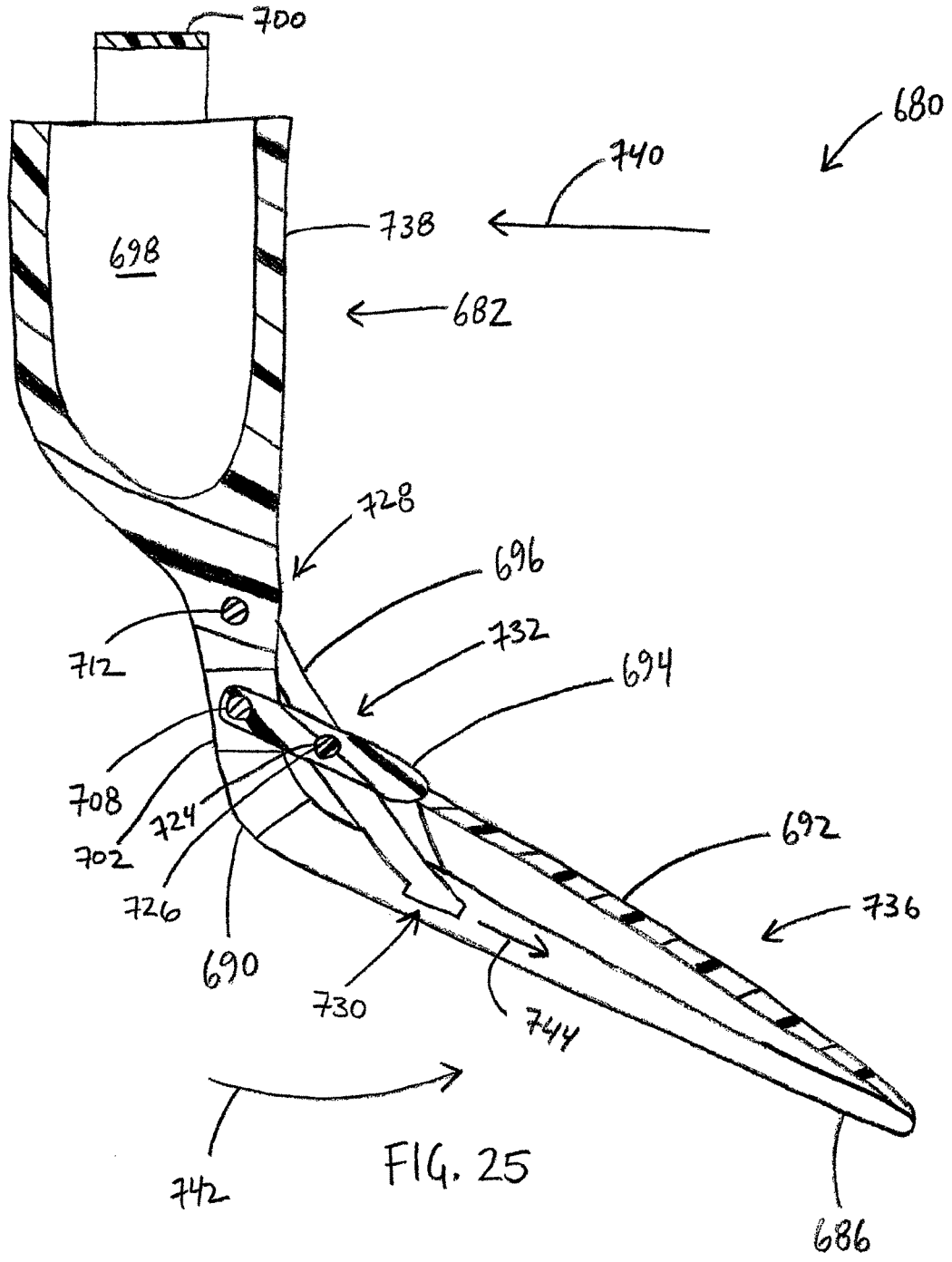
FIG. 25 is a cross-sectional view of the flipper of FIG. 21, taken along the line XXV-XXV in FIG. 24.

Referring to FIGS. 24 and 25, the flipper 680 is shown deflected in response to a downward kick in the direction of the arrow 740 of the user in a fluid such as water (not shown), for example. In response to the downward kick, the fin 736 deflects in an upward deflection direction longitudinally relative to the base 682 at the first and second hinges 688 and 690 in the direction of the arrow 742.

In the embodiment shown, the first and second hinges 688 and 690 are made from a relatively flexible thermoplastic material, whereas the first and second laterally opposite side elements 684 and 686 are made from a relatively rigid thermoplastic material. Because the first and second hinges 688 and 690 are more flexible than the surrounding material, longitudinal deflection of the fin 736 relative to the base 682 in the direction of the arrow 742 causes the first and second hinges 688 and 690 to flex longitudinally along a first curve (shown for the second hinge 690 in FIG. 25).

However, as indicated above, the spreader 696 is made from a relatively rigid thermoplastic material. Because the proximal end 728 of the spreader 696 is coupled to the base 682 about the pivot 712, the distal end 730 of the spreader 696 is coupled to the first and second laterally opposite side elements 684 and 686, and the spreader 696 is more rigid than the first and second hinges 688 and 690, longitudinal deflection of the fin 736 in the direction of the arrow 742 causes the spreader 696 to flex longitudinally along a second curve (shown in FIG. 25) having a curvature less than a curvature of the first curve, thereby causing the intermediate portion 732 of the spreader 696 to move away from the fin 736 generally in the direction of the arrow 742 as shown in FIG. 25.

Because the spreader 696 curves along a second curve having a curvature less than the curvature of the first curve of the first and second hinges 688 and 690, the distal end 730 of the spreader 696 is urged longitudinally relative to the fin in the direction of the arrow 744. Because the first and second generally semi-circular projections 716 and 720 of the spreader 696 are rotatably received within the generally semi-circular recesses 714 and 718 of the first and second laterally opposite side elements 684 and 686 respectively, the longitudinal urging of the distal end 730 of the spreader 696 in the direction of the arrow 744 causes the first and second generally semi-circular projections 716 and 720 to impose respective thrust forces on the first and second laterally opposite side elements respectively in the respective directions of the arrows 746 and 748 respectively shown in FIG. 24. The respective thrust forces thus imposed by the first and second generally semi-circular projections 716 and 720 may collectively be referred to as "a first force".

The respective thrust forces of the first and second generally semi-circular projections 716 and 720 in the directions of the arrows 746 and 748 respectively spread the first and second laterally opposite side elements apart in the respective directions of the arrows 747 and 749 respectively. Thus, the first and second generally semi-circular projections 716 and 720 are coupled to the first and second laterally opposite side elements 684 and 686 by respective hinges that receive and use the forces imposed by the distal end 730 of the spreader 696 caused by longitudinal deflection of the fin 736 relative to the base 682 to spread the first and second laterally opposite side elements 684 and 686 apart, which elastically deforms the web 692 by stretching the web 692 to accommodate the spreading of the first and second laterally opposite side elements 684 and 686, and changes a lateral shape of the fin 736. Although the spreader 696 in the embodiment shown is made from a relatively flexible thermoplastic material, the spreader 696 is flexible enough to permit a separation distance 751 between the first and second generally semi-circular projections 716 and 720 to change as the first and second laterally opposite side elements 684 and 686 are spread apart.

As discussed above, the intermediate portion 732 of the spreader 696 is coupled to the curving element 694 by a generally transverse hinge at the transverse pivot 726 of the spreader 696. Therefore, when the intermediate portion 732 of the spreader 696 moves away from the fin 736 generally in the direction of the arrow 742 in response to longitudinal deflection of the fin 736 relative to the base 682 in the direction of the arrow 742, the intermediate portion 732 of the spreader 696 urges the curving element at the transverse through-hole 724 of the curving element 694 away from the fin 736 generally in the direction of the arrow 742, thus deflecting the curving element about the pivot 708. As shown in FIG. 25, this deflection of the curving element 694 about the pivot 708 causes the web 692 to move away from the first and second laterally opposite side elements 684 and 686 generally in the direction of the arrow 742, thereby imparting a concave shape to the fin 736 opposite the deflection direction of the arrow 742.

Further, the first and second generally semi-circular projections 716 and 720 of the spreader 696 contact the first and second laterally opposite side elements 684 and 686 respectively at respective inner sides 750 and 752 of the first and second laterally opposite side elements 684 and 686. Therefore, when the intermediate portion 732 of the spreader 696 moves generally in the direction of the arrow 742, the distal end 730 of the spreader 696 imposes respective forces generally in the direction of the arrow 742 on the respective inner sides 750 and 752 of the first and second laterally opposite side elements 684 and 686, thereby causing the first and second laterally opposite side elements 684 and 686 to rotate about respective generally longitudinal axes 754 and 756 of the first and second laterally opposite side elements 684 and 686 in respective directions of arrows 758 and 760 respectively. This rotation of the first and second laterally opposite side elements 684 and 686 further imparts a concave shape to the fin 736 opposite the deflection direction of the arrow 742.

Although FIGS. 24 and 25 show the fin 736 deflected upward in the direction of the arrow 742 relative to the base 682 in response to a downward kick in the direction of the arrow 740, the fin 736 may also be deflected downward in a deflection direction opposite the direction of the arrow 742 relative to the base 682 in response to an upward kick in a direction opposite the direction of the arrow 740. In the case of such downward deflection, the spreader 696 and the curving element 694 move away from the fin 736 generally in the direction opposite the direction the direction of the arrow 742. Such downward deflection therefore causes the first and second laterally opposite side elements 684 and 686 to spread and change the lateral shape of the fin 736 in substantially the same way as discussed above and shown in FIGS. 24 and 25 in the case of upward deflection.

Figure 26:
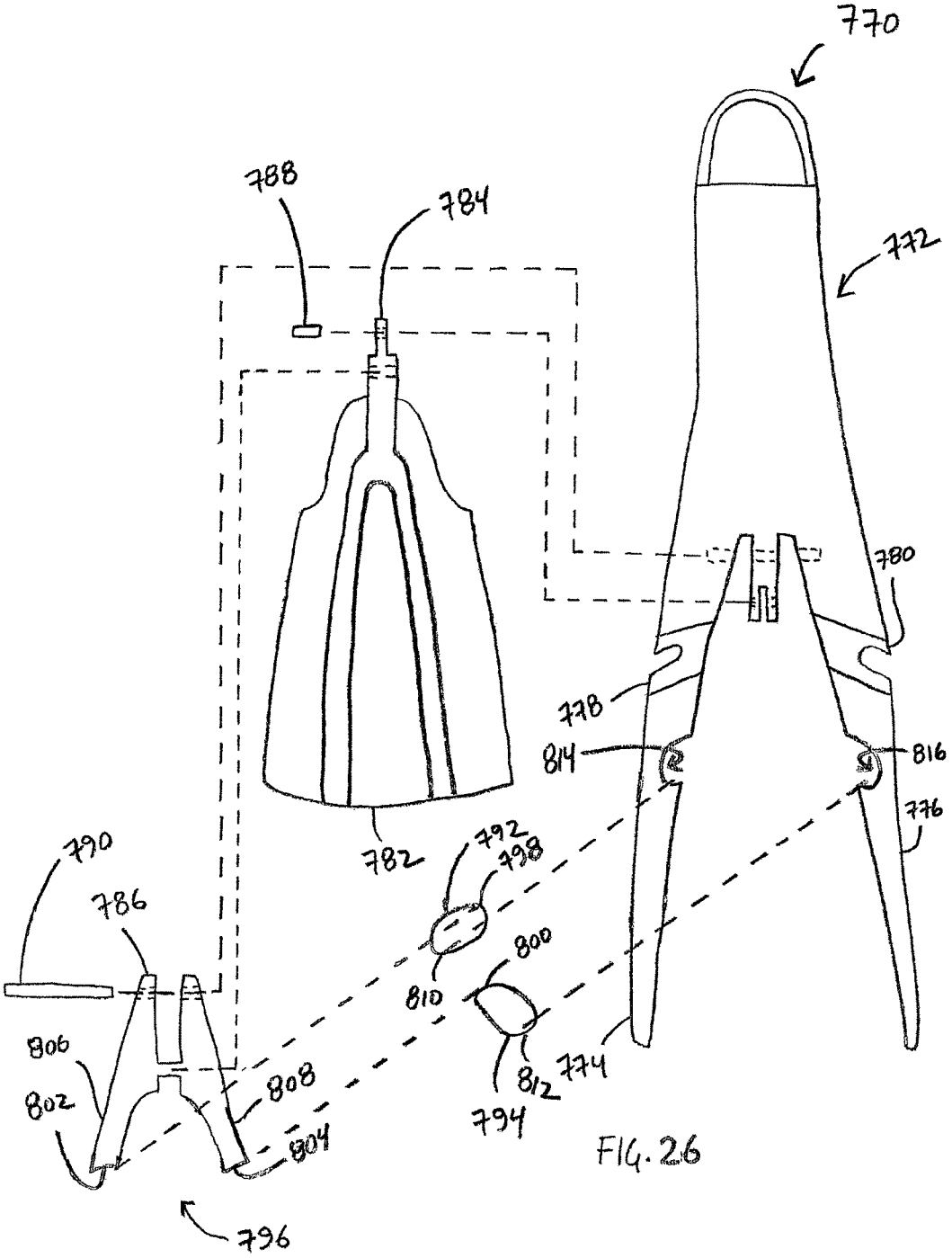
FIG. 26 is an exploded bottom view of a flipper in accordance with another embodiment of the invention.

Referring to FIG. 26, a flipper in accordance with another embodiment of the invention is shown generally at 770. The flipper 770 includes a base shown generally at 772, first and second laterally opposite side elements 774 and 776, first and second hinges 778 and 780 coupling the first and second laterally opposite side elements 774 and 776 respectively to the base 772, an elastically deformable web 782, a curving element 784 coupled to the web 782, a spreader 786, and pivots 788 and 790. The flipper 770 is substantially the same as the flipper 680 discussed above and shown in FIGS. 21 to 25, although the flipper 770 further includes first and second elastomeric members 792 and 794 for hingedly coupling the first and second laterally opposite side elements 774 and 776 respectively to a distal end shown generally at 796 of the spreader 786. In the embodiment shown, the first and second elastomeric members 792 and 794 are made from a relatively flexible thermoplastic material. The flipper 770 may be formed using multi-stage injection moulding, for example.

More particularly, respective proximal ends 798 and 800 of the first and second elastomeric members 792 and 794 are coupled to respective distal ends 802 and 804 of respective spaced apart elongate members 806 and 808 of the spreader 786 at the distal end 796 of the spreader 786. Also, respective distal ends 810 and 812 of the first and second elastomeric members 792 and 794 are received in respective recesses shown generally at 814 and 816 of the first and second laterally opposite side elements 774 and 776, and coupled to the first and second laterally opposite side elements 774 and 776 respectively at the respective recesses 814 and 816. The first and second elastomeric members 792 and 794 thus hingedly couple the distal end 796 of the spreader 786 to the first and second laterally opposite side elements 774 and 776 respectively, and the flipper 770 thus functions substantially the same as the flipper 680 discussed above and shown in FIGS. 21 to 25.

Figure 27:
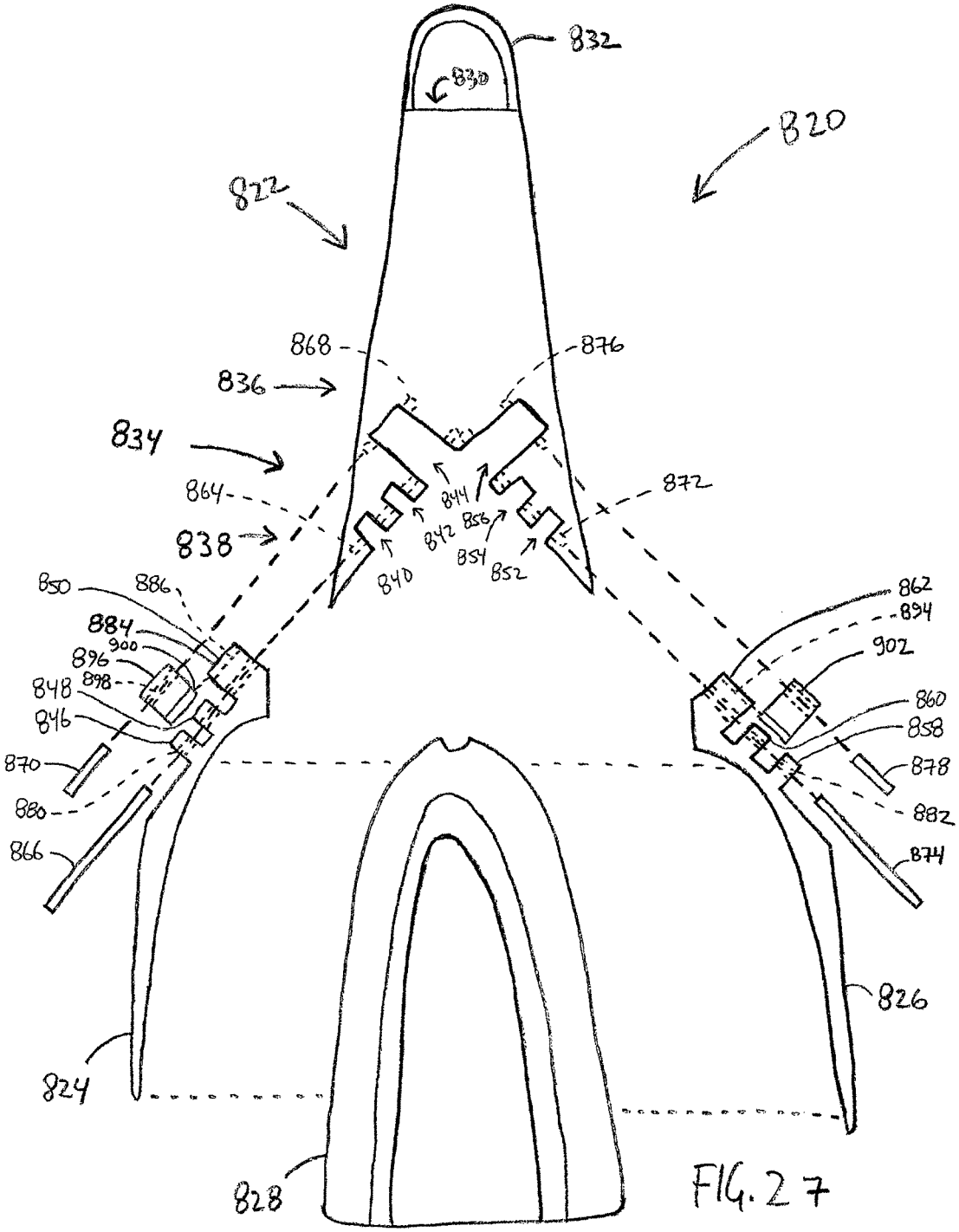
FIG. 27 is an exploded bottom view of a flipper in accordance with another embodiment of the invention.
Figure 28:
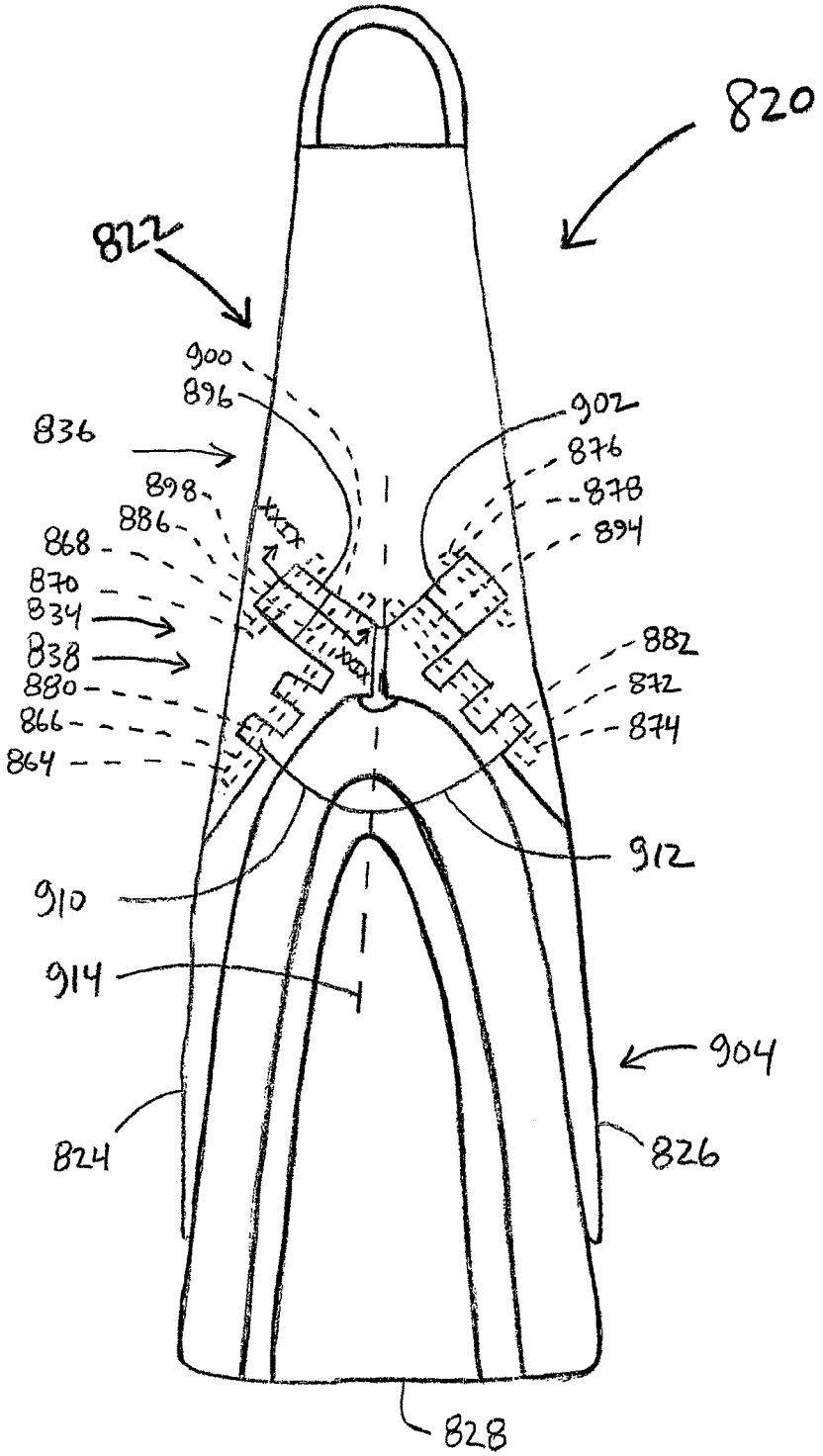
FIG. 28 is a bottom view of the flipper of FIG. 27, showing an undeflected fin of the flipper of FIG. 27.

Referring to FIGS. 27 and 28, a flipper in accordance with another embodiment of the invention is shown generally at 820. The flipper 820 includes a base shown generally at 822, first and second laterally opposite side elements 824 and 826, and an elastically deformable web 828 coupled to and extending between the first and second laterally opposite side elements 824 and 826.

In the embodiment shown, the base 822 is made from a moderately flexible thermoplastic material. The base 822 defines a foot pocket 830 for receiving a foot of a user (not shown), and a heel-retaining strap 832 extending from laterally opposite sides of the base 822 and across an opening of the foot pocket 830 for contacting a heel of the foot to hold the foot in the foot pocket 830.

The base 822 in the embodiment shown is unitarily formed (by multi-stage injection moulding, for example) with a spreader shown generally at 834. The spreader 834 in the embodiment shown is made from a relatively rigid thermoplastic material. The spreader 834 has a proximal end 836 coupled to the base 822, and a distal end shown generally at 838. At the distal end 838, the spreader 834 defines recesses shown generally at 840, 842, and 844 for receiving complementary projections 846, 848, and 850 respectively on the first laterally opposite side element 824, and recesses shown generally at 852, 854, and 856 for receiving complementary projections 858, 860, and 862 respectively of the second laterally opposite side element 826.

Also at the distal end 838, the spreader 834 defines a cylindrical hole 864 extending across the recesses 840, 842, and 844 for receiving a pivot 866. Further, at the distal end 838, the spreader 834 defines a cylindrical hole 868 extending across the recess 844 for receiving a pivot 870. Still further, at the distal end 838, the spreader 834 defines a cylindrical hole 872 extending across the recesses 852, 854, and 856 for receiving a pivot 874. Still further, at the distal end 838, the spreader 834 defines a cylindrical hole 876 extending across the recess 856 for receiving a pivot 878. In the embodiment shown, the pivots 866, 870, 874, and 878 are metallic, although alternatively the pivots 866, 870, 874, and 878 may include other materials.

In the embodiment shown, the first and second laterally opposite side elements 824 and 826 are made from relatively rigid thermoplastic materials. The first laterally opposite side element 824 defines a through-hole 880 across the projections 846, 848, and 850 for receiving the pivot 866. As shown in FIG. 28, the first laterally opposite side element 824 is thus coupled to the base 822 and to the distal end 838 of the spreader 834 at a first hinge by the pivot 866. The second laterally opposite side element 826 defines a through-hole 882 across the projections 858, 860, and 862 for receiving the pivot 874. As shown in FIG. 28, the second laterally opposite side element 826 is thus coupled to the base 822 and to the distal end 838 of the spreader 834 at a second hinge by the pivot 874.

Figure 29:
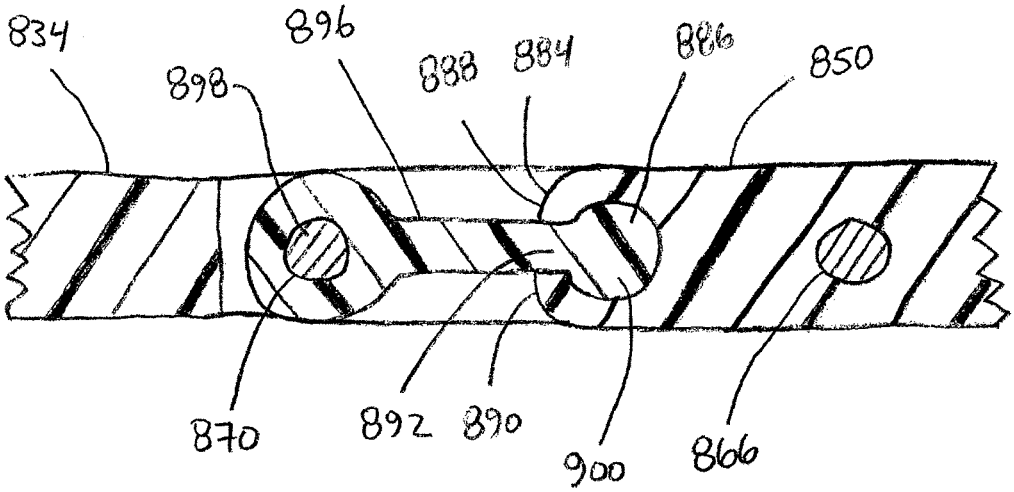
FIG. 29 is a cross-sectional view of the flipper of FIG. 27, taken along the line XXVIIII-XXVIIII in FIG. 28.

Referring to FIG. 29, the projection 850 of the first laterally opposite side element 824 has a distal end 884 defining a channel 886 partially enclosed by end walls 888 and 890 but open at an opening 892. The projection 862 of the second laterally opposite side element 826 defines a similar channel 894 shown in FIGS. 27 and 28.

Referring to FIGS. 27 to 29, the flipper 820 further includes a first resilient element 896, which in the embodiment shown is made from a relatively flexible and resilient thermoplastic material. The first resilient element 896 defines a through-hole 898 for receiving the pivot 870, and the first resilient element 896 is thus pivotally coupled to the pivot 870. The first resilient element 896 also defines a bead 900 receivable in the channel 886 of the projection 850 of the first laterally opposite side element 824 to couple the first resilient element 896 to the projection 850 of the first laterally opposite side element 824. The flipper 820 also includes a second resilient element 902 that is coupled in substantially the same way to the pivot 878 and to the channel 894 of the projection 862 of the second laterally opposite side element 826.

Referring to FIG. 28, the web 828 is coupled to and extends between the first and second laterally opposite side elements 824 and 826. The web 828 and the first and second laterally opposite side elements 824 and 826 may be unitarily formed by multi-stage injection moulding, for example. The first and second laterally opposite side elements 824 and 826 and the web 828 thus coupled or unitarily formed may be referred to as a fin shown generally at 904.

When the flipper 820 is not subjected to any deflecting forces, the flipper 820 may be referred to as being undeflected, such that the first and second laterally opposite side elements 824 and 826 and the web 828 are generally coplanar.

Figure 30:
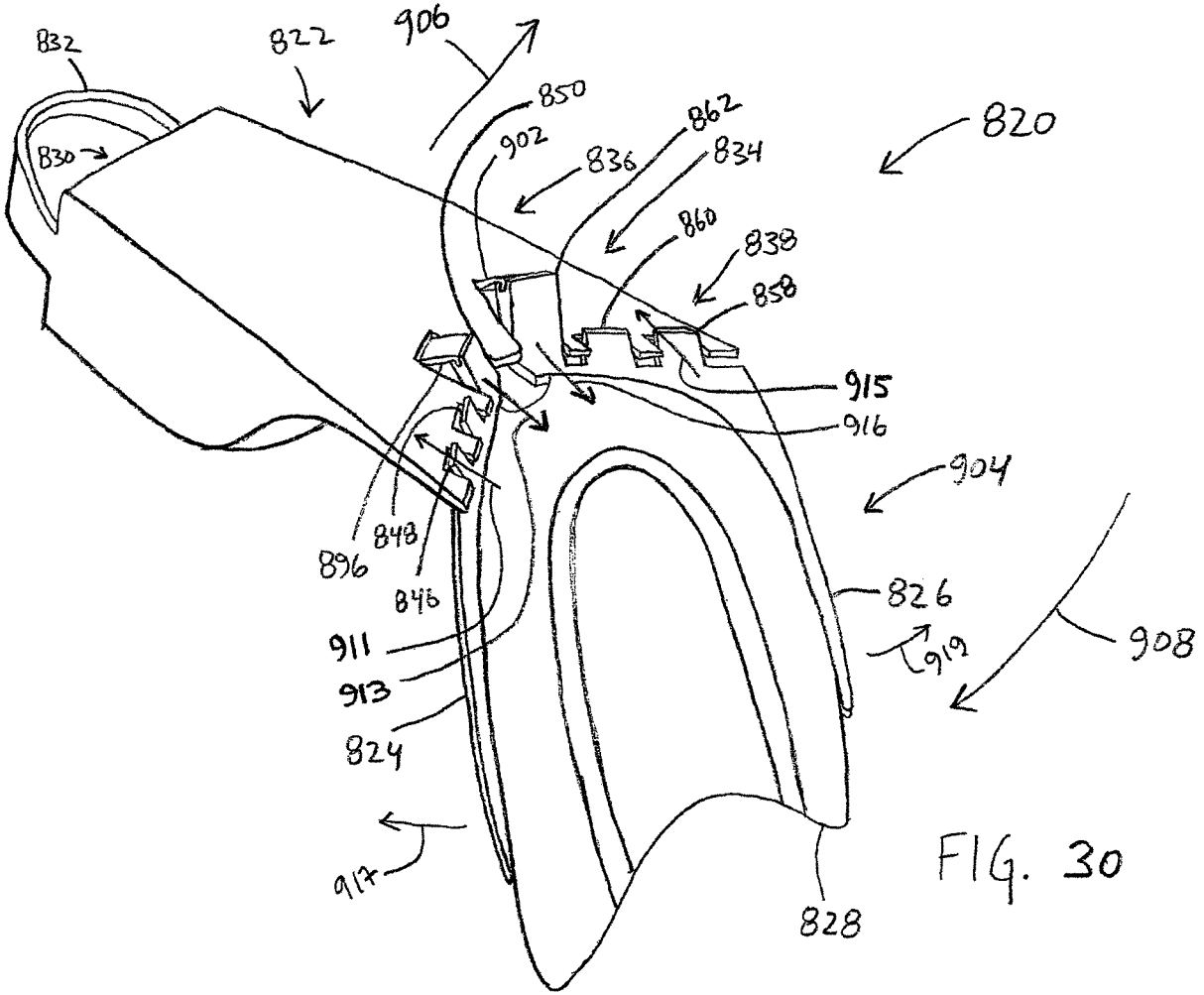
FIG. 30 is a bottom oblique view of the flipper of FIG. 27, showing the fin of the flipper of FIG. 27 deflected downward in response to an upward kick.

However, referring to FIG. 30, the flipper 820 is shown deflected in response to an upward kick in the direction of the arrow 906 of the user in a fluid such as water (not shown), for example. In response to the upward kick, the fin 904 deflects in a downward deflection direction longitudinally relative to the base 822 about the pivot 866 and 874 (shown in FIGS. 27 and 28) in the direction of the arrow 908.

Referring back to FIG. 28, the cylindrical holes 864 and 872 hold the pivots 866 and 874 respectively at respective acute angles 910 and 912 from a central longitudinal axis 914 of the fin 904. Therefore, the first and second laterally opposite side elements are coupled to the base 822 and to the distal end 838 of the spreader 834 at first and second hinges, the first and second hinges having respective hinge axes defined by the pivots 866 and 874 respectively and disposed at the respective acute angles 910 and 912 from the central longitudinal axis 914 of the fin 904.

However, referring back to FIG. 30, the longitudinal deflection of the fin 904 relative to the base 822 tends naturally to involve rotation of the first and second laterally opposite side elements 824 and 826 about a generally transverse axis (not shown) of the fin 904. Therefore, the distal end 838 of the spreader 834 exerts forces on the first and second laterally opposite side elements 824 and 826 in response to longitudinal deflection of the fin 904 relative to the base 822 to conform the movement of the first and second laterally opposite side elements 824 and 826 about the respective hinge axes defined by the pivots 866 and 874 respectively.

More particularly, in response to the downward deflection of the fin 904 relative to the base 822 in the deflection direction of the arrow 908, the distal end 838 of the spreader 834 exerts an inward force in the direction of the arrow 911 on the outermost projection 846 of the first laterally opposite side element 824, and an outward force in the direction of the arrow 913 on the innermost projection 850 of the first laterally opposite element 824. Also, in response to the downward deflection of the fin 904 relative to the base 822 in the deflection direction of the arrow 908, the distal end 838 of the spreader 834 exerts an inward force in the direction of the arrow 915 on the outermost projection 858 of the second laterally opposite side element 826, and an outward force in the direction of the arrow 916 on the innermost projection 862 of the second laterally opposite side element 826.

The aforementioned forces imposed by the distal end 838 of the spreader 834 may collectively be referred to as "a first force", and spread the first and second laterally opposite side elements 824 and 826 apart in respective directions of the arrows 917 and 919. Therefore, the projections 846, 848, and 850 of the first laterally opposite side element 824 and the projections 858, 860, and 862 of the second laterally opposite side element 826 use forces imposed by the distal end 838 of the spreader 834, in response to longitudinal deflection of the fin 904 relative to the base 822, to spread the first and second laterally opposite side elements 824 and 826 apart, thereby elastically deforming the web 828 by stretching the web 828 to accommodate the separation of the first and second laterally opposite side elements 824 and 826, and thereby changing a lateral shape of the fin 904.

Further, because the respective hinge axes defined by the pivots 866 and 874 are at the respective acute angles 910 and 912 from the central longitudinal axis 914 of the fin 904 (shown in FIG. 28), rotation of the first and second laterally opposite side elements about these hinge axes imparts a concave shape to the fin opposite a direction of deflection of the fin, in substantially the same way as described above and illustrated in FIGS. 3 to 6.

Because the first and second resilient elements 896 and 902 are coupled to the base 822 and to the projections 850 and 862 respectively of the first and second laterally opposite side elements 824 and 826 respectively, rotating the first and second laterally opposite side elements 824 and 826 about the respective hinge axes defined by the pivots 866 and 874 respectively (shown in FIGS. 27 and 28) causes resilient deformation of the first and second resilient elements 896 and 902, thereby storing elastic potential energy in the first and second resilient elements 896 and 902 and imparting elastic resistance to the fin 904 in response to longitudinal deflection of the fin 904 relative to the base 822. This elastic potential energy is usable to restore the first and second laterally opposite side elements 824 and 826 from deflected positions shown in FIG. 30, for example, to undeflected positions shown in FIG. 28.

In the embodiment shown, the first and second resilient elements 896 and 902 may be replaced by removing the first and second resilient elements 896 and 902 from the pivots 870 and 878 respectively, and from the channels 886 and 894 (shown in FIGS. 27 to 29). Therefore, first and second resilient elements 896 and 902 may be replaced with other resilient elements having different moduli of elasticity, thereby advantageously enabling adjustment of the elastic resistance of the fin 904 to longitudinal deflection of the fin 904 relative to the base 822.

Although FIG. 30 shows the fin 904 deflected downward in the direction of the arrow 908 relative to the base 822 in response to an upward kick in the direction of the arrow 906, the fin 904 may also be deflected upward in a deflection direction opposite the direction of the arrow 908 relative to the base 822 in response to a downward kick in a direction opposite the direction of the arrow 906. Such upward deflection therefore causes the first and second laterally opposite side elements 826 and 826 to spread and change the lateral shape of the fin 904 in substantially the same way as discussed above and shown in FIG. 30 in the case of downward deflection.

Figure 31:
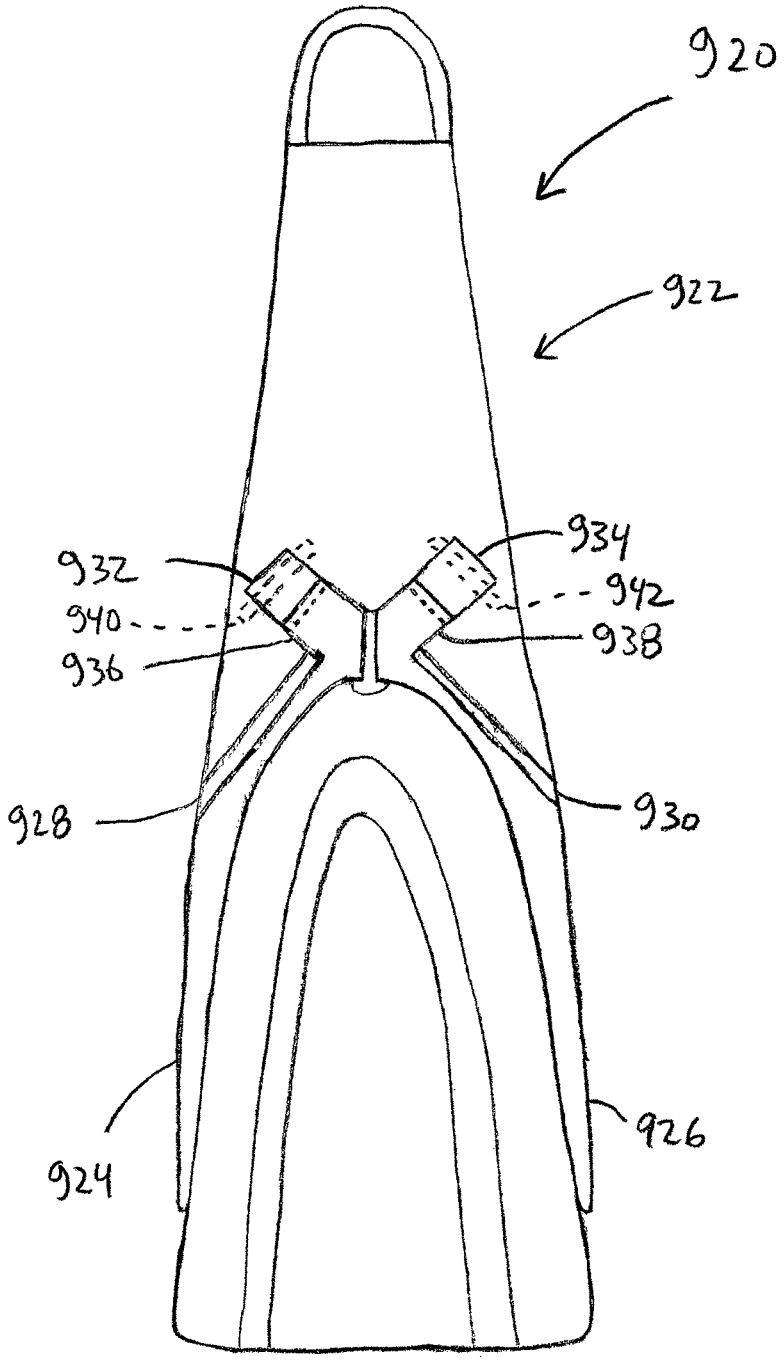
FIG. 31 is a bottom view of a flipper in accordance with another embodiment of the invention.

Referring to FIG. 31, a flipper in accordance with another embodiment of the invention is shown generally at 920. The flipper 920 includes a base shown generally at 922, first and second laterally opposite side elements 924 and 926, first and second hinges 928 and 930 coupling the first and second laterally opposite side elements respectively to the base 922, first and second resilient elements 932 and 934 coupled to first and second projections 936 and 938 respectively of the first and second laterally opposite side elements 924 and 926 respectively, and pivots 940 and 942 pivotally coupling the first and second resilient elements 932 and 934 respectively to the base 922.

The flipper 920 is substantially the same as the flipper 820 discussed above and shown in FIGS. 28 to 30, except that the first and second hinges 928 and 930 of the flipper 920 are made of a relatively flexible thermoplastic material, and hingedly couple the first and second laterally opposite side elements 924 and 926 to the base 922 such that the flipper 920 functions in substantially the same way as the flipper 820 described above and shown in FIGS. 27 to 30. The flipper 920 may be unitarily formed by multi-stage injection moulding, for example.

Figure 40:
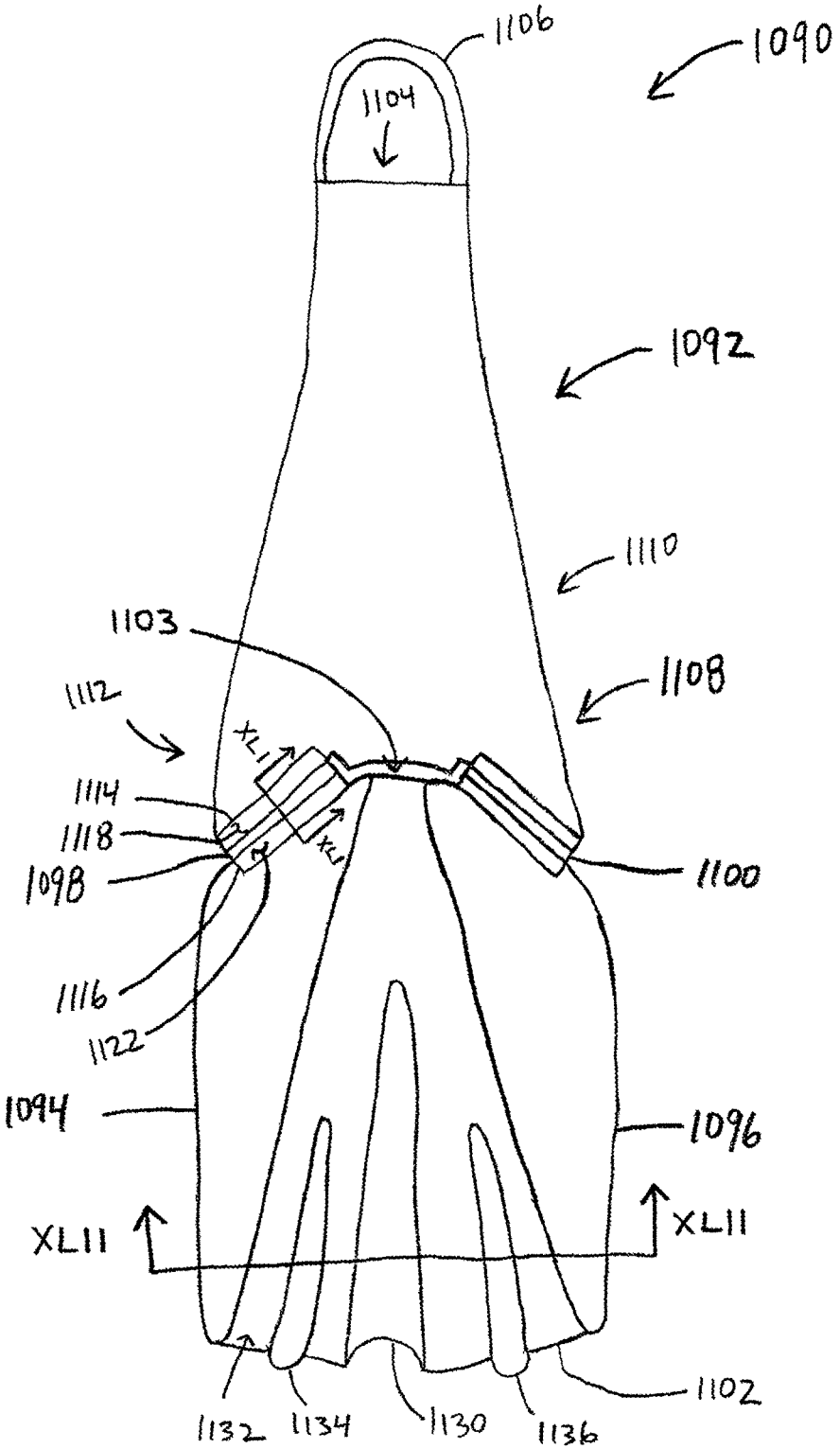
FIG. 40 is a bottom view of a flipper in accordance with another embodiment of the invention.

Referring to FIG. 40, a flipper in accordance with another embodiment of the invention is shown generally at 1090. The flipper 1090 includes a base shown generally at 1092, first and second laterally opposite side elements 1094 and 1096, and first and second hinges 1098 and 1100 coupling the first and second laterally opposite side elements 1094 and 1096 respectively to the base 1092. The flipper 1090 also includes an elastically deformable web 1102 coupled to and extending between the first and second laterally opposite side elements 1094 and 1096.

In the embodiment shown, the elastically deformable web 1102 is detached from the base 1092, leaving a gap shown generally at 1103 between the base 1092 and the elastically deformable web 1102. The gap 1103 permits the fin comprised of the first and second laterally opposite side elements 1094 and 1096 and the elastically deformable web 1102 to form a trust channel along substantially the entire length of the fin when the fin is deflected longitudinally relative to the base 1092, and such a longer thrust channel may advantageously increase efficiency of the flipper 1090 in generating thrust. However, in alternative embodiments, the elastically deformable web 1102 may be attached to the base 1092.

In the embodiment shown, the base 1092 is made from a moderately flexible thermoplastic material. The base 1092 defines a foot pocket shown generally at 1104 for receiving a foot of a user (not shown), and a heel-retaining strap 1106 extending from laterally opposite sides of the base 1092 and across an opening of the foot pocket 1104 for contacting a heel of the foot to hold the foot in the foot pocket 1104.

The base 1092 in the embodiment shown is unitarily formed (by multi-stage injection moulding, for example) with a spreader shown generally at 1108. The spreader 1108 in the embodiment shown is made from a relatively rigid thermoplastic material. The spreader 1108 has a proximal end shown generally at 1110 and coupled to the base 1092, and a distal end shown generally at 1112. At the distal end 1112, the spreader 1108 is coupled to the hinges 1098 and 1100.

Figure 41:
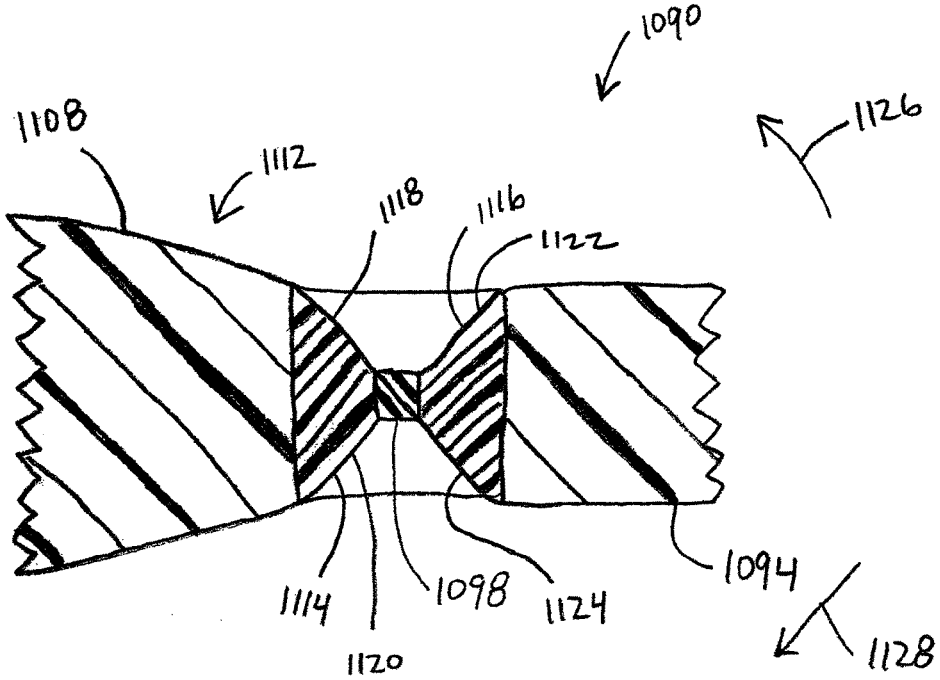
FIG. 41 is a cross-sectional view of the flipper of FIG. 40, taken along the line XLI-XLI in FIG. 40.

Referring to FIG. 41, the hinge 1098 is made from a relatively flexible thermoplastic material. The embodiment shown includes a tapered member 1114 coupling the hinge 1098 to the distal end 1112 of the spreader 1108, and a tapered member 1116 coupling the hinge 1098 to the first laterally opposite side element 1094. In the embodiment shown, the tapered members 1114 and 1116 are made from a relatively rigid thermoplastic material. The tapered member 1114 has tapered outer surfaces 1118 and 1120 extending between the hinge 1098 and the distal end 1112 of the spreader 1108, and the tapered member 1116 has tapered outer surfaces 1122 and 1124 extending between the hinge 1098 and the first laterally opposite side element 1094.

Thus, if the first laterally opposite side element 1094 is deflected upward in the direction of the arrow 1126 in response to a downward kick in a fluid such as water (not shown) for example, the tapered outer surfaces 1118 and 1122 make contact to prevent further deflection in the direction of the arrow 1126. Similarly, if the first laterally opposite side element 1094 is deflected downward in the direction of the arrow 1128 in response to an upward kick in a fluid such as water (not shown) for example, the tapered surfaces 1120 and 1124 may contact to prevent further deflection in the direction of the arrow 1128. Thus, angles of the tapered surfaces 1118, 1120, 1122, and 1124 may be chosen to define a maximum amount of deflection of the flipper 1090. Advantageously, such a maximum amount of deflection may maintain a desirable deflected shape of the flipper 1090 to prevent a loss of thrust that may result from excessive deflection, for example. In the embodiment shown, the hinge 1100 is substantially the same as the hinge 1098, and is coupled to tapered members similar to the tapered members 1114 and 1116. However, in alternative embodiments, the tapered members 1114 and 1116 may be omitted so that deflection of the flipper 1090 is generally less restricted. More generally, other embodiments described herein for example, hinges may or may not restrict deflection to predetermined maximum amounts of deflection.

Figure 42:
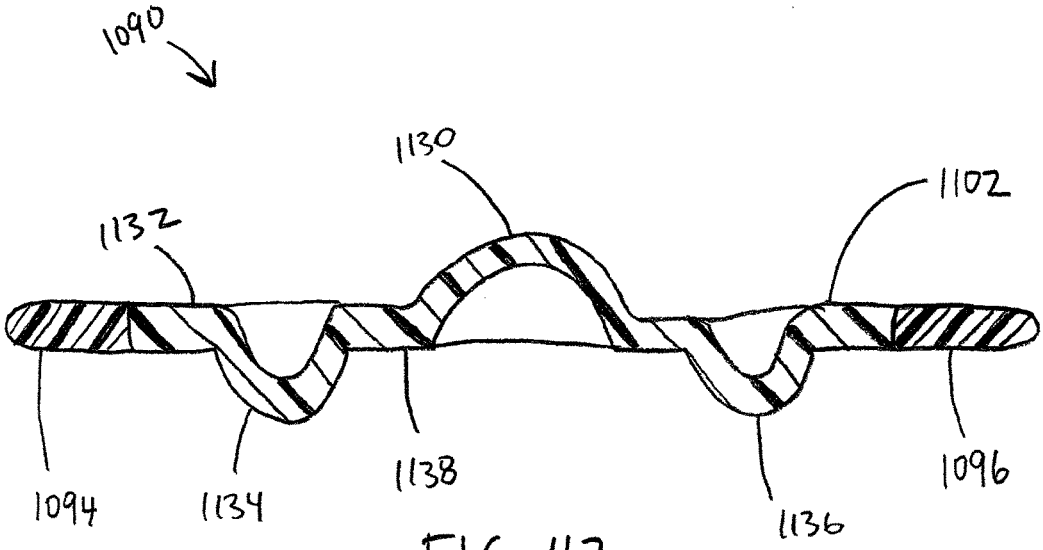
FIG. 42 is a cross-sectional view of the flipper of FIG. 40, taken along the line XLII-XLII in FIG. 40.

Referring to FIG. 42, the elastically deformable web 1102 in the embodiment shown includes a first longitudinal curve 1130 projecting out of a bottom side 1132 of the elastically deformable web 1102, and second and third longitudinal curves 1134 and 1136 projecting out of a top side 1138 opposite the bottom side 1132 of the elastically deformable web 1102. In general, the shape and other physical properties of the elastically deformable web 1102 of a fin may be varied in various embodiments such as the embodiments disclosed herein for example, may be varied to vary the curvature and spreading of the fins. For example, a web that is relatively rigid or less stretchable will permit generally less lateral spreading than a more flexible or stretchable web. In embodiments such as the flipper 1090 and other embodiments disclosed herein for example, longitudinal deflection and lateral spreading both result from rotation of first and second laterally opposite side elements (1094 and 1096 in the embodiment shown) about hinges (1098 and 1100 in the embodiment shown), and therefore, in such embodiments, a more stretchable web generally permits more longitudinal deflection. Therefore, a relatively more flexible web may be chosen to permit relatively greater degrees of longitudinal deflection, and a relatively more rigid web may be chosen to permit relatively less deflection, for example.

Figure 32:
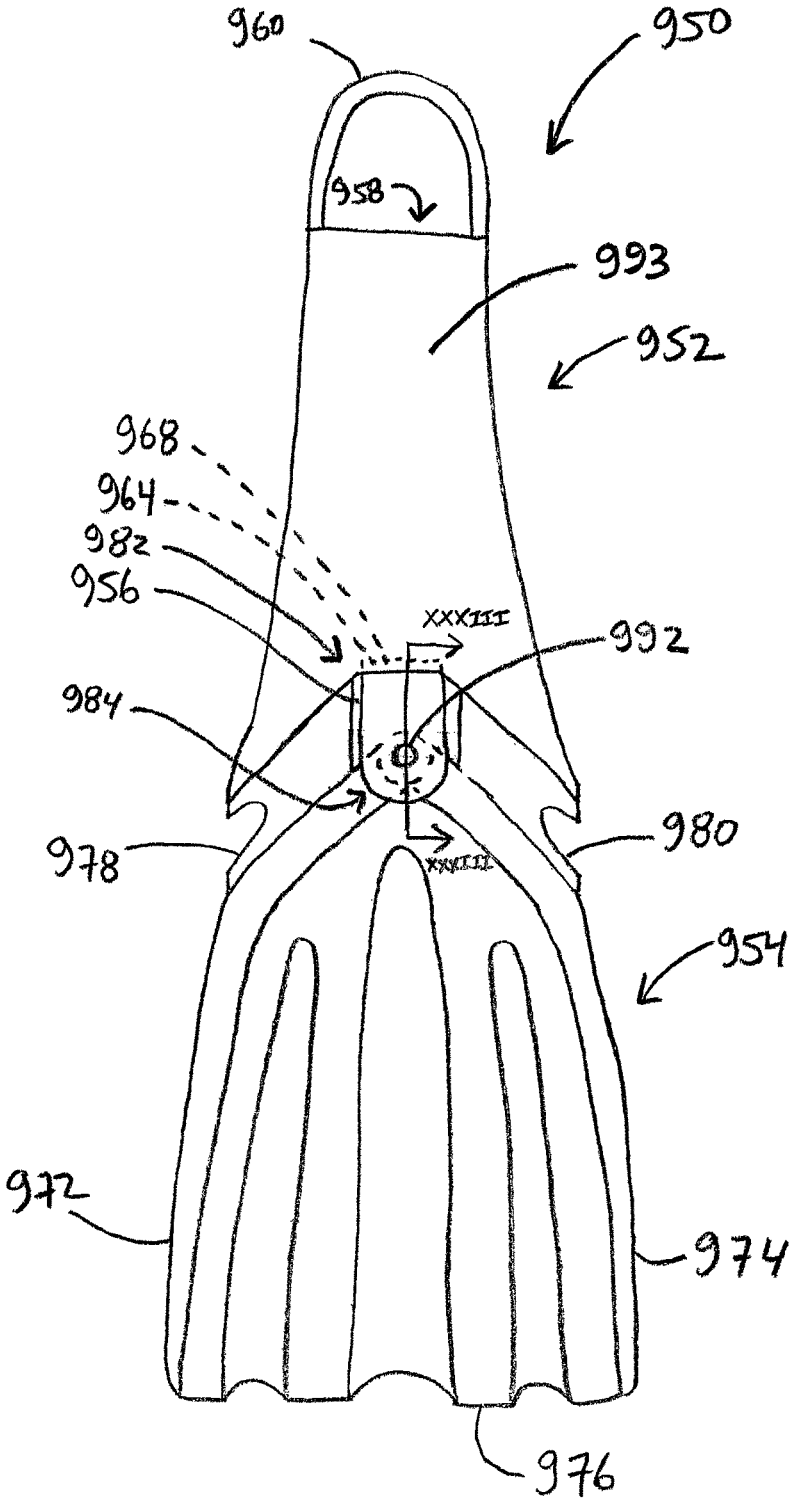
FIG. 32 is a bottom view of a flipper in accordance with another embodiment of the invention, showing an undeflected fin of the flipper of FIG. 32.

Referring to FIG. 32, a flipper in accordance with another embodiment of the invention is shown generally at 950. The flipper 950 includes a base shown generally at 952, a deformable fin shown generally at 954, and a spreader 956.

In the embodiment shown, the base 952 is made from a moderately flexible thermoplastic material. The base 952 defines a foot pocket 958 for receiving a foot of a user (not shown), and a heel-retaining strap 960 extending from laterally opposite sides of the base 952 and across an opening of the foot pocket 958 for contacting a heel of the foot to hold the foot in the foot pocket 958. Further, referring to FIGS. 32 and 33, the base 952 also has a distal end wall 962 defining transverse generally semi-cylindrical channels 964 and 966 for receiving corresponding generally semi-cylindrical transverse projections 968 and 970 respectively on the spreader 956.

The fin 954 in the embodiment shown includes first and second laterally opposite side elements 972 and 974 and an elastically deformable web 976 coupled to and extending between the first and second laterally opposite side elements 972 and 974. In the embodiment shown, the first and second laterally opposite side elements 972 and 974 are made from a relatively rigid thermoplastic material, and the web 976 is made from a relatively flexible thermoplastic material. The first and second laterally opposite side elements 972 and 974 are coupled to the base 952 by first and second hinges 978 and 980, and the first and second hinges 978 and 980 are substantially the same as the first and second hinges 132 and 134 discussed above and shown in FIGS. 1 to 6. The base 952, the first and second laterally opposite side elements 972 and 974, the web 976, and the first and second hinges 978 and 980 may be unitarily formed by multi-stage injection moulding, for example.

Figure 33:
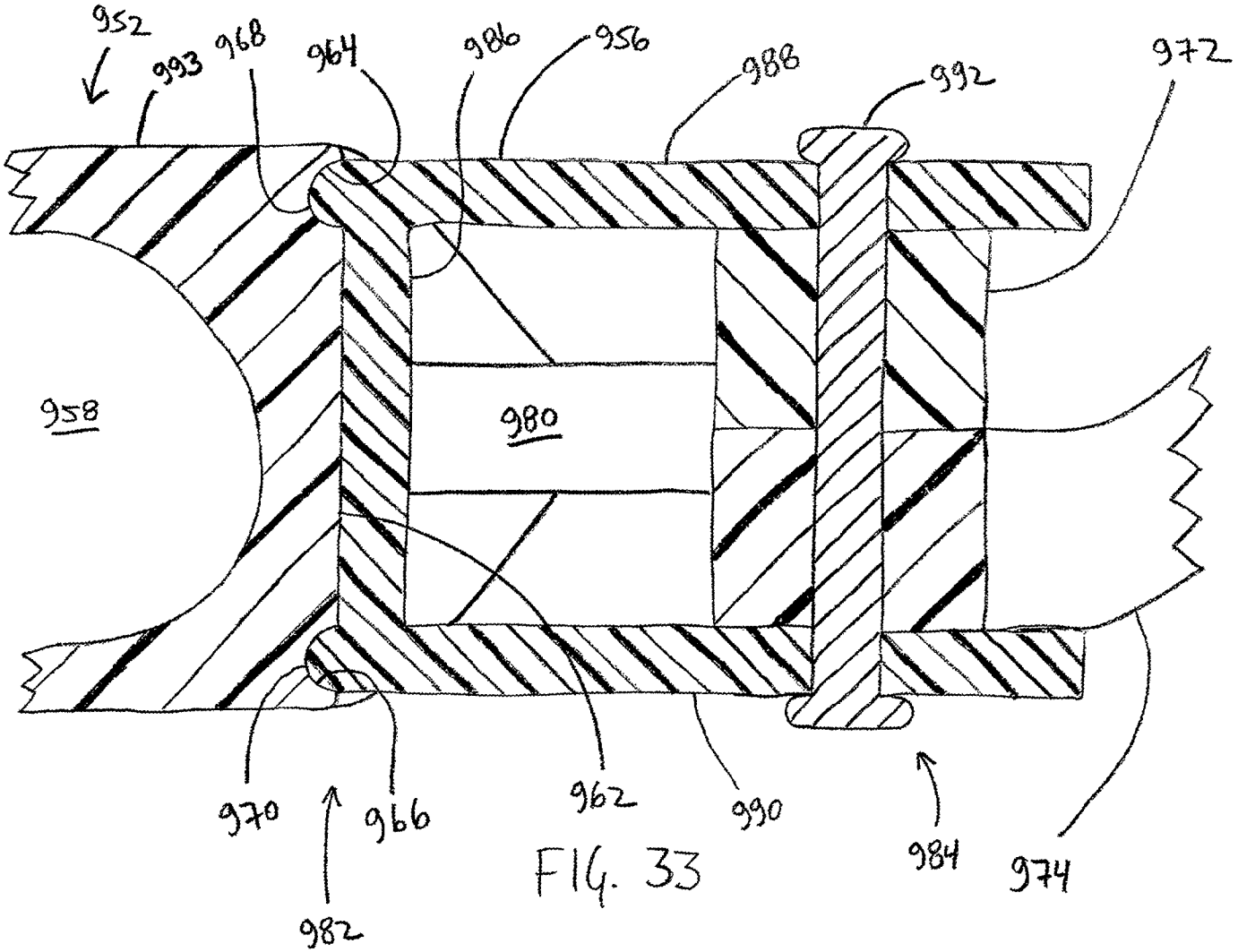
FIG. 33 is a cross-sectional view of the flipper of FIG. 32, taken along the line XXXIII-XXXIII in FIG. 32.

Referring to FIGS. 32 and 33, the spreader 956 in the embodiment shown is made from a relatively rigid thermoplastic material, and has a proximal end shown generally at 982 and a distal end shown generally at 984. At the proximal end 982, the spreader 956 has a generally rectangular proximal wall 986 that defines the projections 968 and 970 discussed above. When one or both of the projections 968 and 970 are received in one or both of the channels 964 and 966 respectively of the base 952, the proximal end 982 of the spreader 956 is thus coupled to the base 952.

The spreader 956 also has first and second generally parallel and spaced apart walls 988 and 990 extending away from the proximal wall 986 opposite the projections 968 and 970. The walls 988 and 990 define respective openings that receive a fastener 992. In the embodiment shown, the fastener 992 is a metallic rivet, although it will be appreciated that this fastener may alternatively be a threaded fastener or another fastener, for example.

Referring to FIG. 33, the first and second laterally opposite side elements 972 and 974 also define respective through-holes (not shown) for receiving the fastener 992, and the first and second laterally opposite side elements 972 and 974 are thus pivotally coupled to the distal end 984 of the spreader 956.

When the flipper 950 is not subjected to any deflecting forces, the flipper 950 may be referred to as being undeflected, such that the projections 968 and 970 at the proximal end 982 of the spreader 956 are both received within respective channels 964 and 966 in the distal end wall 962 of the base 952, and the fin 954 is generally coplanar with a bottom wall 993 of the base 952.

Figure 34:
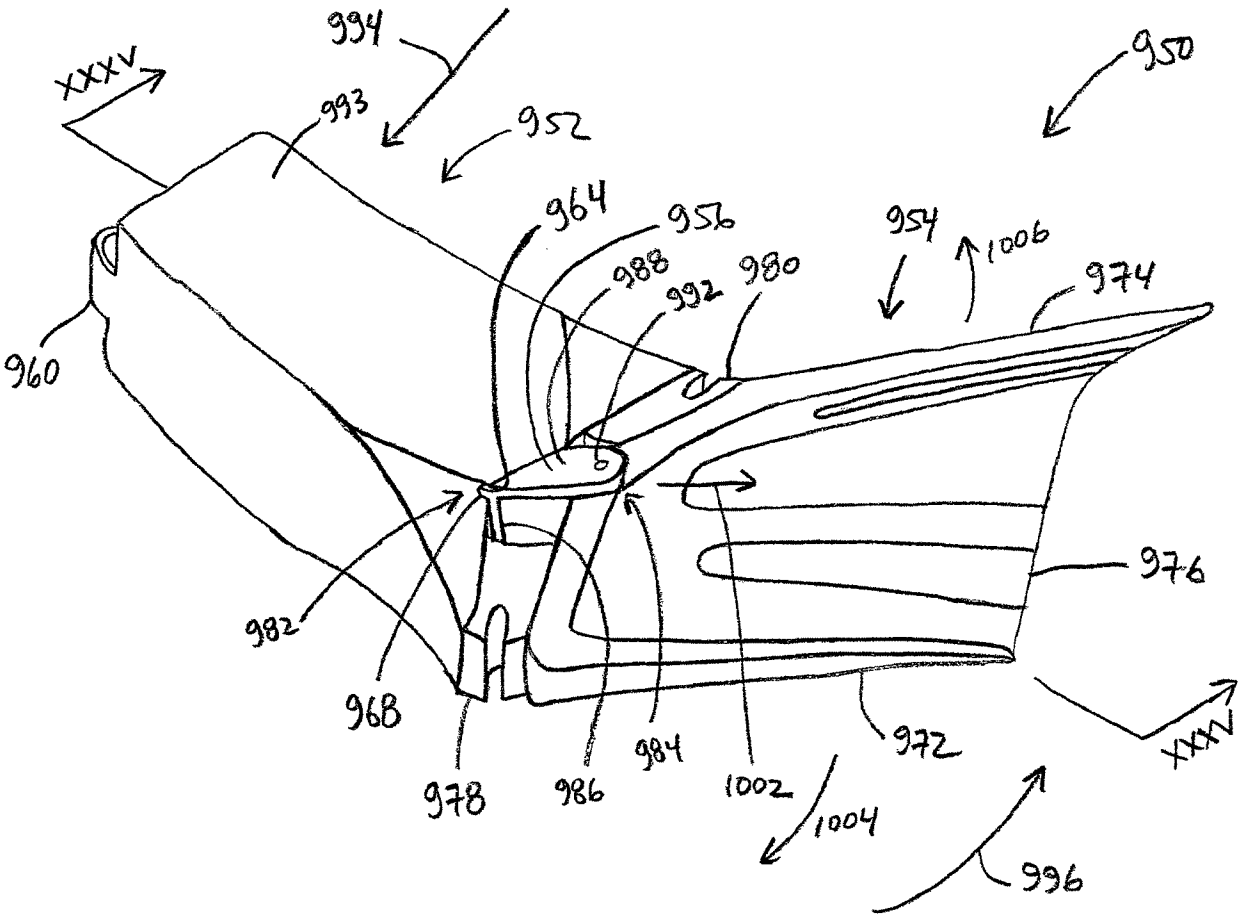
FIG. 34 is a bottom oblique view of the flipper of FIG. 32, showing the fin of the flipper of FIG. 32 deflected upward in response to a downward kick.

Referring to FIG. 34, the flipper 950 is shown deflected in response to a downward kick in the direction of the arrow 994 of the user in a fluid such as water (not shown), for example. In response to the downward kick, the fin 954 deflects in an upward deflection direction longitudinally relative to the base 952 at the first and second hinges 978 and 980 in the direction of the arrow 996. This longitudinal deflection of the fin 954 causes the first and second laterally opposite side elements 972 and 974 to rotate about the first and second hinges 978 and 980 respectively.

Figure 35:
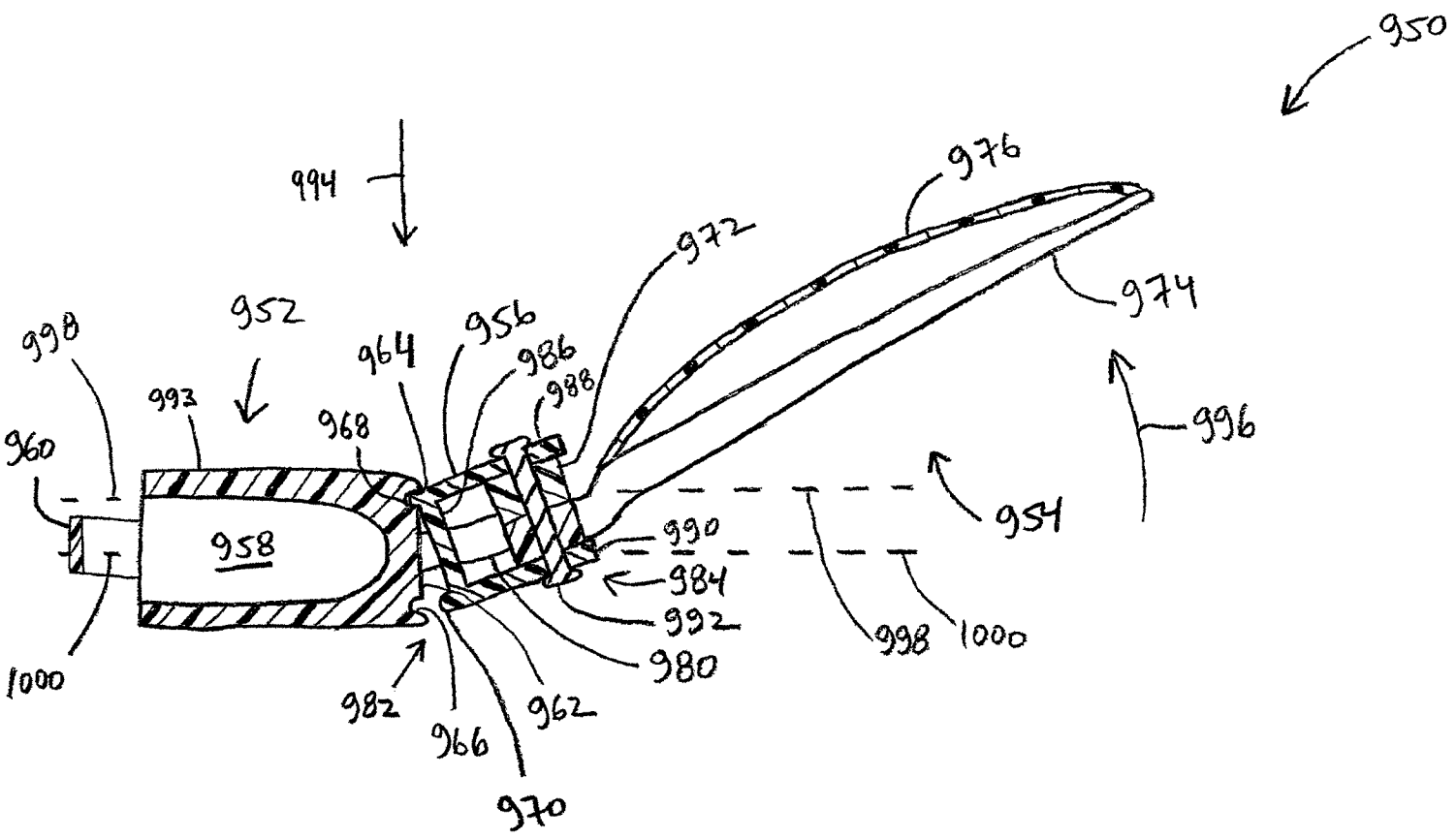
FIG. 35 is a cross-sectional view of the flipper of FIG. 32, taken along the line XXXV-XXXV in FIG. 34.

Further, the first and second laterally opposite side elements 972 and 974 are coupled to the fastener 992 such that longitudinal deflection of the fin 954 relative to the base 952 in the deflection direction of the arrow 996 causes the spreader 956 to rotate about a hinge axis defined by the projection 968 and the channel 964, while the projection 970 moves away from the channel 966, as shown in FIGS. 34 and 35. The hinge axis defined by the projection 968 and the channel 964 lies in a plane shown by the line 998 in FIG. 35. This plane is parallel to and spaced apart from a plane intersecting a longitudinal axis 1000 of the fin 954 when the fin 954 is undeflected.

Because of the separation between the respective planes shown by the lines 998 and 1000 in FIG. 35, the distal end 984 of the spreader 956 moves longitudinally relative to the fin 954 and away from the base 952 in the direction of the arrow 1002 when the spreader 956 is rotated about the hinge axis defined by the projection 968 and the channel 964 in response to longitudinal deflection of the fin 954 relative to the base 952 in the deflection direction of the arrow 996. This longitudinal movement of the distal end 984 of the spreader 956 in the direction of the arrow 1002 causes the distal end 984 of the spreader 956 to impose a force using the fastener 992 on the first and second laterally opposite side elements 972 and 974 in the direction of the arrow 1002. The first and second laterally opposite side elements 972 and 974 receive and use this force, which causes the first and second laterally opposite side elements 972 and 974 to rotate laterally about the first and second hinges 978 and 980 respectively in respective directions of the arrows 1004 and 1006 respectively, thereby spreading the first and second laterally opposite side elements 972 and 974 apart, elastically deforming the web 976 by stretching the web 976 to accommodate the spreading of the first and second laterally opposite side elements 972 and 974, and changing a lateral shape of the fin 954.

Although FIGS. 34 and 35 show the fin 954 deflected upward in the direction of the arrow 996 relative to the base 952 in response to a downward kick in the direction of the arrow 994, the fin 954 may also be deflected downward in a deflection direction opposite the direction of the arrow 996 relative to the base 952 in response to an upward kick in a direction opposite the direction of the arrow 994. In the case of such downward deflection, the spreader 956 rotates about a hinge defined by the projection 970 and the channel 966, and the projection 968 moves away from the channel 964. Such downward deflection therefore causes the first and second laterally opposite side elements 972 and 974 to spread and change the lateral shape of the fin 954 in substantially the same was as discussed above and shown in FIGS. 34 and 35 in the case of upward deflection.

In general, the aforementioned flippers 100, 240, 350, 400, 470, 570, 680, 770, 820, 920, 950, and 1090 have respective fins that are longitudinally deflectable relative to respective bases, and these fins advantageously spread laterally in response to such longitudinal deflection. Therefore, when one of the aforementioned flippers is not deflected in response to a kick, such as when a user of the flipper is coasting through water, for example, a lateral width of the flipper is relatively small and the fin is relatively planar, which may advantageously reduce drag of the flipper in the water.

However, when the user kicks up or down with the flipper in the water, the fin spreads to a relatively greater width, which may advantageously increase an effective surface area of the fin, which may increase efficiency of propulsion of the user in the water. As the user kicks with greater force, the fin is deflected by a greater degree, and spread laterally by a greater degree, and therefore the fin advantageously adapts to a degree of strength of the user's kick. Further, when the user kicks up or down with the flipper, the flipper tends to impart a concave shape to the fin in the direction of the kick. The fin thus forms a thrust channel, which in many embodiments alternates advantageously to face the kick direction. This concave shape may prevent water in the kick path of the fin from passing over lateral sides of the fin, and may facilitate directing water in the kick path of the fin towards a distal end of the fin. This concave shape may therefore advantageously facilitate more efficient flow of water around the fin. Further, such a thrust channel can form and capture a fluid vortex, thereby permitting efficient generation of thrust in the fluid. Still further, the concave shape of the fin that results from longitudinal deflection of the fin creates a relatively longitudinally long thrust channel when compared to flippers that do not actively form such concavity. Such a long thrust channel may advantageously capture a larger amount of fluid, thereby more efficiently generating thrust in the fluid. Further, creation of such a relatively long thrust channel makes more efficient use of the fin, and thus may advantageously permit the fin to be smaller or lighter, or both. Again, the flipper imparts a greater degree of concavity in response to a greater strength of kick, and again the fin advantageously adapts to a degree of strength of the user's kick.

Further, flippers such as those described herein may advantageously form a concave shape to form a thrust channel at an early stage of a kick when the fin is longitudinally deflected relative to the base by a relatively small amount. However, further longitudinal deflection of the fin relative to the base may cause the fin to spread laterally, thereby reducing concavity in the fin. Such reduced concavity in the fin advantageously urges fluid from the thrust channel towards a distal end of the fin, thereby more efficiently generating thrust.

In general, flippers such as those described herein have been found to generate thrust significantly more efficiently than some know flippers.

Further, the aforementioned flippers are advantageously adjustable in numerous ways. For example, the relative flexibilities of the spreaders 106, 246, 356, 406, 476, 478, 580, 696, and 786 may be varied to vary a degree of spreading or concavity that results from a kick by a user, and these flexibilities can thus be advantageously adjusted to accommodate the user's kicking strength. For example, a user with relatively strong legs might generally prefer relatively less-flexible spreaders to avoid causing excessive spreading or concavity, while a user with relatively less-strong legs might generally prefer relatively more-flexible spreaders that would generally cause relatively higher degrees of spreading and concavity in response to relatively weaker kicks. Still further, the substantially fixed positions of the spreaders 406, 476, and 478 can be adjusted to adjust degrees of spreading and concavity of the respective fins, and moduli of elasticity of the first and second elastomeric members 792 and 794, or of the resilient elements 896, 902, 932, and 934, can also be adjusted to adjust degrees of spreading and concavity of the respective to accommodate the user's kicking strength, for example.

Although the bases 102, 242, 352, 402, 472, 572, 682, 772, 822, 922, 952 in the embodiments shown are configured to receive and hold a foot of a user, these bases may alternatively be configured to connect to a foot-holding boot (as described below and shown in FIGS. 38 and 39, for example), or to connect to a prosthetic limb or other source of propulsive force, for example.

Figure 36:
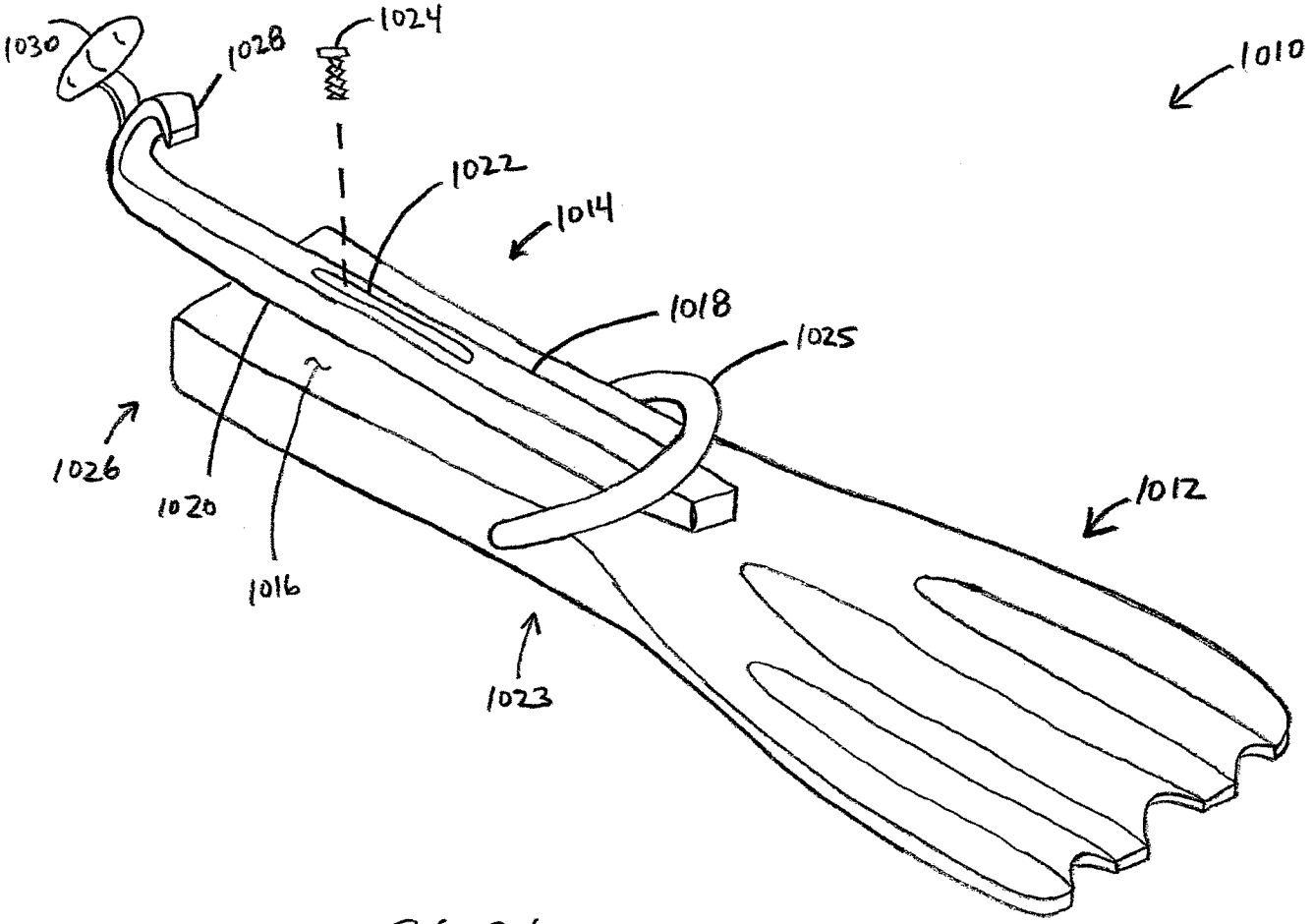
FIG. 36 is an oblique top view of a flipper in accordance with another embodiment of the invention.

Referring to FIG. 36, a flipper in accordance with another embodiment of the invention is shown generally 1010. The flipper 1010 has a fin shown generally at 1012 and a foot coupling portion shown generally at 1014. The fin 1012 may be any fin usable to generate propulsion in water, including any one of the aforementioned fins shown in FIGS. 1 to 35 and 40 to 42, for example.

The foot coupling portion 1014 includes a boot contacting surface 1016 for contacting a sole of a boot, and a boot connector 1018 on the boot contacting surface 1016. The boot connector 1018 includes an elongate portion 1020 having a generally rectangular cross section, and defining an elongate through-channel 1022 for receiving a threaded fastener 1024. The foot coupling portion 1014 has an opening (not shown) in the boot contacting surface 1016 in communication with a threaded receptacle (not shown) in the foot coupling portion 1014 for threadedly holding the threaded fastener 1024 at a selectable position along the length of the elongate through-channel 1022. The boot connector 1018 is thus adjustably positionable on the boot contacting surface 1016 by adjusting a position of the threaded fastener 1024 in the elongate through-channel 1022.

The foot coupling portion 1014 has a first end shown generally at 1023, and at the first end 1023, the foot coupling portion 1014 has a holder 1025 (which may also be referred to more generally as a "first connector") extending from laterally opposite sides of the foot coupling portion 1014 and over the boot contacting surface 1016. In the embodiment shown, the holder 1025 is a metallic bar, although it will be appreciated that alternatively other materials may be used.

The foot coupling portion 1014 also has a second end shown generally at 1026. At the second end 1026 of the foot coupling portion 1014, the boot connector 1018 includes a clasp 1028 (which may also be referred to more generally as a "second connector") above the boot contacting surface 1016 and projecting towards the first end 1023 of the foot coupling portion 1014. The boot connector 1018 also includes a handle 1030 proximate the clasp 1028 to facilitate positioning the clasp 1028.

Figure 37:
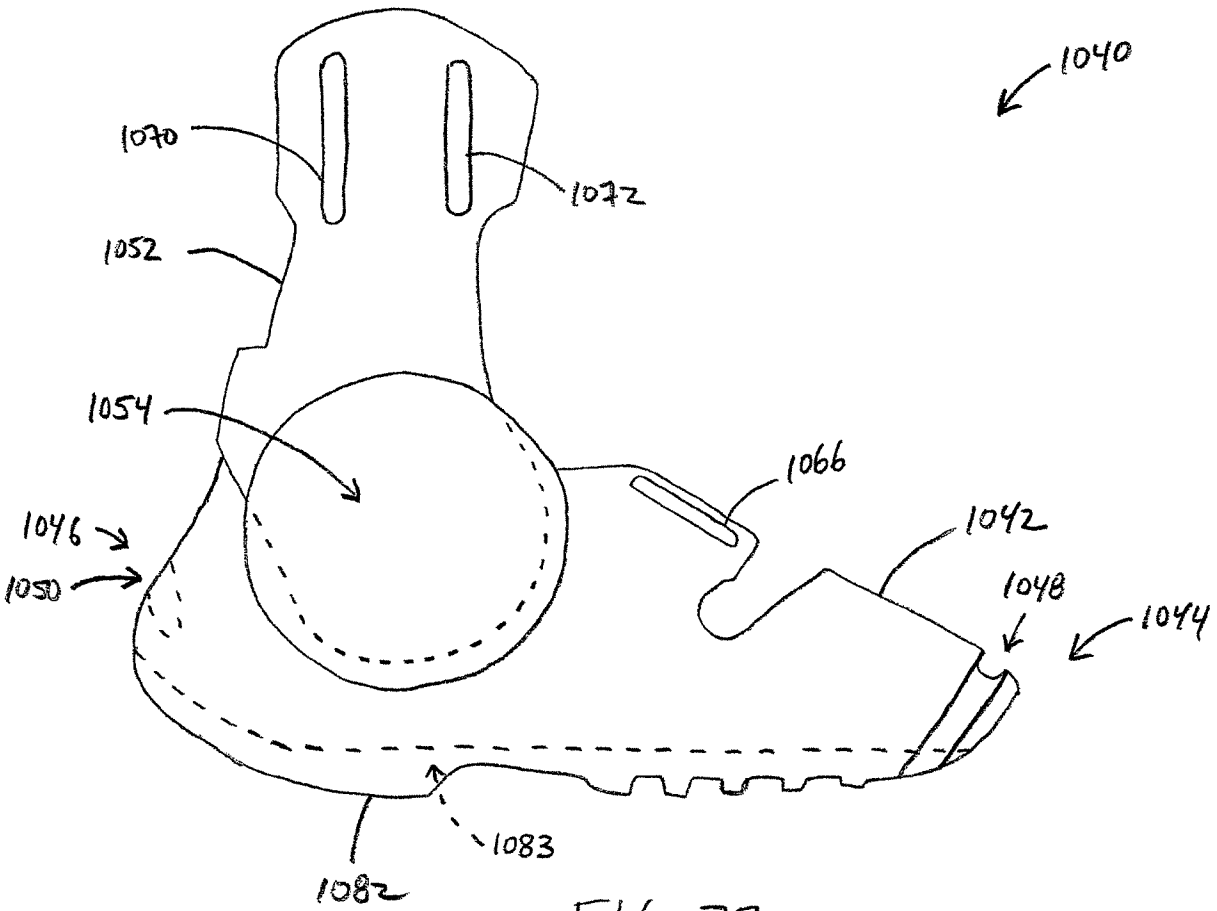
FIG. 37 is a side view of a boot shell in accordance with another embodiment of the invention.

Referring to FIG. 37, a boot shell in accordance with another embodiment of the invention is shown generally at 1040. The boot shell 1040 in the embodiment shown is made from a relatively rigid thermoplastic material. The boot shell 1040 includes a foot holding portion 1042 having a first end (or, more generally, a "first region") shown generally at 1044 and a second end (or, more generally, a "second region") shown generally at 1046. In the embodiment shown, the first end 1044 is opposite, or more generally spaced apart from, the second end 1046. At the first end 1044, the foot holding portion 1042 of the boot shell 1040 defines a first receptacle shown generally at 1048 that is complementary to the holder 1025 shown in FIG. 36 for receiving the holder 1025. The holder 1025 and the first receptacle 1048 are thus complementary connectors. Further, at the second end 1046 the foot holding portion 1042, the boot shell 1040 defines a second receptacle shown generally at 1050 that is complementary to the clasp 1028 shown in FIG. 36 for receiving the clasp 1028. The clasp 1028 and the second receptacle 1050 are thus complementary connectors. The boot shell 1040 also includes an ankle stabilizer 1052 rotatably coupled to the foot holding portion 1042 at a hinge shown generally at 1054. The foot holding portion 1042 also has a sole 1082 that defines a longitudinal channel shown generally at 1083.

Figure 38:
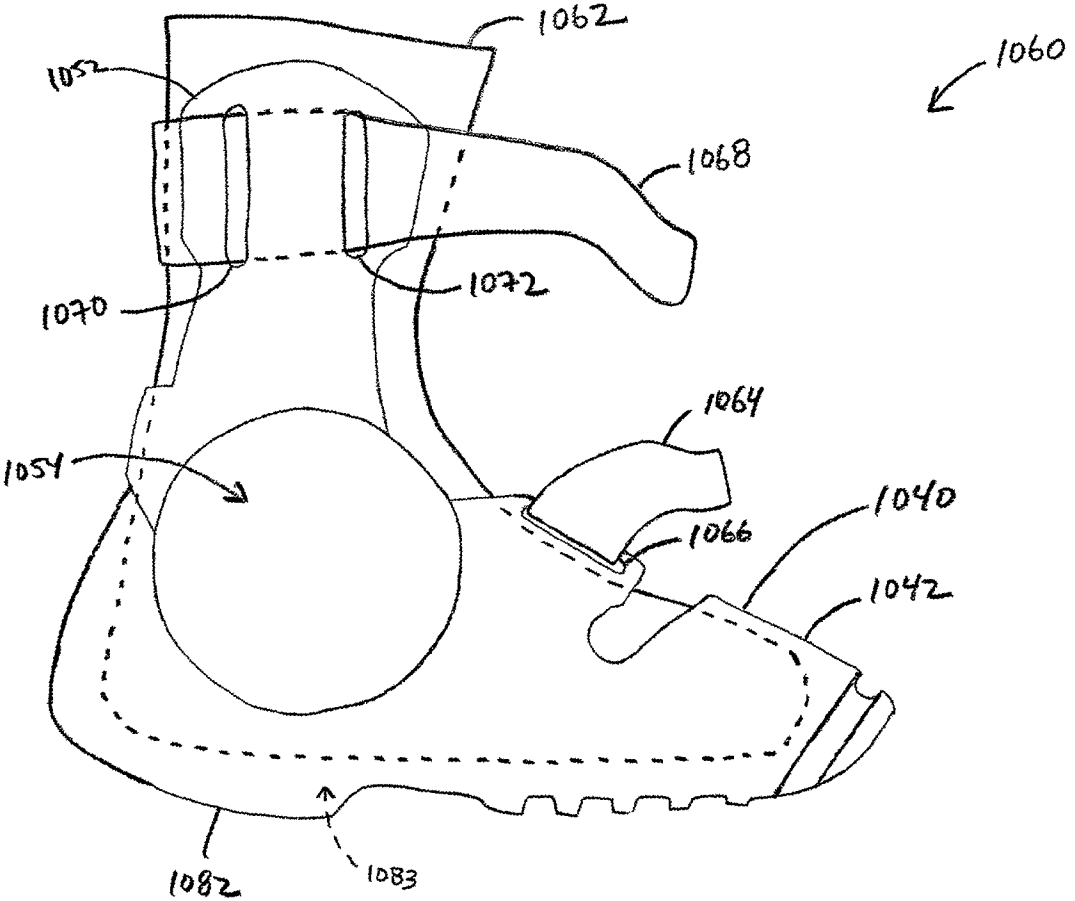
FIG. 38 is a side view of a boot in accordance with another embodiment of the invention.

Referring to FIG. 38, a boot in accordance with another embodiment of the invention is shown generally at 1060. The boot 1060 includes the boot shell 1040 shown in FIG. 37, and further includes a liner 1062 made from a material such as neoprene, for example. The liner 1062 in the embodiment shown is removable from the boot shell 1040, but alternatively the liner 1062 and the boot shell 1040 may be integrally formed. Also, the boot shell 1040 may alternatively hold a foot of a user without the liner 1062, for example.

In use, a user may position the liner 1062 around a foot of the user, fastening the liner 1062 to the foot with a zipper or other fastener (not shown), for example. The liner 1062 is received within the boot shell 1040 such that a foot in the liner 1062 is held in the foot holding portion 1042 of the boot shell 1040. A strap 1064 received through an opening 1066 in the boot shell 1040 facilitates holding the liner 1062 in the foot holding portion 1042 of the boot shell 1040. Further, a strap 1068 passes through openings 1070 and 1072 in the ankle stabilizer 1052 of the boot shell 1040 to fasten an ankle within the liner 1062 to the ankle stabilizer 1052. Because the ankle stabilizer 1052 is rotatable about the hinge 1054, the ankle stabilizer 1052 may advantageously permit flexion and extension of an ankle (not shown) in the liner 1062 and in the boot shell 1040 while preventing pronation or supination of the ankle, for example.

Figure 39:
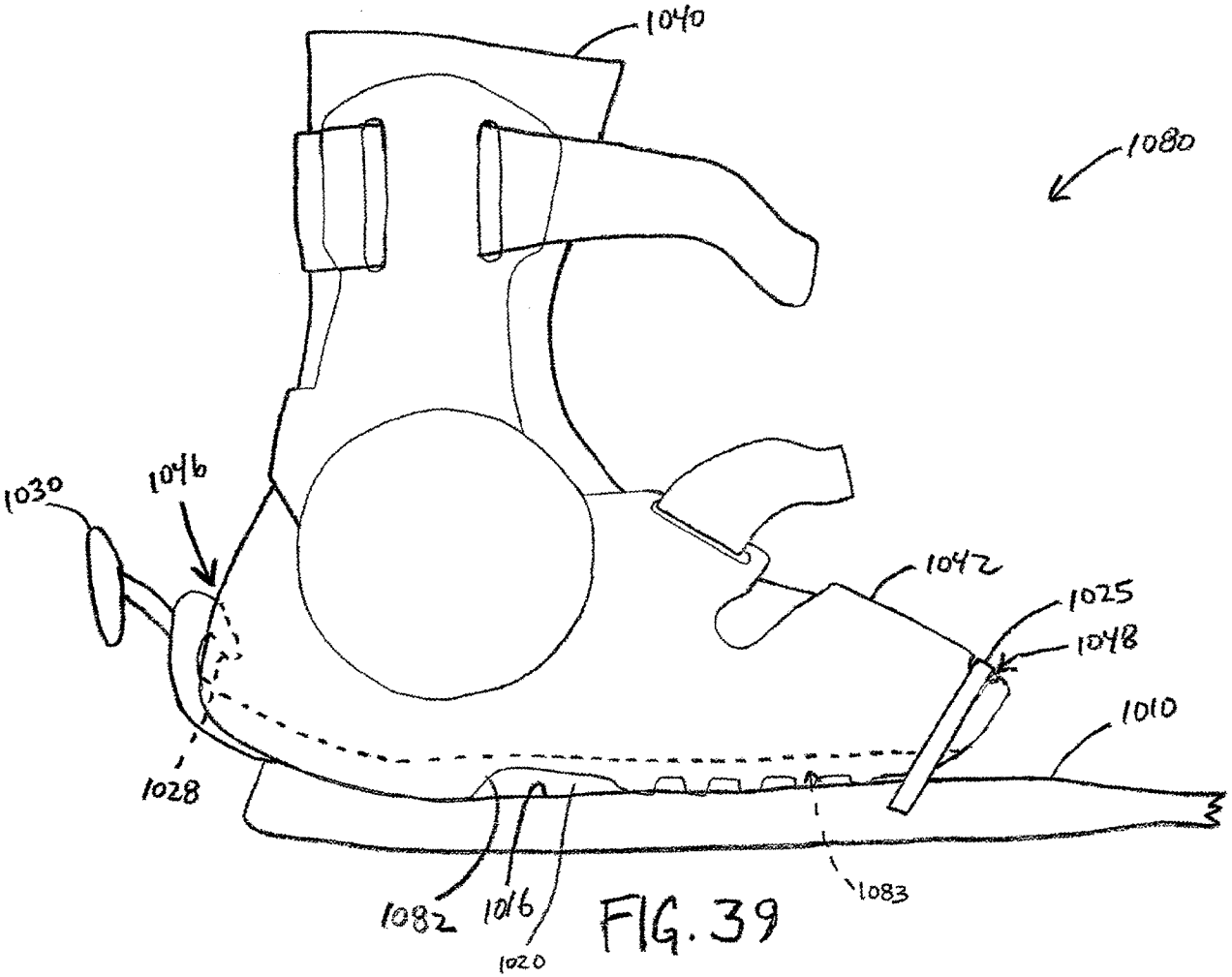
FIG. 39 is a side view of a boot-flipper system in accordance with another embodiment of the invention.

Referring to FIG. 39, a boot-flipper system in accordance with another embodiment of the invention is shown generally at 1080. The system 1080 includes the flipper 1010 shown in FIG. 36 and the boot 1060 shown in FIG. 38. The sole 1082 of the foot holding portion 1042 contacts the boot contacting surface 1016 of the flipper 1010, and the elongate portion 1020 of the boot connector 1018 is received within the longitudinal channel 1083 of the foot holding portion 1042 to prevent lateral movement of the foot holding portion 1042 relative to the foot coupling portion 1014. Further, the holder 1025 of the flipper 1010 is received within the first receptacle 1048 of the foot holding portion 1042, and the clasp 1028 of the flipper 1010 is received in the second receptacle 1050 of the foot holding portion 1042. The boot-flipper system 1080 thus facilitates coupling a foot (not shown) in the foot holding portion 1042 to the flipper 1010. As indicated above, the ankle stabilizer 1052 permits flexion and extension of an ankle (not shown) in the liner 1062 and in the boot shell 1040 while preventing pronation or supination of the ankle, and therefore the boot-flipper system 1080 may advantageously offer a user a high degree of control over movement of the fin 1012 of the flipper 1010 coupled to the boot 1060.

The boot-flipper system 1080 facilitates coupling a foot to the flipper 1010 in the foot holding portion 1042, and a user may select a boot such as the boot 1060 but having a foot holding portion such as the foot holding portion 1042 that comfortably fits a foot of the user. Advantageously, the user can select such a boot independently of a flipper such as the flipper 1010, and therefore with one such boot, the user may use any flipper such as the 1010 while advantageously using the boot selected to fit the user's foot comfortably.

Figure 43:
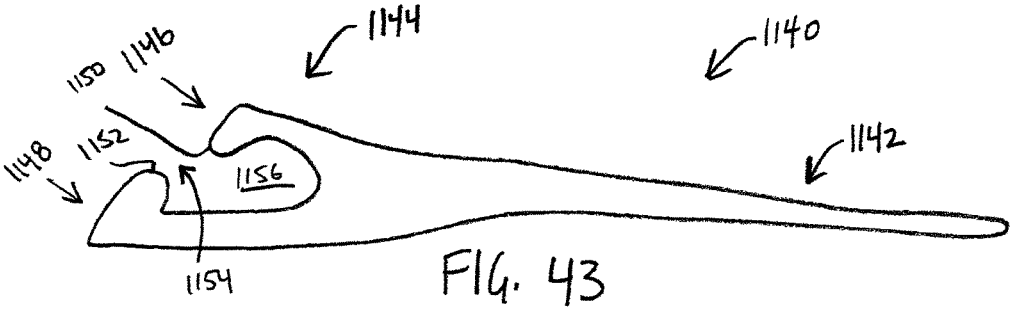
FIG. 43 is a side view of a flipper in accordance with another embodiment of the invention.

Referring to FIG. 43, a flipper in accordance with another embodiment of the invention is shown generally at 1140. The flipper 1140 has a fin shown generally at 1142 and a foot coupling portion shown generally at 1144. The fin 1142 may be any fin usable to generate propulsion in water, including any one of the aforementioned fins shown in FIGS. 1 to 35 and 40 to 42, for example.

The foot coupling portion 1144 has a first end shown generally at 1146 and a second end shown generally at 1148 opposite the first end 1146. The foot coupling portion 1144 defines a first inward projection 1150 on the first end 1146, and a second inward projection 1152 on the second end 1148. The first and second inward projections 1150 and 1152 are spaced apart by a gap shown generally at 1154, and the gap 1154 is an opening to a recess 1156 in the foot coupling portion 1144.

Figure 44:
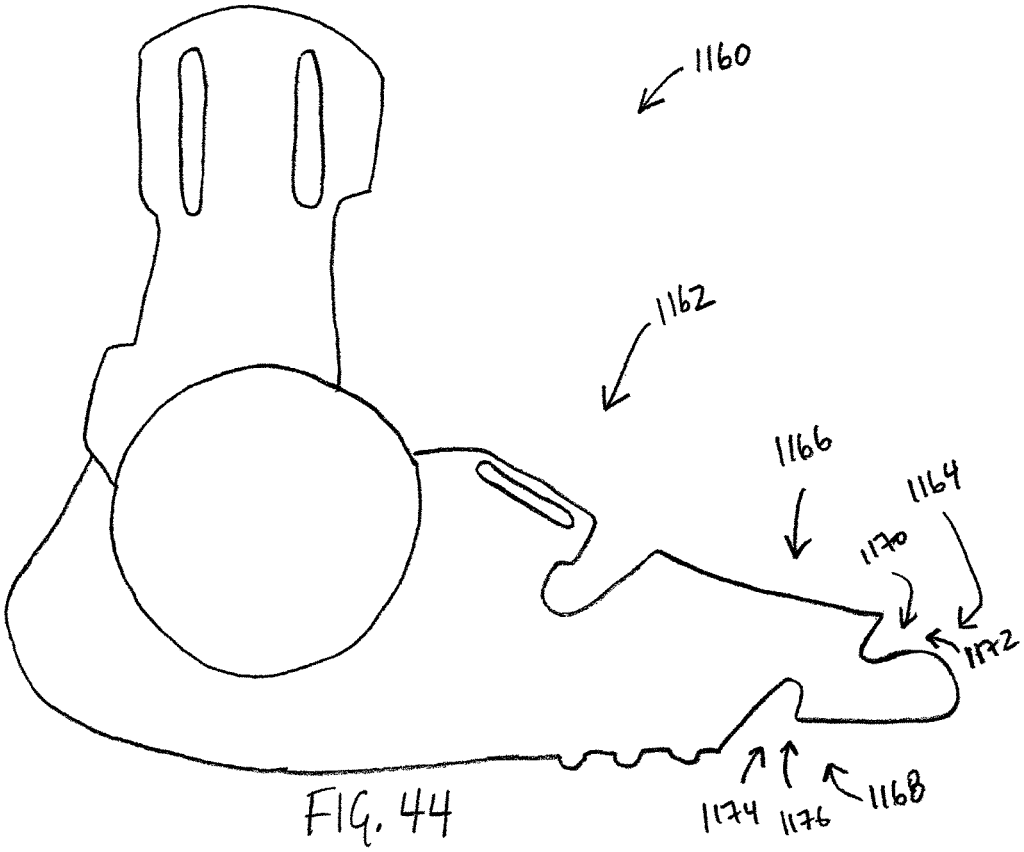
FIG. 44 is a side view of a boot shell in accordance with another embodiment of the invention.

Referring to FIG. 44, a boot shell in accordance with another embodiment of the invention is shown generally at 1160. The boot shell 1160 is made from a relatively rigid thermoplastic material and includes a foot holding portion shown generally at 1162. The foot holding portion 1162 has a front end shown generally at 1164, and the front end 1164 has a top side shown generally at 1166 and a bottom side shown generally at 1168. In a first region shown generally at 1170 on the top side 1166 of the front end 1164 of the foot holding portion 1162, the boot shell 1160 defines a first receptacle shown generally at 1172 complementary to the first inward projection 1150 of the flipper 1140 (shown in FIG. 43). Also, in a second region shown generally at 1174 on the bottom side 1168 of the front end 1164 of the foot holding portion 1162, the boot shell 1160 defines a second receptacle shown generally at 1176 complementary to the second inward projection 1152 of the flipper 1140 (shown in FIG. 43).

Referring to FIGS. 43 and 44, in operation, a user may insert a liner (such as the liner 1062 shown in FIG. 38, for example) in the boot shell 1160, and the user may connect the flipper 1140 to the boot shell 1160 by receiving the first inward projection 1150 in the first receptacle 1172 and by receiving the second inward projection 1152 in the second receptacle 1176. The first and second connectors 150 and 152 thus function as connectors, clasps, and holders, and the first and second receptacles 172 and 176 thus function as connectors, for connecting the flipper 1140 to a boot including the boot shell 1160. In the embodiment shown, the foot coupling portion 1144 is made from a relatively rigid but deformable thermoplastic material, so that the boot coupling portion 1144 may be temporarily deformed to connect the flipper 1140 to a boot including the boot shell 1160 as described above.

While specific embodiments of the invention have been described and illustrated, such embodiments should be considered illustrative of the invention only and not as limiting the invention as construed in accordance with the accompanying claims.

The embodiments of the invention in which an exclusive property of privilege is claimed are defined as follows:

1. A method of changing a lateral shape of a deformable fin having first and second laterally opposite side elements connected to a base, the method comprising:

in response to longitudinal deflection of the fin relative to the base from an undeflected position to a first deflected position, deflecting the first and second laterally opposite side elements about first and second hinge axes respectively relative to the base in a first deflection direction;

wherein the first and second hinge axes are disposed at respective acute angles from a central longitudinal axis of the fin in a direction longitudinally away from the base toward the fin; and wherein deflecting the first and second laterally opposite side elements about the first and second hinge axes respectively relative to the base in the first deflection direction comprises spreading the first and second laterally opposite side elements apart.

2. The method of claim 1, further comprising:

in response to longitudinal deflection of the fin relative to the base from the undeflected position to a second deflected position on an opposite side of the undeflected position from the first deflected position, deflecting the first and second laterally opposite side elements about the first and second hinge axes respectively relative to the base in a second deflection direction opposite the first deflection direction, wherein deflecting the first and second laterally opposite side elements about the first and second hinge axes respectively relative to the base in the second deflection direction comprises spreading the first and second laterally opposite side elements apart.

3. The method of claim 1, wherein deflecting the first and second laterally opposite side elements about the first and second hinge axes respectively relative to the base in the first deflection direction comprises imparting a concave shape to the fin opposite the first deflection direction.

4. The method of claim 1, wherein deflecting the first and second laterally opposite side elements about the first and second hinge axes respectively comprises rotating the first and second laterally opposite side elements about the respective first and second hinge axes.

5. The method of claim 1, wherein deflecting the first and second laterally opposite side elements about the first and second hinge axes respectively comprises deforming respective flexible hinges defined by at least one flexible material and extending away from the central longitudinal axis of the fin and longitudinally away from the base and towards the fin, at the respective acute angles from the central longitudinal axis of the fin.

6. A flipper apparatus comprising:

a base;

a deformable fin having first and second laterally opposite side elements; and first and second hinges connecting the first and second laterally opposite side elements respectively to the base, wherein the first and second hinges have first and second hinge axes respectively, disposed at respective acute angles from a central longitudinal axis of the fin in a direction longitudinally away from the base and toward the fin;

wherein the first and second laterally opposite side elements are deflectable about the first and second hinge axes respectively relative to the base in a first deflection direction in response to longitudinal deflection of the fin relative to the base from an undeflected position to a first deflected position; and wherein the first and second hinges are configured to spread the first and second laterally opposite side elements apart in response to deflection of the first and second laterally opposite side elements about the first and second hinges respectively relative to the base in a first deflection direction caused by longitudinal deflection of the fin relative to the base from the undeflected position to the first deflected position.

7. The method of claim 1, wherein spreading the first and second laterally opposite side elements apart comprises stretching a web coupled to and extending between the first and second laterally opposite side elements.

8. The method of claim 1, wherein deflecting the first and second laterally opposite side elements about the first and second hinge axes respectively comprises deflecting the first and second laterally opposite side elements about the first and second hinge axes respectively in water in response to a kick from a single foot of a user in the water.

9. The method of claim 1, wherein deflecting the first and second laterally opposite side elements about the first and second hinge axes respectively comprises moving the fin from one side of a space between the first and second hinge axes to an opposite side of the space between the first and second hinges.

10. The method of claim 1, wherein the first and second laterally opposite side elements are connected to the base by respective first and second hinges extending along the respective first and second hinge axes.

11. A flipper apparatus comprising:

a base;

a deformable fin having first and second laterally opposite side elements coupled to the base;

a means for conforming movement of the first laterally opposite side element relative to the base about a first hinge axis, wherein the first hinge axis extends away from a central longitudinal axis of the fin, and longitudinally away from the base and towards the fin, at a first acute angle from the central longitudinal axis of the fin;

a means for conforming movement of the second laterally opposite side element relative to the base about a second hinge axis, wherein the second hinge axis extends away from the central longitudinal axis of the fin, and longitudinally away from the base and towards the fin, at a second acute angle from the central longitudinal axis of the fin; and a means for spreading, wherein the means for spreading is configured to spread the first and second laterally opposite side elements apart in response to deflection of the first and second laterally opposite side elements about the first and second hinge axes respectively relative to the base in a first deflection direction caused by longitudinal deflection of the fin relative to the base from an undeflected position to a first deflected position.

12. The apparatus of claim 11, wherein the means for conforming movement of the first laterally opposite side element and the means for conforming movement of the second laterally opposite side element are configured to impart, in response to the deflection of the first and second laterally opposite side elements about the first and second hinge axes respectively relative to the base caused by the longitudinal deflection of the fin relative to the base from the undeflected position to the first deflected position, a concave shape to the fin, opposite the first deflection direction.

13. The apparatus of claim 11, wherein the means for spreading is further configured to spread the first and second laterally opposite side elements apart in response to deflection of the first and second laterally opposite side elements about the first and second hinge axes respectively relative to the base in a second deflection direction opposite the first deflection direction caused by longitudinal deflection of the fin relative to the base from the undeflected position to a second deflected position on an opposite side of the undeflected position from the first deflected position.

14. The apparatus of claim 6, wherein the first and second hinges comprise respective pivots extending away from the central longitudinal axis of the fin, and longitudinally away from the base and towards the fin, at the respective acute angles from the central longitudinal axis of the fin.

15. The apparatus of claim 6, wherein the first and second hinges comprise respective flexible hinges defined by at least one flexible material and extending away from the central longitudinal axis of the fin, and longitudinally away from the base and towards the fin, at the respective acute angles from the central longitudinal axis of the fin.

16. The apparatus of claim 11, further comprising a means for coupling the base to a foot of a user.

17. The apparatus of claim 11, further comprising an elastically deformable web coupled to and extending between the first and second laterally opposite side elements.

18. The apparatus of claim 11, wherein, in response to longitudinal deflection of the fin relative to the base, the fin is movable from one side of a space between the first and second hinge axes to an opposite side of the space between the first and second hinge axes.

19. The apparatus of claim 6, wherein the base is configured to connect to a foot-holding boot.

20. The apparatus of claim 6, wherein the first and second hinges are configured to impart a concave shape to the fin, opposite the first deflection direction, in response to the deflection of the first and second laterally opposite side elements about the first and second hinges respectively relative to the base in the first deflection direction caused by the longitudinal deflection of the fin relative to the base from the undeflected position to the first deflected position.

21. The apparatus of claim 6, wherein the first and second hinges are configured to spread the first and second laterally opposite side elements apart in response to deflection of the first and second laterally opposite side elements about the first and second hinge axes respectively relative to the base in a second deflection direction opposite the first deflection direction caused by longitudinal deflection of the fin relative to the base from the undeflected position to a second deflected position on an opposite side of the undeflected position from the first deflected position.

22. The apparatus of claim 6, wherein the fin is sized to be used in water on only a single foot of a user.

23. The apparatus of claim 6, wherein the apparatus is configured to connect to only a single foot of a user.

24. The apparatus of claim 6, further comprising an elastically deformable web coupled to and extending between the first and second laterally opposite side elements.

25. The apparatus of claim 6, wherein, in response to longitudinal deflection of the fin relative to the base, the fin is movable from one side of a space between the first and second hinges to an opposite side of the space between the first and second hinges.

26. The apparatus of claim 6, wherein the first and second hinges extend away from the central longitudinal axis of the fin, and longitudinally away from the base and towards the fin, at the respective acute angles from the central longitudinal axis of the fin.

* * * * *